US011787199B2

(12) United States Patent
Arakane et al.

(10) Patent No.: US 11,787,199 B2
(45) Date of Patent: Oct. 17, 2023

(54) IMAGE RECORDING APPARATUS

(71) Applicant: BROTHER KOGYO KABUSHIKI KAISHA, Nagoya (JP)

(72) Inventors: Satoru Arakane, Nagoya (JP); Masao Mimoto, Kitanagoya (JP); Tsuyoshi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 18/061,509

(22) Filed: Dec. 5, 2022

(65) Prior Publication Data

US 2023/0102944 A1 Mar. 30, 2023

Related U.S. Application Data

(62) Division of application No. 17/031,256, filed on Sep. 24, 2020, now Pat. No. 11,541,668.

(30) Foreign Application Priority Data

Sep. 27, 2019 (JP) ..... 2019-176441

(51) Int. Cl.
*B41J 2/21* (2006.01)
*B41J 11/00* (2006.01)
*B41J 2/045* (2006.01)

(52) U.S. Cl.
CPC ..... *B41J 2/2132* (2013.01); *B41J 2/0458* (2013.01); *B41J 2/21* (2013.01); *B41J 11/008* (2013.01)

(58) Field of Classification Search
None
See application file for complete search history.

(56) References Cited

U.S. PATENT DOCUMENTS

2003/0043219 A1 3/2003 Kojima
2003/0197756 A1 10/2003 Inoue et al.
2010/0182366 A1 7/2010 Takagi et al.
(Continued)

FOREIGN PATENT DOCUMENTS

JP 2003-062984 A 3/2003
JP 2004-058617 A 2/2004
(Continued)

OTHER PUBLICATIONS

Office Action dated May 12, 2022 from parent U.S. Appl. No. 17/031,256.
(Continued)

*Primary Examiner* — Justin Seo
(74) *Attorney, Agent, or Firm* — Scully, Scott, Murphy & Presser, PC

(57) ABSTRACT

There is provided an image recording apparatus including: a conveyer; a carriage; a recording head; a memory; and a controller. The controller is configured to cause the conveyer to convey a recording medium in a conveyance direction such that dot recording ranges are partially overlapped with each other in the conveying operation. In a case that a predetermined condition is fulfilled, the controller is configured to cause the recording head to record a dot including a correcting portion by correcting discharge, and in a case that the predetermined condition is not fulfilled, the controller is configured to cause the recording head to record the dot including the correcting portion by ordinary discharge.

6 Claims, 30 Drawing Sheets

(56) References Cited

U.S. PATENT DOCUMENTS

| | | | |
|---|---|---|---|
| 2015/0254536 | A1 | 9/2015 | Hosaka |
| 2015/0254538 | A1 | 9/2015 | Fukazawa et al. |
| 2019/0255858 | A1 | 8/2019 | Slaats et al. |
| 2019/0299673 | A1 | 10/2019 | Mimoto et al. |

FOREIGN PATENT DOCUMENTS

| | | | |
|---|---|---|---|
| JP | 2010-194737 | A | 9/2010 |
| JP | 2010-260338 | A | 11/2010 |
| JP | 2015-168065 | A | 9/2015 |
| JP | 2015-168086 | A | 9/2015 |
| JP | 2019-177556 | A | 10/2019 |

OTHER PUBLICATIONS

Notice of Allowance dated Sep. 8, 2022 from parent U.S. Appl. No. 17/031,256.

Notice of Reasons for Refusal dated Aug. 1, 2023 from related Japanese Patent Application No. 2019- 176441 together with English language translation.

BIDIRECTIONAL RECORDING MODE
CASE IN WHICH GAP IS UNIFORM

BIDIRECTIONAL RECORDING MODE
CASE IN WHICH GAP IS LARGER ON MORE DOWNSTREAM SIDE
IN CONVEYANCE DIRECTION (WITHOUT CORRECTION OF IMAGE DATA)

BIDIRECTIONAL RECORDING MODE
CASE IN WHICH GAP IS LARGER ON MORE DOWNSTREAM SIDE
IN CONVEYANCE DIRECTION (WITH CORRECTION OF IMAGE DATA)

SPECIFIED IMAGE DATA (BEFORE CORRECTION)

SPECIFIED IMAGE DATA (AFTER CORRECTION)

UNIDIRECTIONAL RECORDING MODE
CASE IN WHICH GAP IS LARGER ON MORE DOWNSTREAM SIDE IN CONVEYANCE DIRECTION (WITH CORRECTION OF IMAGE DATA)

CASE IN WHICH RECORDING POSITION IS WITHIN PREDETERMINED RANGE (WITH CORRECTION OF IMAGE DATA)

CASE IN WHICH POSITION OF CARRIAGE IS WITHIN LEFT END PORTION RANGE (WITH CORRECTION OF IMAGE DATA)

CASE IN WHICH POSITION OF CARRIAGE IS WITHIN LEFT END PORTION RANGE (WITH CORRECTION OF IMAGE DATA)

BIDIRECTIONAL RECORDING MODE
CASE IN WHICH GAP IS LARGE ON MORE UPSTREAM SIDE
IN CONVEYANCE DIRECTION (WITH CORRECTION OF IMAGE DATA)

UNIDIRECTIONAL RECORDING MODE
CASE IN WHICH GAP IS LARGE ON MORE UPSTREAM SIDE
IN CONVEYANCE DIRECTION (WITH CORRECTION OF IMAGE DATA)

CASE IN WHICH DEVIATION OF IMAGE IS ABSENT

CASE IN WHICH DEVIATION OF IMAGE IS PRESENT (WITHOUT CORRECTION OF IMAGE DATA)

CASE IN WHICH DEVIATION OF IMAGE IS PRESENT (WITH CORRECTION OF IMAGE DATA)

CASE IN WHICH IMAGE DATA IS NOT CORRECTED

CASE IN WHICH IMAGE DATA IS CORRECTED

CASE IN WHICH IMAGE DATA IS NOT CORRECTED

CASE IN WHICH IMAGE DATA IS CORRECTED

UNIDIRECTIONAL RECORDING MODE
(WITH CORRECTION OF IMAGE DATA)

WITH CORRECTION OF IMAGE DATA

IMAGE RECORDING APPARATUS

REFERENCE TO RELATED APPLICATIONS

This application is a divisional of U.S. patent application Ser. No. 17/031,256 filed on Sep. 24, 2020 that claims priority from Japanese Patent Application No. 2019-176441, filed on Sep. 27, 2019. The entire contents of each of which is incorporated herein by reference.

BACKGROUND ART

Background

Description of the Related Art

As an example of the image recording apparatus for recording an image, an ink-jet printer is known, which records an image by discharging an ink from a head. In the case of a certain known ink-jet printer, an image is printed on the paper by alternately repeating a conveying operation in which the paper (example of the recording medium) is moved in the conveyance direction and a printing operation in which the ink is discharged while moving nozzles in the scanning direction to form dot arrays.

In the meantime, in the case of the ink-jet printer of this type, various types of deterioration of the image quality may arise when a certain image is printed by means of the two continuous printing operations. A technique is known, which suppresses the banding that is a kind of the image quality deterioration as described above. Specifically, when the mutually adjacent dot arrays are formed by different printing operations, it is feared that the banding may occur on account of the fact that the condition of mixing of the ink provided between the dot arrays differs as compared with a case in which the mutually adjacent dot arrays are formed by an identical printing operation. Conventionally, in order to suppress the banding, the ink amount to be discharged is restricted on the basis of the information relevant to the color of the image when at least one dot array is formed when the mutually adjacent dot arrays are formed by the different printing operations.

DESCRIPTION

Summary

Further, as a kind of the image quality deterioration as described above, the deviation of the image is known, which occurs at the joint portion of images formed by the two continuous printing operations. The deviation of the image arises at the joint portion of the images formed by the two continuous printing operations such that the positions of formation of the dot arrays formed by one printing operation are deviated as a whole in the scanning direction with respect to the positions of formation of the dot arrays formed by the other printing operation. The factor of the occurrence of the deviation in the formation position of the dot array is exemplified, for example, by the difference between the upstream and the downstream in the conveyance direction in relation to the distance of separation between the head and the paper when the printing operation is performed.

Further, as for the image recording apparatus, an image recording apparatus of the line type is also known, which has a plurality of recording heads aligned in a direction intersecting the conveyance direction of the recording medium (see FIG. 21A). Also in the case of the image recording apparatus of the line type, the deviation of the image may arise at a joint portion of images formed by the two adjacent recording heads such that the positions of formation of the dots formed by one recording head are deviated as a whole in the scanning direction with respect to the positions of formation of the dots formed by the other recording head. Conventionally, no countermeasure is known against the deviation of the image as described above.

In view of the above, it is conceived that any process is performed in order to make the deviation of the image hardly conspicuous. However, if the process for making the deviation hardly conspicuous is evenly performed when the image is recorded, the image quality of the image to be recorded is conversely deteriorated in some cases.

Accordingly, an object of the present disclosure is to provide an image recording apparatus which is capable of making the deviation of an image hardly conspicuous and which does not greatly deteriorate the image quality of the image to be recorded.

According to an aspect of the present disclosure, there is provided an image recording apparatus including: a conveyer configured to convey a recording medium in a conveyance direction; a carriage configured to move reciprocatively in a scanning direction intersecting the conveyance direction; a recording head held on the carriage and including a discharge surface in which nozzle arrays including a plurality of nozzles arranged in the conveyance direction are opened; a memory configured to store image data which includes a plurality of dot elements corresponding to a plurality of dots to be recorded on the recording medium, and in which discharge amounts of a liquid to be discharged in a case that the corresponding dots are recorded are set for the plurality of dot elements respectively; and a controller configured to execute recording of an image on the recording medium by alternately executing a recording pass in which the dots are recorded on the recording medium by causing the recording head to discharge, from the plurality of nozzles, the liquid in the discharge amounts set for the dot elements of the image data while moving the carriage in the scanning direction and a conveying operation in which the conveyer is caused to convey the recording medium in the conveyance direction. The controller is configured to cause the conveyer to convey the recording medium in the conveyance direction such that dot recording ranges, in which the dots are recorded in the two continuous recording passes, are partially overlapped with each other in the conveying operation. In an overlap range in which the dot recording ranges of the two continuous recording passes are overlapped with each other, the controller is configured to cause the recording head to record a dot array corresponding to one line in the scanning direction by the two continuous recording passes while being mutually complemented. In a case that a specified image, which includes a plurality of discharge dots corresponding to the dot elements included in the plurality of dot elements of the image data and having the set discharge amounts larger than zero and which has a width corresponding to the plurality of dots in each of the conveyance direction and the scanning direction, is recorded while ranging over the overlap range, the controller is configured to judge whether or not a predetermined condition is fulfilled, the predetermined condition including at least one of a first condition and a second condition, the first condition relating to a duty as a ratio of an areal size for recording the discharge dots corresponding to the dot elements having the discharge amounts larger than zero with respect to an areal size of an entire area in the area adjacent in the scanning direction to a correcting portion, the second condition relating to a positional deviation in the scanning direction of a landing position of the liquid discharged from the nozzle between the two continuous recording passes, wherein the correcting portion is an end portion in the scanning direction of an image area recorded in the overlap range in the specified image. In a case that the predetermined condition is fulfilled, the controller is configured to cause the recording head to record the dot including the correcting portion by correcting discharge in which the liquid in a discharge amount smaller than the discharge amount set for the dot element corresponding to the dot is discharged from at least one of the plurality of nozzles. In a case that the predetermined condition is not fulfilled, the controller is configured to cause the recording head to record the dot including the correcting portion by ordinary discharge in which the liquid in the discharge amount set for the dot element corresponding to the dot is discharged from at least one of the plurality of nozzles.

According to the present disclosure, it is possible to make the deviation of the image hardly conspicuous by recording the dots including the correcting portion by the correcting discharge in a case that the predetermined condition is fulfilled. Further, it is possible to avoid the deterioration of the image quality of the recorded image by recording the dots including the correcting portion by the ordinary discharge in a case that the predetermined condition is not fulfilled.

BRIEF DESCRIPTION OF THE DRAWINGS

FIG. 4B depicts a view in which FIG. 3 is viewed in a direction of an arrow IIIB.

DESCRIPTION OF THE EMBODIMENTS

First Embodiment

<Overall Configuration of Printer>

Figure 1:
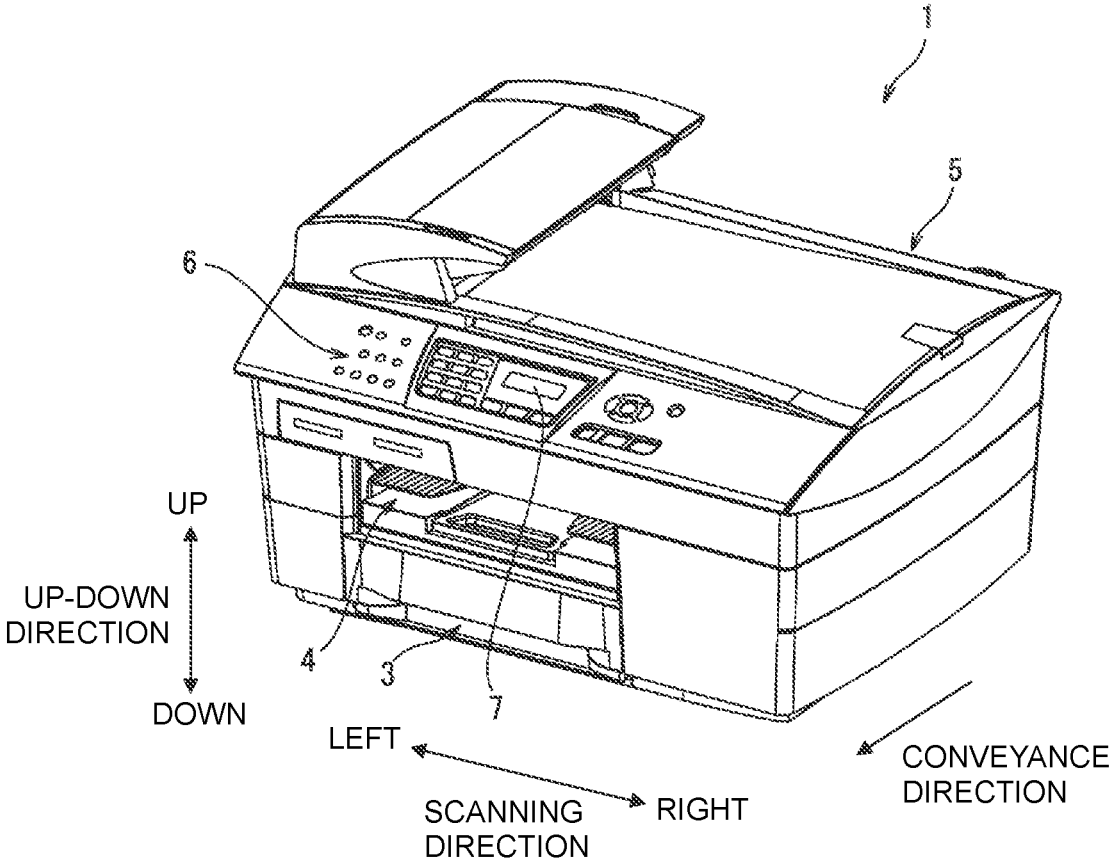
FIG. 1 depicts a perspective view illustrating an appearance of an ink-jet printer according to a first embodiment.

A printer 1 according to a first embodiment ("image recording apparatus" of the present disclosure) is a so-called multifunction peripheral which is also capable of, for example, performing the reading of the image in addition to the recording of an image on the recording paper S ("recording medium" of the present disclosure). As depicted in FIG. 1, the printer 1 is provided with, for example, a recording unit 2 (see FIG. 2), a feed unit 3, a discharge unit 4, a reading unit 5, an operation unit 6, and a display unit 7. Further, the operation of the printer 1 is controlled by a controller 50 (see FIG. 6A).

The recording unit 2 is provided at the inside of the printer 1, and the recording unit 2 performs the recording of the image on the recording paper S. Note that the recording unit 2 will be explained in detail later on. The feed unit 3 feeds the recording paper S to the recording unit 2. The feed unit 3 is capable of accommodating a plurality of types of the recording paper S having different sizes, and the feed unit 3 selectively feeds any one of the plurality of types of the recording paper S to the recording unit 2. The recording paper S is discharged to the discharge unit 4 after performing the recording of the image by the recording unit 2. The reading unit 5 is a scanner or the like, and the reading unit 5 reads the manuscript. The operation unit 6 is provided with, for example, buttons. A user performs the necessary operation with respect to the printer 1 by operating the buttons of the operation unit 6. The display unit 7 is a liquid crystal display or the like. The display unit 7 displays necessary information when the printer 1 is used.

Next, the recording unit 2 will be explained. As depicted in FIGS. 2 to 5, the recording unit 2 is provided with, for example, a carriage 1, an ink-jet head 12 ("recording head" of the present disclosure), a conveying roller pair 13, nine plates 14, a platen 15, eight discharge roller pairs 16, nine spurs 17, and a holder 19. However, in FIG. 2, for example, the discharge roller pair 13, the plate 14, the platen 15, the discharge roller pairs 16, and the spurs 17 are omitted from the illustration. Further, in FIG. 3, in order to more easily view, for example, the plate 14 and ribs 20 described later on, the carriage 11 is drawn by two-dot chain lines. Members, which are actually hidden by the carriage 11, which cannot be viewed, and which are arranged on the lower side of the carriage 11, are drawn by solid lines. Further, in FIG. 3, for example, guide rails for supporting the carriage 11 are omitted from the illustration.

As depicted in FIG. 2, the carriage 11 are attached to the two guide rails 21, 22 which extend in parallel in the left-right direction. The carriage 11 is movable in the left-right direction along the guide rails 21, 22. Further, a driving belt 23 is attached to the carriage 11. The driving belt 23 is an endless belt which is wound around two pulleys 24, 25. One pulley 24 is connected to a carriage motor 56 (see FIG. 6A). Then, when the carriage motor 56 is rotated forwardly or rotated reversely, then the driving belt 23 moves in accordance with the rotation of the pulleys 24, 25, and the carriage 11 is reciprocatively moved in the left-right direction as the scanning direction. More specifically, when the carriage motor 56 is forwardly rotated, the carriage 11 is moved in the FWD direction directed from the right end to the left end. When the carriage motor 56 is reversely rotated, the carriage 11 is moved in the RVS direction directed from the left end to the right end.

The holder 19 is arranged in front of the carriage 11. Four ink cartridges 26 are detachably installed to the holder 19. In the case of the printer 1, the attaching/detaching operation for the ink cartridge 26, which is performed by the user, can be carried out from the front surface side of the printer 1. Inks of black, yellow, cyan, and magenta are stored in the four ink cartridges 26 respectively.

The ink-jet head 12 is carried on the carriage 11. The ink-jet head 12 is reciprocatively movable in the scanning direction together with the carriage 11. The ink-jet head 12 has a main head body 12*a* and a buffer tank 12*b*. A tube joint 28 is provided at a downstream position in the conveyance direction from the middle position in the conveyance direction of the ink-jet head 12, on the buffer tank 12*b*. Then, one end of each of four supply tubes 27 is connected to the tube joint 28. The four supply tubes 27 are flexible tubes. The other end of each of the four supply tubes 27 is connected to each of the four ink cartridges 26 installed to the holder 19. The inks, which are contained in the four ink cartridges 26 installed to the holder 19, are supplied to the buffer tank 12*b* via the supply tubes 27. Further, the four supply tubes 27 extend to the left from the connecting portions with respect to the tube joint 28, the four supply tubes 27 are bent on the left side of the ink-jet head 12 in the printer 1, and the four supply tubes 27 have curved portions 27*a* at which the direction is changed to allow the four supply tubes 27 to extend to the right.

The main head body 12*a* is attached to a lower portion of the buffer tank 12*b*. The main head body 12*a* has an unillustrated flow passage unit and an unillustrated actuator. The flow passage unit is formed with internal flow passages including a plurality of nozzles 10 which are formed on a discharge surface 12*a*1 as a lower surface of the flow passage unit. The internal flow passages are communicated with the buffer tank 12*b*. The plurality of nozzles 10 discharge the inks supplied from the buffer tank 12 via the internal flow passages. Further, the discharge surface 12*a*1 is a horizontal surface which is parallel to the front-back direction and the left-right direction.

Figure 3:
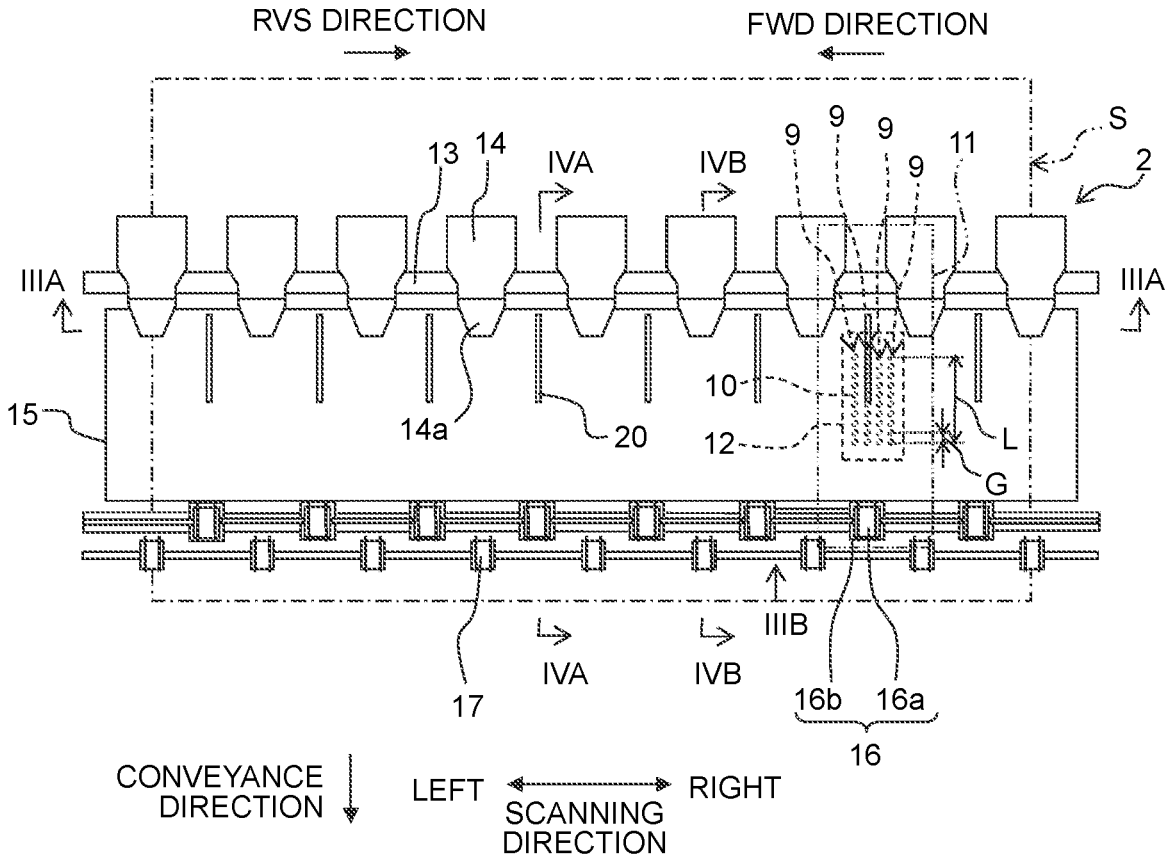
FIG. 3 depicts a plan view illustrating a recording unit depicted in FIG. 1.

As depicted in FIG. 3, the plurality of nozzles 10 form four nozzle arrays 9 which are aligned in the scanning direction. Each of the nozzle arrays 9 has the plurality of nozzles 10 which are arranged over a length Ln at constant nozzle intervals G in the conveyance direction (front-back direction) orthogonal to the scanning direction. Then, the inks of black, yellow, cyan, and magenta are discharged from the plurality of nozzles 10 in this order as starting from those which form the nozzle arrays 9 disposed on the right side. The actuator applies the discharge energy individually to the ink contained in each of the nozzles 10. For example, the actuator applies the pressure to the ink by changing the volume of the unillustrated pressure chamber communicated with the nozzle 10. Alternatively, the actuator applies the pressure to the ink by generating bubbles in the pressure chamber by means of the heating. However, the configuration of the actuator itself is known. Therefore, any further detailed explanation will be omitted herein.

Further, in this embodiment, in order to record the image on the recording paper S, five types of the discharge amounts of the ink (extra-large droplet, large droplet, middle droplet, small droplet, undischarge) can be discharged from the nozzle 10 in one discharge cycle. In other words, the printer 1 can perform the recording of five gradations. In this embodiment, the discharge amount of the ink, which is discharged from the nozzle 10 in one discharge cycle, is adjusted by changing at least any one of the number of liquid droplets discharged from the nozzle 10 in one discharge cycle and the liquid droplet amount (volume) per one liquid droplet by controlling the actuator. In this context, the discharge cycle is the time required for the carriage 11 to move by the unit distance corresponding to the resolution in the scanning direction (left-right direction).

Figure 2A:
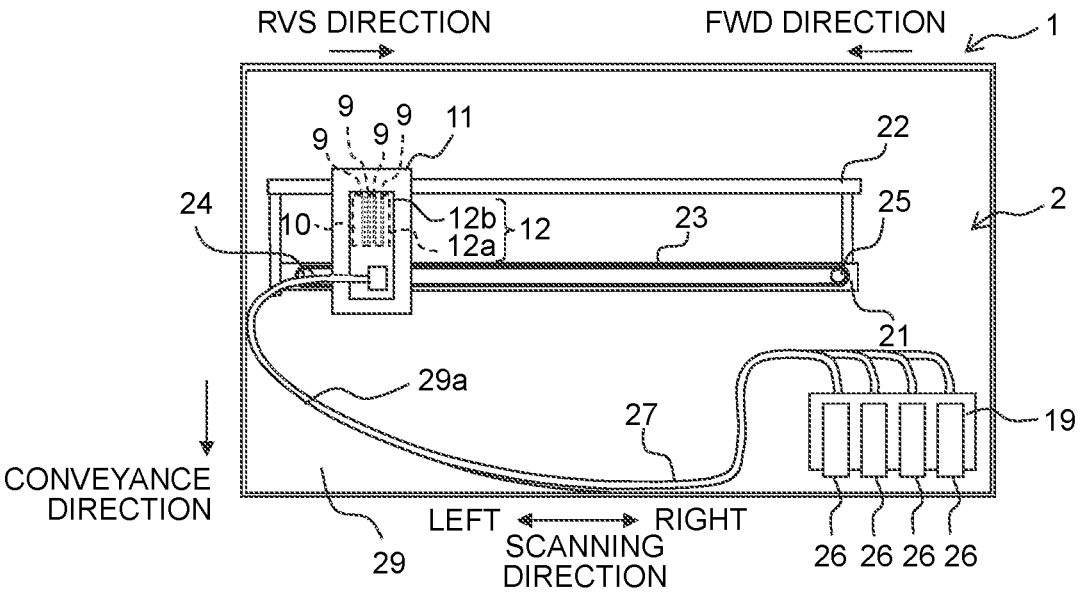
FIG. 2A depicts a plan view illustrating the ink-jet printer in a state in which a carriage is positioned within a left end portion range in a movable range.
Figure 2B:
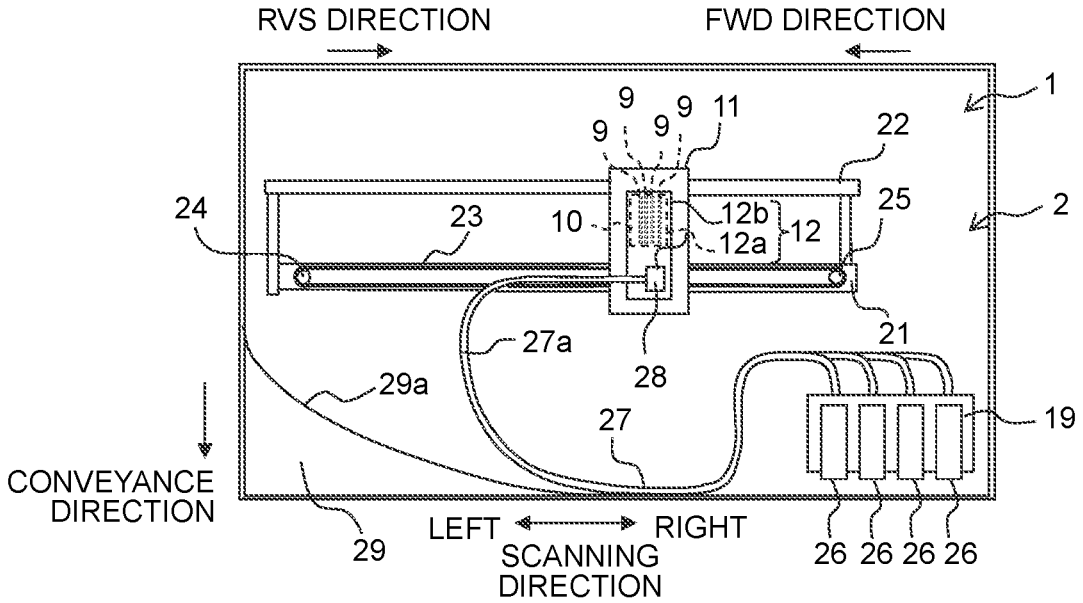
FIG. 2B depicts a plan view illustrating the ink-jet printer in a state in which the carriage is positioned on the right side from the left end portion range in the movable range.

Further, as depicted in FIG. 2, a contact member 29, which supports the four supply tubes 27, is provided at a position in front of the carriage 11 in the printer 1. The contact member 29 has a contact surface 29*a* which supports the curved portions 27*a* of the four supply tubes 27 by making contact therewith from the side. As depicted in FIG. 2A, the contact surface 29*a* extends so that the contact surface 29*a* can make contact with the outer portions of the bending of the supply tubes 27 along the curved shapes of the curved portions 27*a* of the supply tubes 27 in a state in which the carriage 11 is positioned within the left end portion range in the movable range. Therefore, the four supply tubes 27 are brought in contact with the contact surface 29*a* while being curved, and the four supply tubes 27 retain the curved attitudes. On the other hand, as depicted in FIG. 2B, the four supply tubes 27 are not brought in contact with the contact surface 29*a* in a state in which the carriage 11 is positioned on the right side from the left end portion range.

Figure 5A:
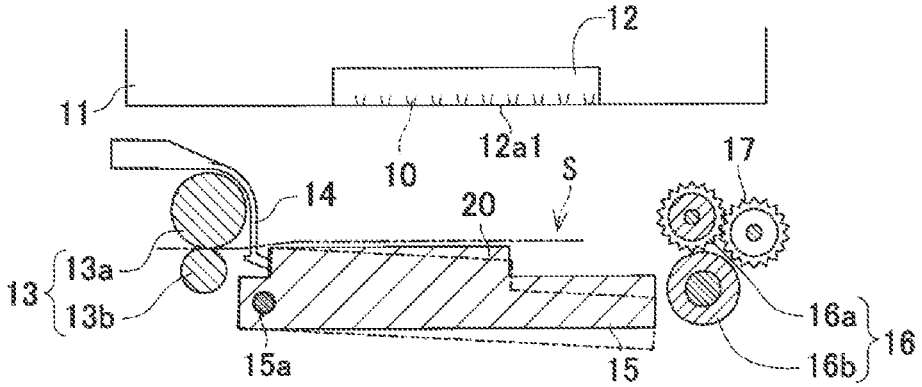
FIG. 5A depicts a sectional view taken along a line IVA-IVA depicted in FIG. 3.
Figure 5B:
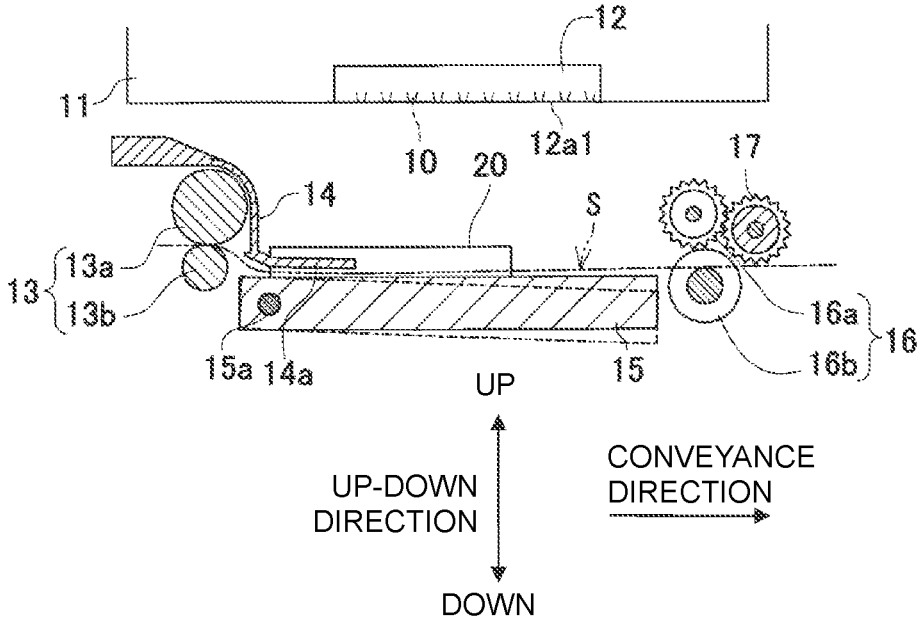
FIG. 5B depicts a sectional view taken along a line IVB-IVB depicted in FIG. 3.

As depicted in FIG. 5, the conveying roller pair 13 is arranged on the upstream side in the conveyance direction from the ink-jet head 12. The conveying roller pair 13 has an upper roller 13*a* and a lower roller 13*b*. The recording paper S, which is fed from the feed unit 3, is nipped by the rollers in the upward-downward direction, and the recording paper S is conveyed in the conveyance direction. The upper roller 13*a* is a driving roller which is driven by the conveying motor 57 (see FIG. 6A). The lower roller 13*b* is a following roller which is rotated while being interlocked with the rotation of the upper roller 13*a*.

The platen 15 is arranged while being opposed to the discharge surface 12*a*1 on the downstream side in the conveyance direction of the conveying roller pair 13. The platen 15 extends in the scanning direction over the entire length of the movable range of the carriage 11 to be provided when the image is recorded. Further, the platen 15 is swingably supported by a swinging shaft 15*a* which is provided at an end portion on the upstream side in the conveyance direction and which extends in the scanning direction. Further, the platen 15 is urged by an unillustrated spring or the like, and thus the platen 15 is positioned at the position indicated by solid lines in the drawing in a state in which the recording paper S is not conveyed.

The nine plates 14 extend from the positions at which the nine plates 14 are overlapped with the conveying roller pair 13 to the positions disposed on the downstream side in the conveyance direction from the conveying roller pair 13. The nine plate 14 are arranged at equal intervals in the scanning direction. Each of the plates 14 has a holding section 14*a* which is provided at an end portion on the downstream side in the conveyance direction and which is provided to hold the recording paper S from the upper position. The recording paper S, which is conveyed by the conveying roller pair 13, passes through the space between the plates 14 and the platen 15. In this situation, the recording paper S is held from the upper positions by the holding sections 14*a* of the plates 14. Further, the platen 15 is pushed downwardly by the recording paper S held by the plates 14. As depicted by alternate long and short dash lines in FIG. 5, the platen 15 makes swinging movement about the center of the swinging shaft 15*a*. Further, in this situation, the larger the thickness of the recording paper S is, the more greatly the platen 15 swings. Accordingly, the larger the thickness of the recording paper S is, the more greatly separated from the discharge surface 12*a*1 the upper surface of the platen 15 is. As a result, it is possible to obtain a substantially identical spacing distance (hereinafter referred to as "gap") in the upward-downward direction between the discharge surface 12*a*1 and the recording paper S arranged on the upper surface of the platen 15 irrelevant to the type of the recording paper S.

The eight ribs 20 are formed on the upper surface of the platen 15. The eight ribs 20 extend in the conveyance direction respectively, and the eight ribs 20 are arranged at equal intervals so that the eight ribs 20 are positioned between the adjoining plates 14 in the scanning direction. Each of the ribs 20 protrudes from the upper surface of the platen 15 to the position disposed over or above the holding section 14*a* of the plate 14, and each of the ribs 20 extends toward the downstream side in the conveyance direction from the end portion on the upstream side in the conveyance direction of the platen 15. Accordingly, the rib 20 supports the recording paper S from the lower position which is disposed over or above the position at which the holding section 14*a* holds the recording paper S.

The eight pairs of the discharge roller pairs 16 are arranged on the downstream side in the conveyance direction from the ink-jet head 12. Further, the position of the discharge roller pair 16 in the scanning direction is approximately the same as that of the rib 20. Each of the discharge roller pairs 16 has an upper roller 16*a* and a lower roller 16*b*. These rollers are used to receive or accept the recording paper S from the conveying roller pair 13 so that the recording paper S is nipped in the upward-downward direction and the recording paper S is further conveyed in the conveyance direction. Further, the discharge roller pairs 16 discharge the recording paper S toward the discharge unit 4. The lower roller 16*b* is a driving roller which is driven by the conveying motor 57 (see FIG. 6A). The upper roller 16*a* is a spur that is a following roller which is rotated while being interlocked with the rotation of the lower roller 16*b*. In this case, the upper roller 16*a* makes contact with the recording surface of the recording paper S after the recording. However, the upper roller 16*a* is not a roller which has a flat outer circumferential surface, but the upper roller 16*a* is the spur. Therefore, the ink on the recording paper S hardly adheres thereto.

The nine spurs 17 are arranged on the downstream side from the discharge roller pair 16 in the conveyance direction, and the nine spurs 17 hold the recording paper S from the upper positions. Further, the positions in the scanning direction of the nine spurs 17 are approximately the same as those of the holding sections 14*a* of the nine plates 14. Further, the spurs 17 are not rollers which have flat outer circumferential surfaces, but the spurs 17 are spur-shaped. Therefore, the ink on the recording paper S hardly adheres thereto.

Note that the numbers of the plates 14 and the discharge roller pairs 16 and the numbers of the ribs 20 and the spurs 17 are referred to by way of example, and the numbers may be different from those described above. As for the numbers of the plates 14 and the discharge roller pairs 16 and the numbers of the ribs 20 and the spurs 17, it is enough that at least one of them may be provided in relation to each of them.

Figure 4A:
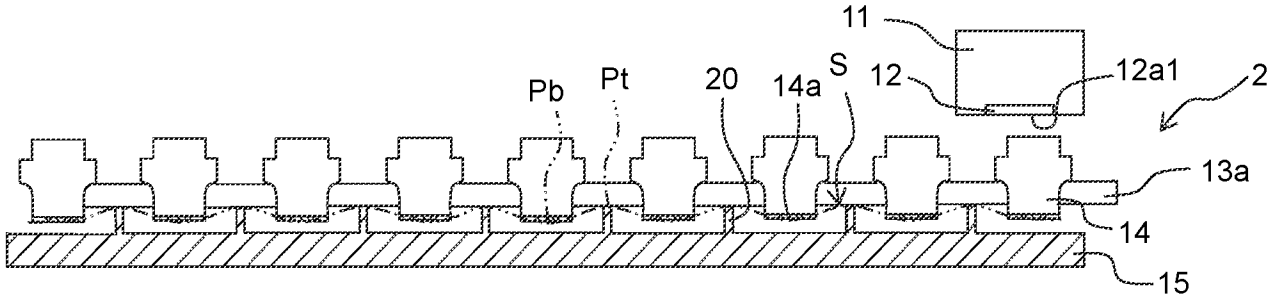
FIG. 4A depicts a sectional view taken along a line IIIA-IIIA depicted in FIG. 3.
Figure 4B:
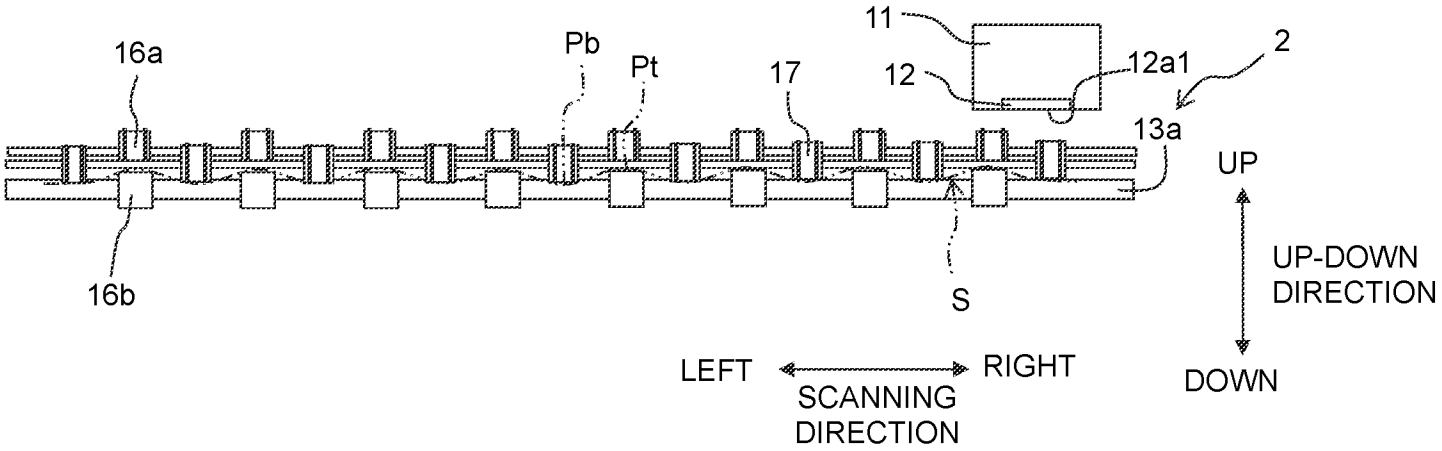

Then, the recording paper S is supported from the lower positions by the eight ribs 20 and the eight lower rollers 16*b*. The recording paper S is held from the upper positions by the holding sections 14*a* of the nine plates 14 and the nine spurs 17, and thus the recording paper S is bent to provide a wavy shape in the scanning direction as depicted in FIGS. 4A and 4B.

Further, the recording paper S, which has the wavy shape, has apexes Pt (maximum points) having maximized heights at the positions at which the respective ribs 20 and the discharge roller pairs 16 are arranged in the scanning direction. Further, the recording paper S has apexes Pb (minimum points) having minimized heights at the positions at which the holding sections 14*a* of the respective plates 14 and the spurs 17 are arranged in the scanning direction. In other words, the recording paper S has the wavy shape in which the peak portions and the valley portions are alternately arranged, the peak portions protruding toward the discharge surface 12*a*1 about the centers of the apexes Pt, and the valley portions being recessed while being separated from the discharge surface 12*a*1 as compared with the peak portions about the centers of the apexes Pb.

Figure 6A:
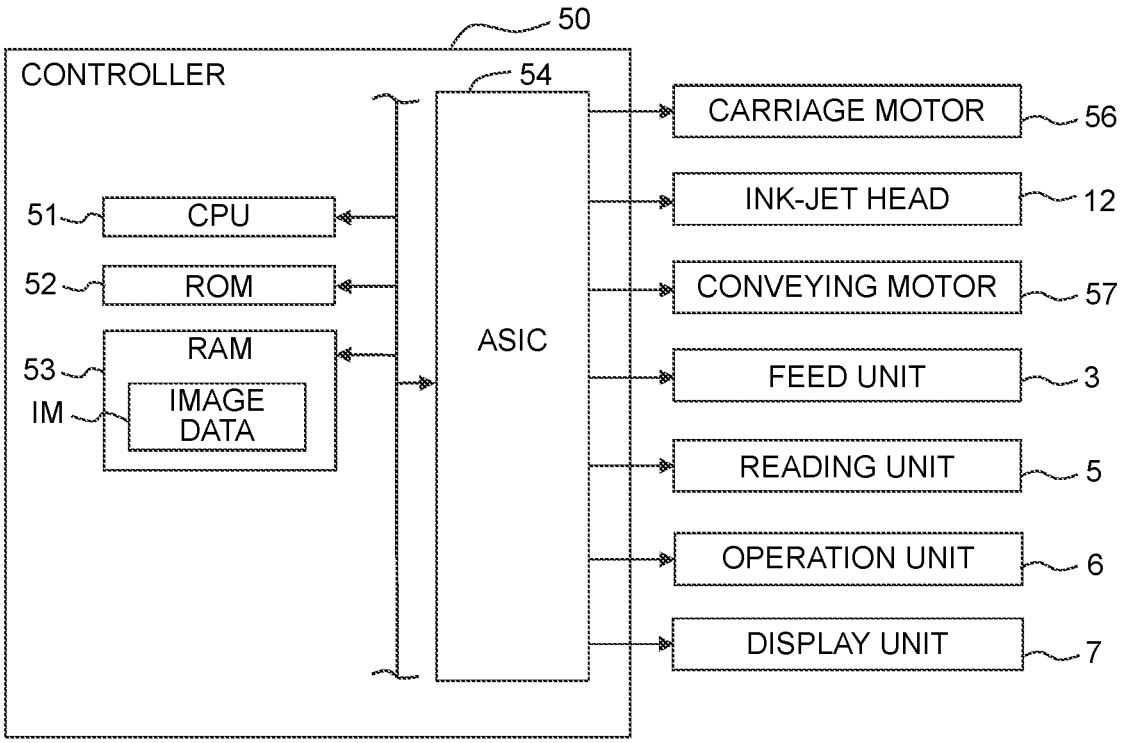
FIG. 6A depicts a block diagram illustrating electric configuration of the ink-jet printer.

Next, an explanation will be made about the electric configuration of the printer 1. The operation of the printer 1 is controlled by the controller 50. As depicted in FIG. 6A, the controller 50 is provided with, for example, CPU (Central Processing Unit) 51, ROM (Read Only Memory) 52, RAM (Random Access Memory) 53, ASIC (Application Specific Integrated Circuit) 54 including various control circuits. For example, the ink-jet head 12, the feed unit 3, the carriage motor 56, and the conveying motor 57 are electrically connected to ASIC 54.

For example, programs to be executed by CPU 51 and various pieces of fixed data are stored in ROM 52. For example, data required during the execution of the program and the image data IM in relation to the image to be recorded on the recording paper S are temporarily stored in RAM 53.

Figure 6B:
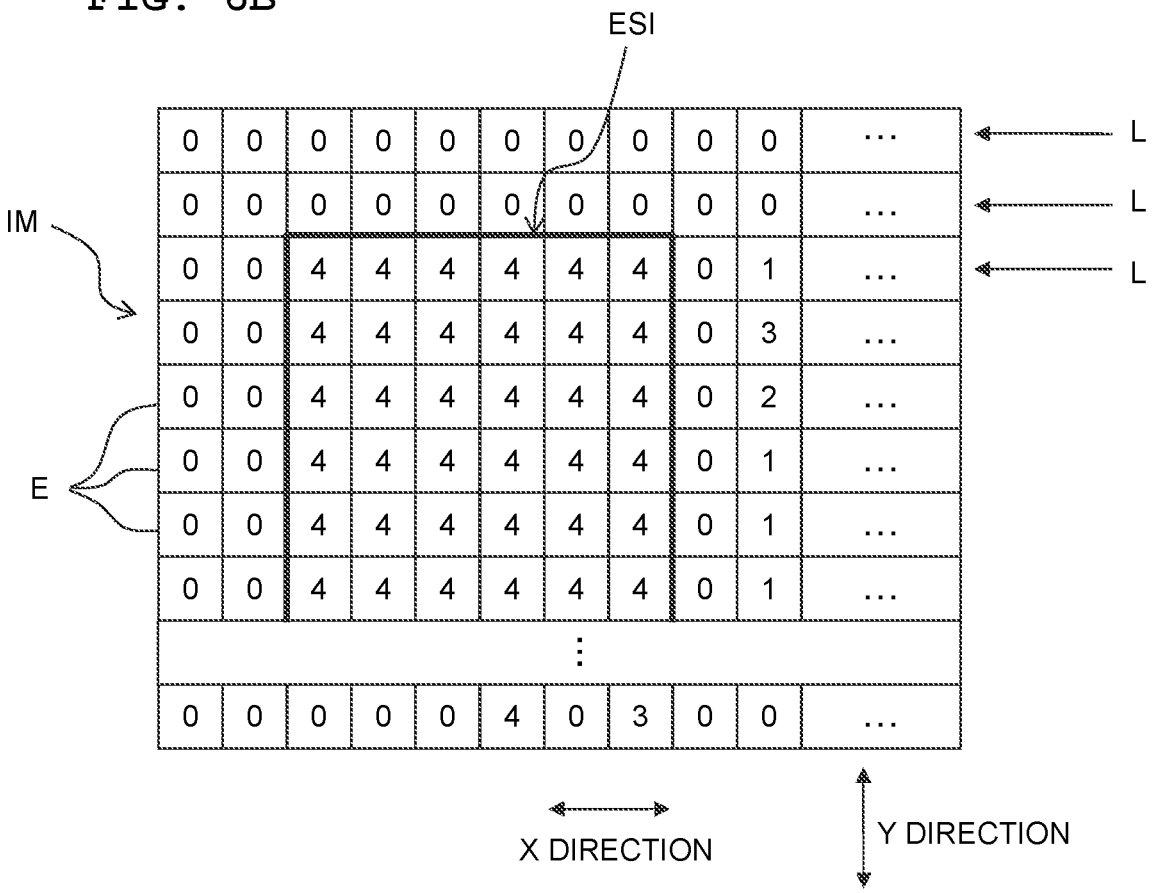
FIG. 6B depicts image data.

As depicted in FIG. 6B, the image data IM has a plurality of dot elements E corresponding to a plurality of dots to be formed on the recording paper S (including undischarge dots on which the ink is not landed). In particular, the image data IM is formed by the plurality of dot elements E which are aligned in the X direction and the Y direction that are orthogonal to one another. The X direction and the Y direction correspond to the scanning direction and the conveyance direction respectively. The discharge amount of the ink, which is to be discharged from the nozzle 10 when the corresponding dot is formed, is set to each of the dot elements E. In particular, any one of the five types of the discharge amounts (extra-large droplet, large droplet, middle droplet, small droplet, undischarge) is set for each of the dot elements E. As for the five types of the discharge amounts, the discharge amount is increased in an order of "extra-large droplet", "large droplet", "middle droplet", "small droplet", "undischarge". Further, in the case of "undischarge", the discharge amount is zero. In other words, the dot, which corresponds to the dot element E set with "undischarge", is the undischarge dot on which the ink is not landed. Further, the image data IM has a plurality of pieces of line data L. Each of the pieces of line data L is the data which is composed of a plurality of dot elements E corresponding to a plurality of dots arranged in the scanning direction on the recording paper S. Note that the image data IM depicted in FIG. 6B is illustrated assuming that the dot element E set with the extra-large droplet is depicted as "4", the dot element E set with the large droplet is depicted as "3", the dot element E set with the middle droplet is depicted as "2", the dot element E set with the small droplet is depicted as "1", and the dot element E set with the undischarge is depicted as "0".

The controller 50 controls, for example, the ink-jet head 12, the feed unit 3, the carriage motor 56, and the conveying motor 57 to perform various processes including, for example, the recording process for recording the image concerning the image data IM on the recording paper S. In the following explanation, for example, the situation, in which the controller 50 controls, for example, the ink-jet head 12, the feed unit 3, the carriage motor 56, and the conveying motor 57 to execute the predetermined recording process, is simply described, in some cases, such that the controller 50 executes the predetermined recording process. Note that as for the controller 50, only CPU 51 may perform various processes, only ASIC 54 may perform various processes, or CPU 51 and ASIC 54 may cooperate to perform various processes. Further, as for the controller 50, one CPU 51 may perform the process alone, or a plurality of CPU's 51 may perform the process in a shared manner. Further, as for the controller 50, one ASIC 54 may perform the process alone, or a plurality of ASIC's 54 may perform the process in a shared manner.

<Flow of Recording Process>

An explanation will be made below about the recording process to be performed by the controller 50 when the image is recorded on the recording paper S. In this embodiment, when a recording instruction is inputted to instruct the printer 1 to perform the recording, then the controller 50 performs the process in accordance with a flow depicted in FIG. 7, and thus the image is recorded on the recording paper S.

Figure 7:
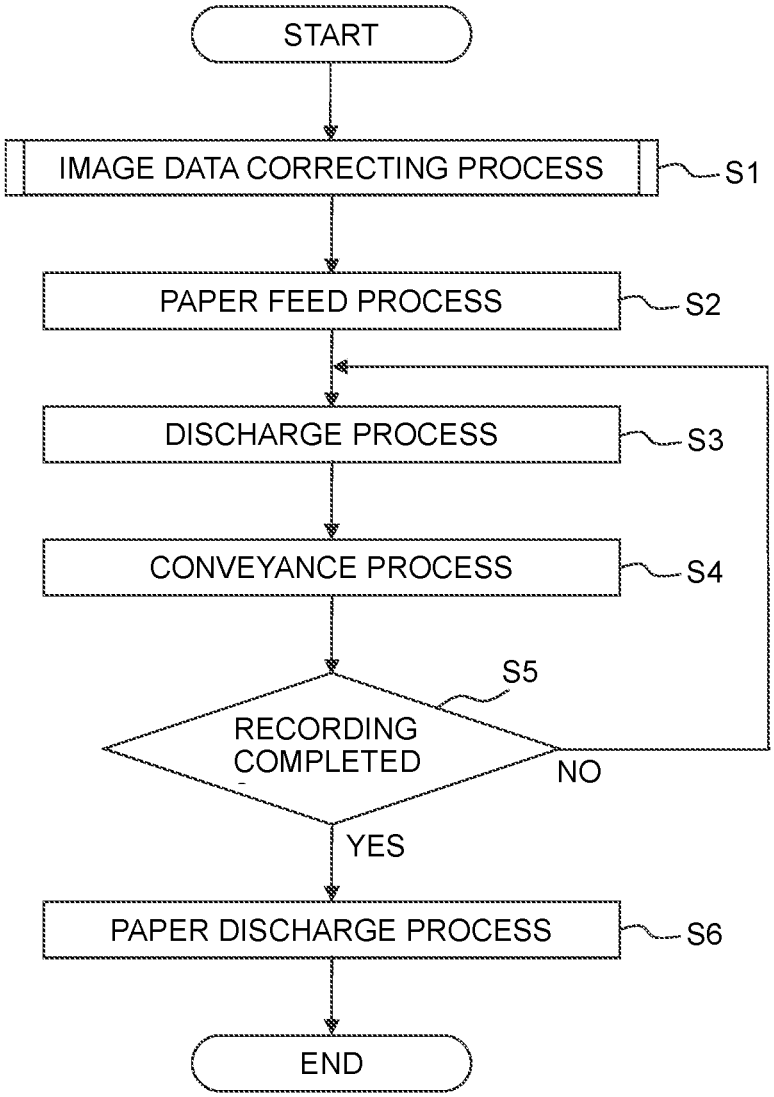
FIG. 7 depicts a flow chart illustrating a flow of a recording process.

As depicted in FIG. 7, the controller 50 firstly executes the image data correcting process (S1) in which the image data IM as the recording object stored in RAM 53 (hereinafter referred to as "image data IM before the correction" as well) is corrected. The image data correcting process is the process in which the deterioration of the image quality of the image recorded on the recording paper S is made hardly conspicuous. The image data correcting process will be explained in detail later on. After that, the controller 50 executes the paper feed process (S2) in which the recording paper S is supplied to the recording unit 2 by controlling the feed unit 3. In the paper feed process, the recording paper S is conveyed until arrival at the recording start position. The recording start position is the position at which the area of the recording paper S, in which the image is to be firstly recorded, confronts the discharge surface 12*a*1 of the ink-jet head 12.

Subsequently, the controller 50 executes the discharge process (S3). In the discharge process, the controller 50 performs the recording pass in which the dots are formed on the recording paper S by discharging the inks at predetermined discharge timings from the plurality of nozzles 10 by controlling the ink-jet head 12, while moving the carriage 11 in the scanning direction by controlling the carriage motor 56. In particular, in the discharge process, the respective nozzles 10 of the ink-jet head 12 are allowed to correspond to any one of the line data L of the image data IM after performing the image data correcting process (S1) described above (hereinafter referred to as "image data IM after the correction" as well). Then, the ink in the discharge amounts set for the dot elements E of the corresponding line data L is discharged at each discharge cycle from the respective nozzles 10 to form the dots on the recording paper S. Accordingly, the image corresponding to one line (hereinafter referred to as "line image" as well), which is composed of the plurality of dots aligned in the scanning direction, is record on the recording paper S in relation to each of the nozzles 10.

Note that the recording paper S has the wavy shape extending in the scanning direction as described above. Therefore, the gap, which is provided with respect to the discharge surface 12*a*1, changes along with the scanning direction. Further, the ink is discharged from the nozzle 10 during the movement of the carriage 11, and hence the inertial force acts on the ink discharged from the nozzle 10. On this account, the flying direction of the ink is not the directly below direction. The flying direction of the ink also includes the component of the movement direction of the carriage 11. According to the above, if the interval of the discharge timing is constant, the interval between the dots in the scanning direction is not constant. In view of the above, in the recording pass, the discharge timing for discharging the ink from the nozzle 10 is adjusted in accordance with the gap with respect to the discharge surface 12*a*1 in relation to each of the positions in the scanning direction on the recording paper S for forming the dots thereon. Note that the discharge timing is adjusted assuming that the recording paper S is retained to have the assumed wavy shape.

Figure 8A:
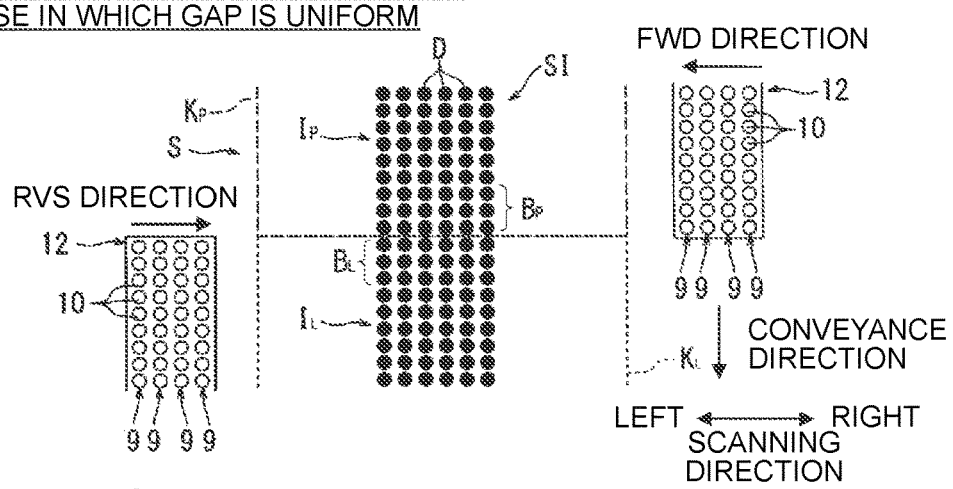
FIG. 8A depicts a specified image provided when no difference arises in the gap between the upstream and the downstream in the conveyance direction.

Subsequently, the controller 50 executes the conveyance process (S4). In the conveyance process, the controller 50 controls the conveying motor 57 to allow the conveying roller pair 13 and the discharge roller pairs 16 to perform the conveying operation in which the recording paper S is conveyed by the length Ln of the nozzle array 9. Accordingly, as depicted in FIG. 8A, the first dot recording range KL in which the dots are formed by the preceding recording pass of the two times of the continuous recording passes and the second dot recording range KP in which the dots are formed by the following recording pass are not overlapped with each other, but they are adjacent to one another in the conveyance direction on the recording paper S.

Then, if the recording of the image on the recording paper S is not completed (S5: NO), the controller 50 returns to the process of S3. Accordingly, the recording pass and the conveying operation are alternately repeated until the recording of the image on the recording paper S is completed.

If the recording of the image on the recording paper S is completed (S5: YES), the controller 50 executes the paper discharge process (S6). In the paper discharge process, the controller 50 controls the conveying motor 57 to discharge the recording paper S to the paper discharge unit 4 by means of the conveying roller pair 13 and the discharge roller pairs 16.

In this context, in this embodiment, there are two types of the recording modes, i.e., the unidirectional recording mode and the bidirectional recording mode. Then, the controller 50 selectively performs the recording of the image in accordance with any one of the recording modes of the unidirectional recording mode and the bidirectional recording mode in the recording process. The unidirectional recording mode and the bidirectional recording mode will be explained below.

In the unidirectional recording mode, the ink is discharged from the plurality of nozzles 10 only when the carriage 11 is moved to one side in the scanning direction (RVS direction in this embodiment). Therefore, in the unidirectional recording mode, the movement directions of the carriage 11 are identical in the respective two times of the continuous recording passes, in relation to all of the recording passes to be performed when the image is recorded on one sheet of the recording paper S. In other words, the movement direction of the carriage 11 in the preceding recording pass is the same as the movement direction of the carriage 11 in the following recording pass, in relation to the respective two times of the continuous recording passes.

In the bidirectional recording mode, the ink is also discharged from the plurality of nozzles 10 when the carriage 11 is moved to any one of one side and the other side in the scanning direction (RVS direction and FWD direction in this embodiment). Therefore, in the bidirectional recording mode, the movement directions of the carriage 11 are alternately changed in the recording passes, in relation to all of the recording passes to be performed when the image is recorded on one sheet of the recording paper S. In other words, the movement direction of the carriage 11 in the preceding recording pass is different from the movement direction of the carriage 11 in the following recording pass, in relation to the respective two times of the continuous recording passes.

In the unidirectional recording mode, it is necessary to perform the return operation in which the carriage 11 is moved in the FWD direction before the next recording pass is started after executing one time of the recording pass by moving the carriage 11 in the RVS direction. On the other hand, in the bidirectional recording mode, it is unnecessary to perform the return operation after executing one time of the recording pass. On this account, the bidirectional recording mode makes it possible to improve the throughput as compared with the unidirectional recording mode. On the contrary, in the bidirectional recording mode, the image quality of the image recorded on the recording paper S is easily deteriorated as compared with the unidirectional recording mode. For example, if the actual gap between the recording paper S and the discharge surface 12*a*1 is different from the assumed gap, the flying time of the ink discharged from the nozzle 10 also changes. The flying direction of the ink also includes the component of the movement direction of the carriage 11. Therefore, if the flying time changes, the landing position of the ink on the recording paper S is deviated from the ideal landing position in relation to the scanning direction. In this case, in the unidirectional recording mode, the movement direction of the carriage 11 is identical in each of the recording passes. Therefore, the direction of the deviation of the actual landing position with respect to the ideal landing position is identical. On the other hand, in the bidirectional recording mode, the movement directions of the carriage 11 are different from each other between the two times of the continuous recording passes. On this account, the direction of the deviation in the preceding recording pass is mutually different from the direction of the deviation of the following recording pass, in relation to the two times of the continuous recording passes. Therefore, in the bidirectional recording mode, the image quality is easily deteriorated on account of the deviation of the landing position of the ink, as compared with the unidirectional recording mode.

<Image Data Correcting Process>

Next, the image data correcting process will be explained, while matters as assumptions thereof will be also explained in combination.

As depicted in FIG. 8A, when the specified image SI is recorded while ranging over the boundary between the first dot recording range KL and the second dot recording range KP, the step-shaped deviation (hereinafter simply referred to as "deviation") may appear in the specified image SI on account of various factors. In this context, the specified image SI is the image which is composed of a plurality of discharge dots D and which has a width corresponding to a plurality of dots in each of the conveyance direction and the scanning direction. The specified image SI is exemplified, for example, by a line (for example, a line for constructing a text) which is interposed between both sides in the scanning direction by undischarge dots, which has a width corresponding to a plurality of dots (for example, in an amount of six dots) in the scanning direction, and which extends in the conveyance direction. The discharge dot D is the dot in which the discharge amount set for the corresponding dot element E is any one of the extra-large droplet, the large droplet, the middle droplet, and the small droplet in the image data IM. The undischarge dot is the dot in which the discharge amount set for the corresponding dot element E is zero (undischarge) in the image data IM. Note that in FIG. 8, only the discharge dots D are depicted in the drawing, and the undischarge dots are not depicted in the drawing. FIGS. 10, 11, 12, 14, 15, 17, 20, and 22 to 26 referred to later on are also depicted in the same manner as described above.

Figure 9A:
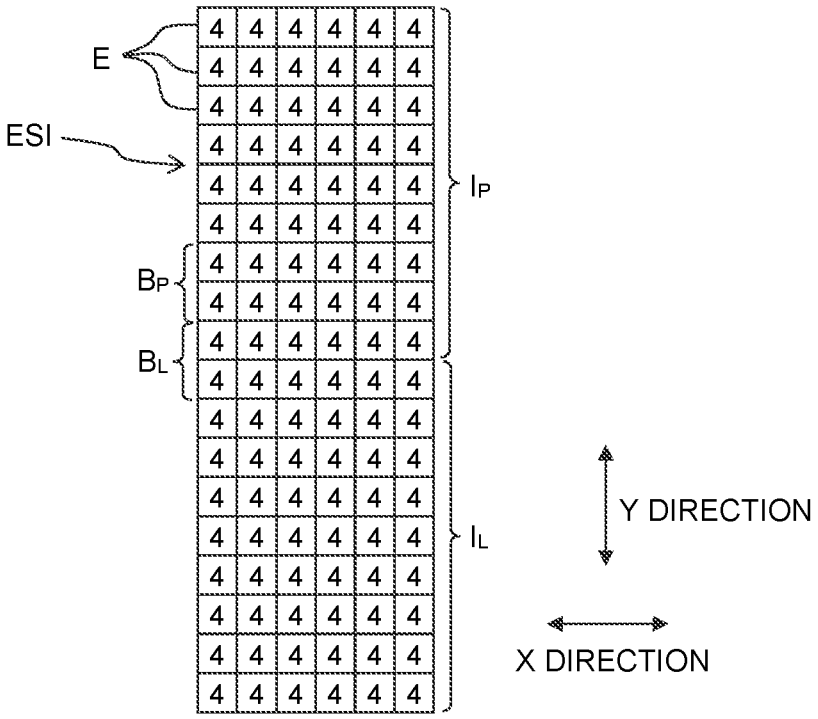
FIG. 9A depicts the specified image data before the correction.

The following explanation will be made assuming that the specified image SI is the line which is composed of the discharge dots D having the discharge amounts of the extra-large droplets set for the corresponding dot elements E and which has the width corresponding to six dots in the scanning direction. Therefore, as depicted in FIGS. 6B and 9A, the specified image data ESI, which corresponds to the specified image SI in the image data IM, is such data that a plurality of dot element arrays, each of which is composed of six dot elements E set with "4" of "extra-large droplet" and aligned in the X direction, are aligned in the Y direction. Note that in FIG. 9, only the specified image data ESI of the image data IM is depicted.

In this embodiment, the main factor of the appearance of the deviation in the specified image SI is exemplified by three factors, i.e., the difference between the upstream and the downstream in the conveyance direction of the gap between the recording paper S and the discharge surface 12*a*1, the fluctuation of the gap at the peak portion of the recording paper S, and the attitude change of the carriage 11 caused by the reaction force received from the contact surface 29*a* by the supply tube 27. The three factors will be explained respectively below. However, the explanation will be made assuming that the deviation of the specified image SI is caused by only one factor as the object of the explanation, for the sake of convenience.

At first, the deviation of the specified image SI, which is caused by the factor of the difference between the upstream and the downstream in the conveyance direction of the gap, will be explained. When the difference between the upstream and the downstream in the conveyance direction of the gap does not appear, and the situation is uniform, then the flying times of the ink discharged from the respective nozzles 10 of the nozzle arrays 10 are identical. Therefore, as depicted in FIG. 8A, the discharge dots D, which are formed by the ink discharged in the same discharge cycle from the respective nozzles 10 of the nozzle arrays 9, are mutually formed at the same positions in the scanning direction in each of the recording passes. In other words, the discharge dots D, which are formed by the same recording pass and which are included in the plurality of discharge dots D corresponding to the plurality of dot elements E (dot elements E having the same position in the X direction) aligned in the Y direction in the specified image data ESI, are mutually formed at the same position in the scanning direction.

However, in this embodiment, as described above, the platen 15 is swingably supported by the swinging shaft 15*a* provided at the end portion on the upstream side in the conveyance direction. The platen 15 is configured to make the swinging movement by the recording paper S held by the plates 14. On account of this configuration, the gap between the recording paper S and the discharge surface 12*a*1 is more increased on the more downstream side in the conveyance direction.

Figure 8B:
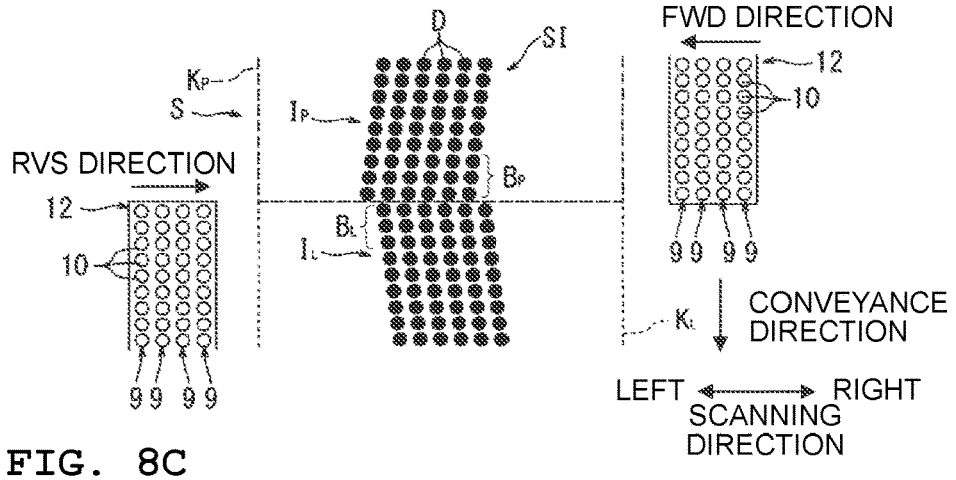
FIG. 8B depicts a specified image provided when a difference arises in the gap between the upstream and the downstream in the conveyance direction and the image data is not corrected in the case of the bidirectional recording mode.

On this account, the flying time is more prolonged for the ink which is discharged from the nozzles 10 arranged on the more downstream side in the conveyance direction in the nozzle arrays 9 in relation to each of the recording passes. The landing position is disposed on the more downstream side in the movement direction of the carriage 11. In other words, as depicted in FIG. 8B, in each of the recording passes, the formation positions of the respective discharge dots D formed by the ink discharged in the same discharge cycle from the respective nozzles 10 of the nozzle arrays 9 are disposed on the more downstream side in the movement direction of the carriage 11, in relation to the discharge dots D disposed on the more downstream side in the conveyance direction. Further, in this embodiment, the nozzle 10, which is positioned on the most upstream side in the conveyance direction of the nozzle array 9, is set as the reference nozzle. Then, the discharge timings of the ink are set so that the positions in the scanning direction of the dot arrays formed by the ink discharged from the reference nozzles in each of the recording passes are identical with each other.

On account of the fact as described above, the deviation is generated between the first image area IL recorded in the first dot recording range KL in the specified image SI and the second image area IP recorded in the second dot recording range KP in the specified image SI. In other words, the first boundary area BL, which is adjacent to the second dot recording range KP in the first image area IL, is deviated in the scanning direction as a whole with respect to the second boundary area BP which is adjacent to the first dot recording range KL in the second image area IP. In particular, in the case of the bidirectional recording mode, the first boundary area BL is deviated as a whole toward the downstream side in the movement direction of the carriage 11 in the preceding recording pass with respect to the second boundary area BP. Note that the length in the conveyance direction of the first boundary area BL is shorter than the length in the conveyance direction of the first dot recording range KL. Similarly, the length in the conveyance direction of the second boundary area BP is shorter than the length in the conveyance direction of the second dot recording range KP.

Further, as described above, the swinging width of the platen 15 changes depending on the thickness of the recording paper S. Therefore, the difference between the upstream and the downstream in the conveyance direction of the gap changes depending on the type of the recording paper S on which the image is to be recorded. Therefore, the amount of deviation of the first boundary area BL with respect to the second boundary area BP changes depending on the type of the recording paper S.

As a countermeasure against the deviation of the specified image SI generated by the factor of the difference between the upstream and the downstream in the conveyance direction of the gap as described above, the controller 50 corrects the specified image ESI as follows in the image data correcting process. That is, in the case of the bidirectional recording mode, as depicted in FIG. 8C, the controller 50 sets the correcting portions AM respectively at the end portion of the first boundary area BL disposed on the downstream side in the movement direction of the carriage 11 in the preceding recording pass and the end portion of the second boundary area BP disposed on the downstream side in the movement direction of the carriage 11 in the following recording pass.

Figure 9B:
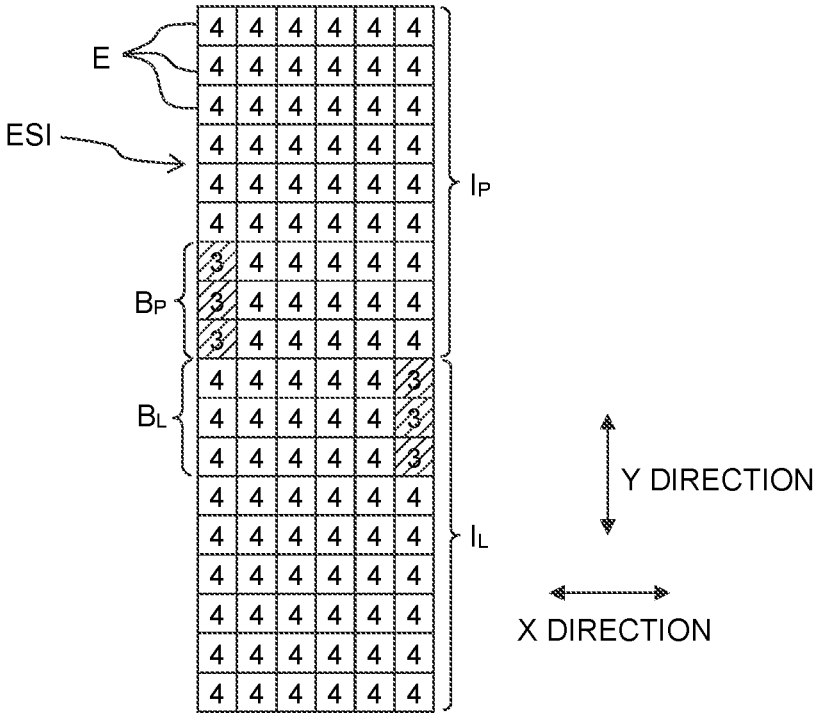
FIG. 9B depicts the specified image data after the correction.

Then, as depicted in FIG. 9B, the controller 50 performs the correction to decrease the discharge amounts set for the dot elements E corresponding to the discharge dots D belonging to the correcting portions AM in the specified image data ESI. Specifically, in this embodiment, the correction is performed to change the discharge amount set for the dot element E corresponding to the discharge dot D belonging to the correcting portion AM from "extra-large droplet" to "large droplet". Note that in FIG. 9B, the dot elements E, in each of which the discharge amount is corrected from "extra-large droplet" to "large droplet", are depicted while being hatched and painted out.

Figure 8C:
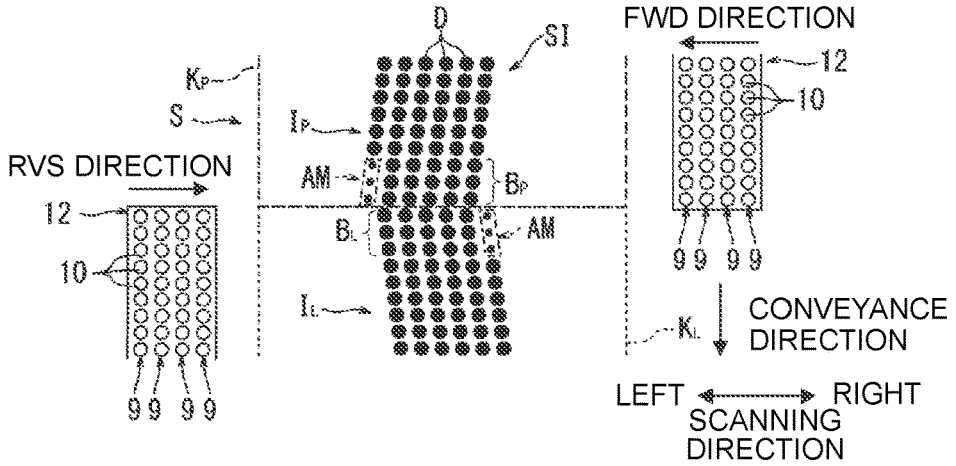
FIG. 8C depicts a specified image provided when a difference arises in the gap between the upstream and the downstream in the conveyance direction and the image data is corrected in the case of the bidirectional recording mode.

When the image is recorded on the recording paper S in accordance with the image data IM corrected as described above, even if the deviation appears in the specified image SI on account of the factor of the difference between the upstream and the downstream in the conveyance direction of the gap as depicted in FIG. 8C, then it is possible to decrease the sizes of the discharge dots D formed at the corner portions. That is, it is possible to chamfer the corner portions of the deviation generated in the specified image SI. As a result, it is possible to make the deviation of the specified image SI hardly conspicuous.

In this procedure, the areal size and the shape of the correcting portion AM is set on the basis of, for example, an experiment. For example, the areal size and the shape of the correcting portion AM is set so that the deviation of the specified image SI is hardly conspicuous by visual observation when the first image area IL and the second image area IP of the specified image SI are recorded while being deviated by an amount which is a half of the maximum deviation amount that can be assumed. As a result of the research carried out by the discloser of this application by performing an experiment or the like, it has been found out that the deviation of the specified image SI is hardly conspicuous when the length in the scanning direction of the correcting portion MA is shorter than the length in the conveyance direction. Further, the following fact has been found out. That is, if the length in the scanning direction of the correcting portion AM is excessively long, the deterioration of the image quality, which is brought about by decreasing the size of the discharge dot D belonging to the correcting portion AM, is conspicuous. Further, even when the length in the scanning direction is a length corresponding to one dot, an effect is obtained to make the deviation of the specified image SI hardly conspicuous. In view of the above, in this embodiment, the shape of the correcting portion AM is set to the rectangular shape in which the length in the scanning direction is the length corresponding to one dot and the length in the conveyance direction is the length corresponding to three dots. However, the shape of the correcting portion AM is not limited thereto. For example, the length in the scanning direction may be a length corresponding to one dot, and the length in the conveyance direction may be a length corresponding to one dot.

Figure 10A:
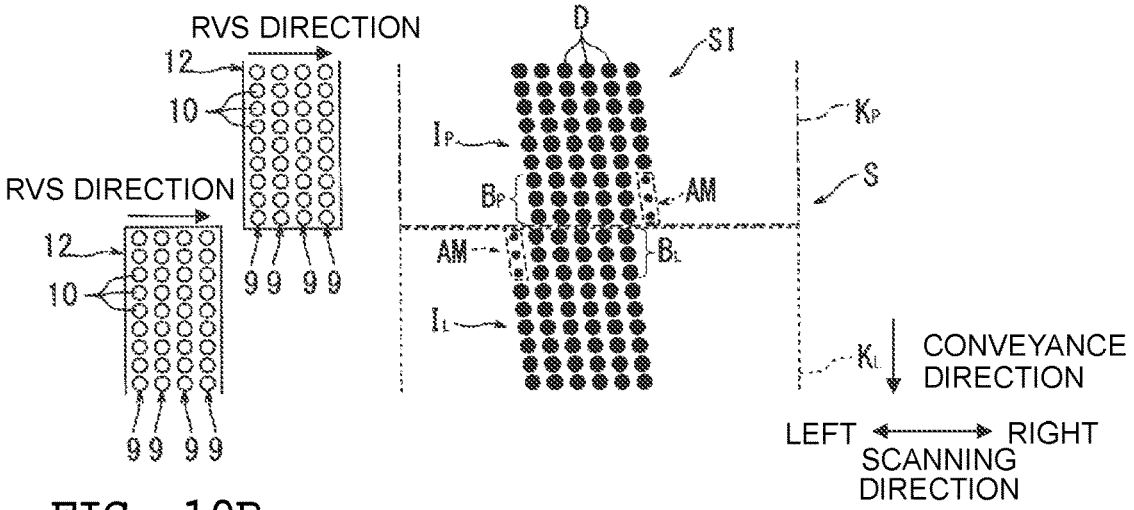
FIG. 10A depicts a specified image provided when a difference arises in the gap between the upstream and the downstream in the conveyance direction and the image data is corrected in the case of the unidirectional recording mode, FIG. 10B explains the fluctuation of the gap at a peak portion.
Figure 10B:
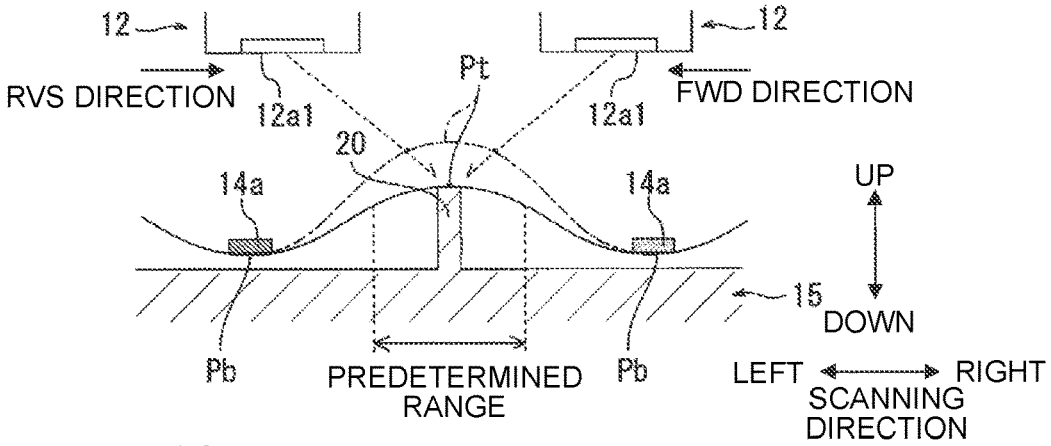
FIG. 10C depicts a specified image provided when the recording position is disposed within a predetermined range and the image data is corrected in the case of the bidirectional recording mode.

Further, in the case of the unidirectional recording mode, as depicted in FIG. 10A, the controller 50 sets the correcting portions AM respectively at the end portion of the first boundary area BL disposed on the upstream side in the RVS direction (left end portion) and the end portion of the second boundary area BP disposed on the downstream side in the RVS direction (right end portion). Accordingly, also in the case of the unidirectional recording mode, it is possible to make the deviation of the specified image SI hardly conspicuous. In this embodiment, each of the first boundary area BL and the second boundary area BP corresponds to the "specified area" of the present disclosure.

Next, an explanation will be made about the deviation of the specified image SI generated by the factor of the fluctuation of the gap at the peak portion of the recording paper S. As described above, the recording paper S is supported from the lower positions by the ribs 20 and the lower rollers 16*b*, and the recording paper S is held from the upper positions by the holding sections 14*a* of the plates 14 and the spurs 17. Accordingly, as depicted in FIGS. 4A and 4B, the recording paper S has the wavy shape in which the peak portions and the valley portions are alternately aligned in the scanning direction. In this case, the recording paper S is held at the valley portion of the recording paper S from the upper positions by the holding section 14*a* and the spur 17. Therefore, the gap with respect to the discharge surface 12*a*1 hardly fluctuates. On the other hand, the recording paper S is merely supported at the peak portion of the recording paper S from the lower positions by the rib 20 and the discharge roller pair 16, and the recording paper S is not held from the upper positions. On this account, the peak portion of the recording paper S easily floats as compared with an assumed situation, as depicted by an alternate long and short dash line in FIG. 10B, and the actual gap with respect to the discharge surface 12*a*1 is easily narrowed as compared with an assumed gap. As a result, when the recording mode is the bidirectional recording mode, even if the ink discharge control is performed so that the dots are formed at the same positions in the scanning direction at the peak portion in each of the preceding recording pass and the following recording pass, then the dots formed by the preceding recording pass and the dots formed by the following recording pass are formed while being separated from each other in relation to the scanning direction in some cases.

Figure 10C:
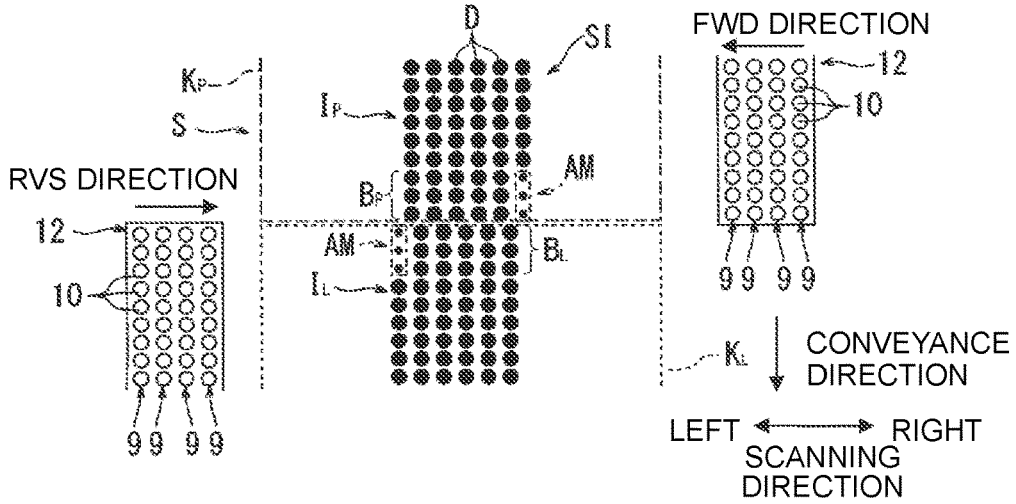

In view of the above, as a countermeasure against the deviation of the specified image SI generated by the factor of the fluctuation of the gap at the peak portion of the recording paper S, if the recording mode of the recording process is the bidirectional recording mode, the controller 50 corrects the specified image data ESI as follows in the image data correcting process. That is, as depicted in FIG. 10C, if the recording positions of the first boundary area BL and the second boundary area BP of the specified image SI are within a predetermined range about the center of the apex Pt, the correcting portions AM are set respectively at the end portion of the first boundary area BL disposed on the upstream side in the movement direction of the carriage 11 in the preceding recording pass and the end portion of the second boundary area BP disposed on the upstream side in the movement direction of the carriage 11 in the following recording pass. Then, the correction is performed for the specified image data ESI such that the discharge amounts set for the dot elements E corresponding to the discharge dots D belonging to the correcting portions AM are changed from "extra-large droplet" to "large droplet". According to the above, even when the deviation arises in the specified image SI on account of the factor of the fluctuation of the gap at the peak portion of the recording paper S, it is possible to make the deviation hardly conspicuous.

Next, an explanation will be made about the deviation of the specified image SI generated by the factor of the attitude change of the carriage 11 caused by the reaction force received from the contact surface 29*a* by the supply tube 27. As described above, the curved section 27*a* of the supply tube 27 is brought in contact with the contact surface 29*a* in the state in which the carriage 11 is positioned within the left end portion range as described above. In this situation, the supply tube 27 receives the reaction force from the contact surface 29*a*, and thus the tube joint 28 is pressed rightwardly.

Figure 11A:
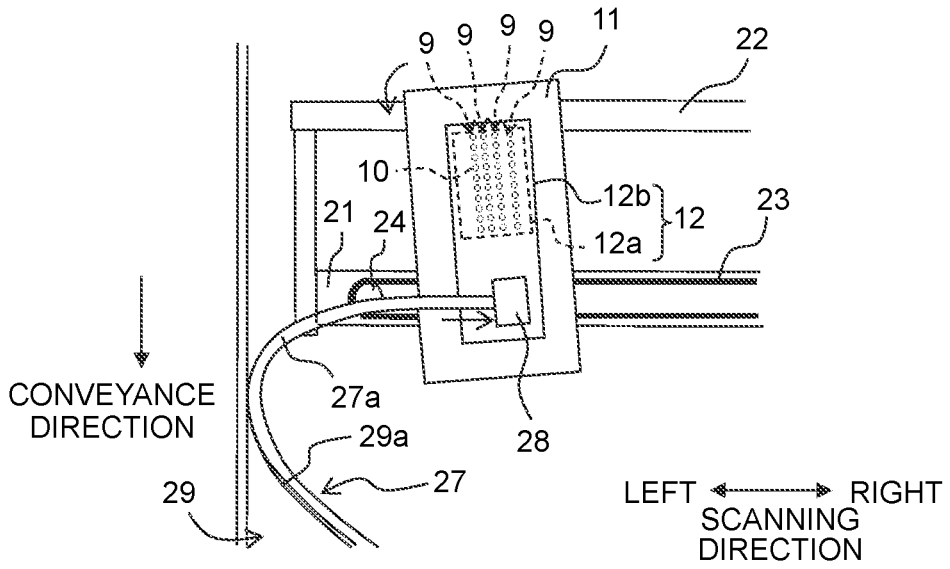
FIG. 11A explains the attitude change of the carriage.
Figure 11B:
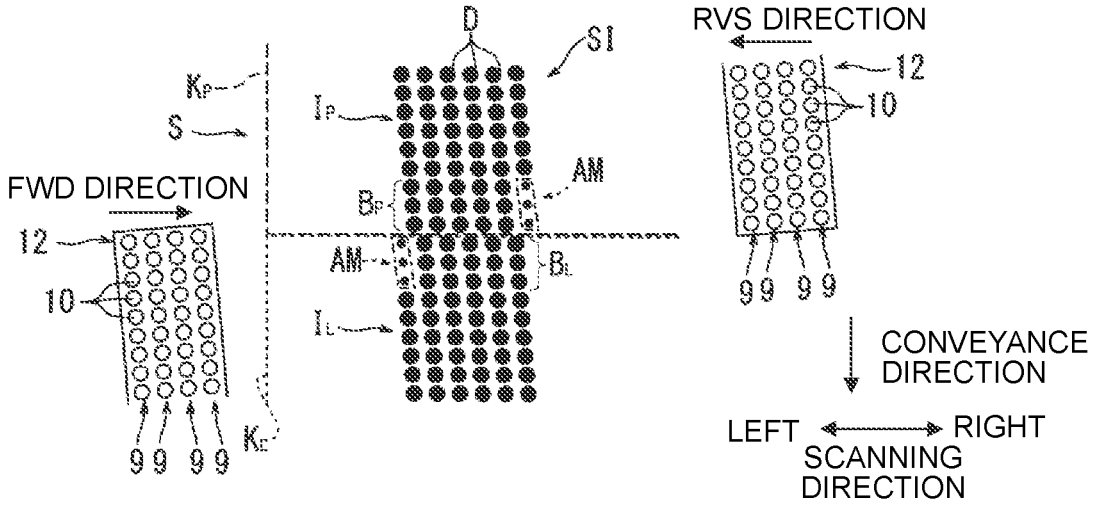
FIG. 11B depicts a specified image provided when the position of the carriage is disposed within the left end portion range and the image data is corrected.

Further, a play or clearance is provided to some extent between the carriage 11 and the guide rails 21, 22. Accordingly, in the state in which the carriage 11 is positioned within the left end portion range, as depicted in FIG. 11A, the carriage 11 undergoes the following situation. That is, the attitude of the carriage 11 is slightly changed by the pressing force received from the supply tube 27 by the ink-jet head 12. In particular, the carriage 11 is slightly rotated so that the nozzles 10 disposed on the upstream side in the conveyance direction of the nozzle arrays 9 are moved to the left, and the nozzles 10 disposed on the downstream side are moved to the right. As a result, the arrangement direction of the nozzle arrays 9 is not parallel to the conveyance direction, but the arrangement direction is slightly inclined with respect to the conveyance direction. Therefore, as depicted in FIG. 11B, in the state in which the carriage 11 is positioned within the left end portion range, the respective discharge dots D, which are formed by the ink discharged in the same discharge cycle from the respective nozzles 10 of the nozzle arrays 9 in the respective recording passes, have the formation positions as follows. That is, the discharge dots D, which are disposed on the more downstream side in the conveyance direction, are positioned more rightwardly in the scanning direction.

In view of the above, the controller 50 corrects the specified image data ESI as follows in the image data correcting process as a countermeasure against the deviation of the specified image SI generated by the factor of the attitude change of the carriage 11. That is, when the specified image SI is recorded, if the position of the carriage 11 is within the left end portion range, then the correcting portions AM are set respectively at the left end portion of the first boundary area BL and the right end portion of the second boundary area BP as depicted in FIG. 11B. Then, the correction is performed so that the discharge amounts, which are set for the dot elements E corresponding to the discharge dots D belonging to the correcting portions AM, are changed from "extra-large droplet" to "large droplet" in the specified image data ESI. According to the above, even if the deviation arises in the specified image SI on account of the factor of the attitude change of the carriage 11, it is possible to make the deviation hardly conspicuous.

As described above, in this embodiment, if it is assumed that the first boundary area BL is deviated rightwardly as a whole with respect to the second boundary area BP, the right end portion of the first boundary area BL and the left end portion of the second boundary area BP are set as the correcting portions AM respectively. On the other hand, if it is assumed that the first boundary area BL is deviated leftwardly as a whole with respect to the second boundary area BP, the left end portion of the first boundary area BL and the right end portion of the second boundary area BP are set as the correcting portions AM respectively. In other words, the end portion, which is included in the right end portion of the first boundary area BL and the right end portion of the second boundary area BP and which is disposed near to the right end of the recording paper S, is set as the correcting portion AM. Similarly, the end portion, which is included in the left end portion of the first boundary area BL and the left end portion of the second boundary area BP and which is disposed near to the left end of the recording paper S, is set as the correcting portion AM.

In this context, if the correcting portion AM is set as described above, and the correction is performed to decrease the discharge amount set for the dot element E corresponding to the discharge dot D belonging to the correcting portion AM, the density of the correcting portion AM is thinned as compared with a case in which the correction is not performed.

On the other hand, if the specified image SI is the text, then there are many blanks (dots in which the discharge amounts set for the dot elements E are zero (undischarge)) around the specified image SI as described above, and the duty is low (less than a threshold value) in the area which is adjacent in the scanning direction to the correcting portion AM. In this context, the duty means the ratio of the areal size in which the discharge dots D corresponding to the dot elements E having the discharge amounts larger than zero are formed, with respect to the areal size of the entire area. Then, in this case, the correcting portion AM is adjacent in the scanning direction to the area in which the duty is low. Therefore, the thin density of the correcting portion AM is hardly conspicuous.

Figure 12A:
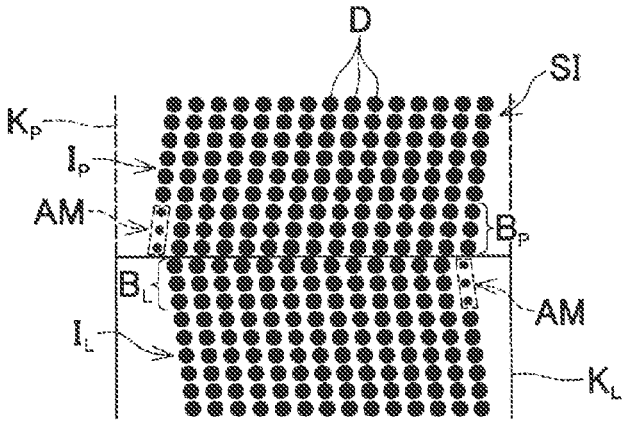
FIG. 12A depicts a dot arrangement provided when the duty is high in an area adjacent in the scanning direction of the correcting portion corresponding to FIG. 8C.
Figure 12B:
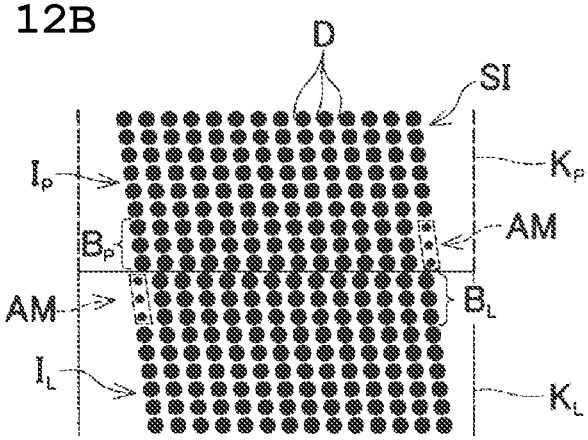
FIG. 12B depicts a dot arrangement provided when the duty is high in an area adjacent in the scanning direction of the correcting portion corresponding to FIG. 11B.
Figure 12C:
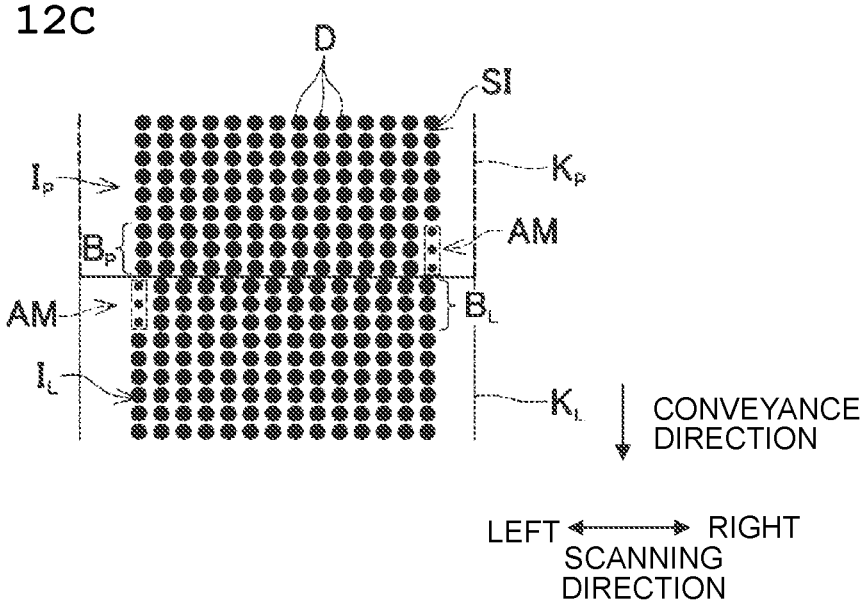
FIG. 12C depicts a dot arrangement provided when the duty is high in an area adjacent in the scanning direction of the correcting portion corresponding to FIG. 10C.

On the contrary, if the specified image SI is any one such as a picture, a photograph or the like other than the text, the duty is high (not less than a threshold value) in the area which is adjacent in the scanning direction to the correcting portion AM as depicted in FIGS. 12A to 12C. In this case, FIGS. 12A to 12C depict exemplary arrangements of the dots when the specified image SI is any one such as a picture, a photograph or the like other than the text. FIG. 12A corresponds to FIG. 8C, FIG. 12B corresponds to FIG. 10A and FIG. 11B, and FIG. 12C corresponds to FIG. 10C. Then, in this case, the correcting portion AM in which the density is thinned on account of the correction and the portion in which the duty is high as described above are aligned while being adjacent to one another in the scanning direction. Therefore, the thinned density of the correcting portion AM is easily conspicuous on account of the difference in the density between these portions. Then, in this case, it is feared that the image quality of the image to be recorded may be conversely lowered as a result of the execution of the correction as described above.

In view of the above, in the first embodiment, if the specified image SI is the text, the correction as described above is performed. If the specified image SI is any one other than the text, the correction as described above is not performed.

Figure 13A:
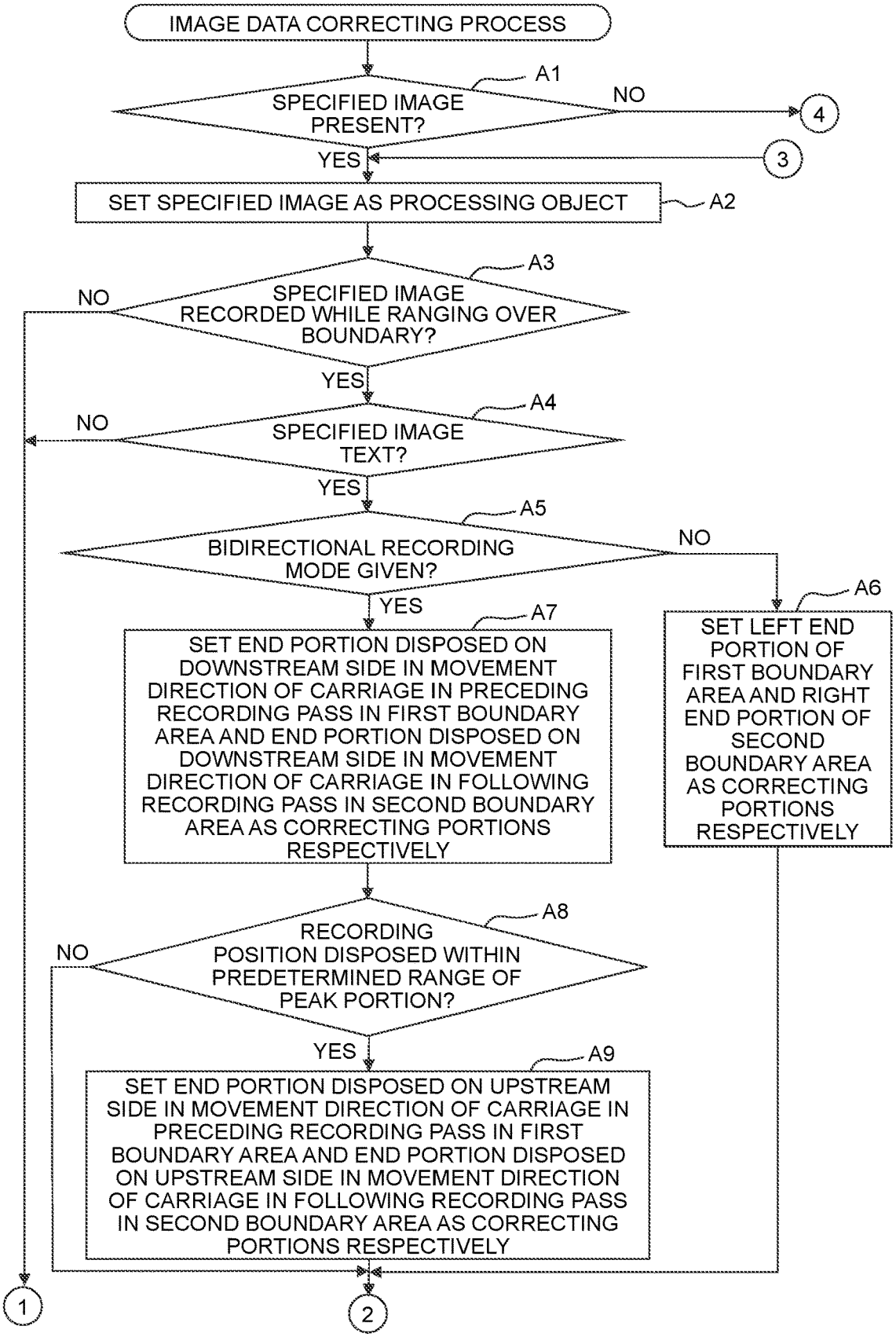
FIGS. 13A and 13B depict flow charts illustrating a flow of an image data correcting process.
Figure 13B:
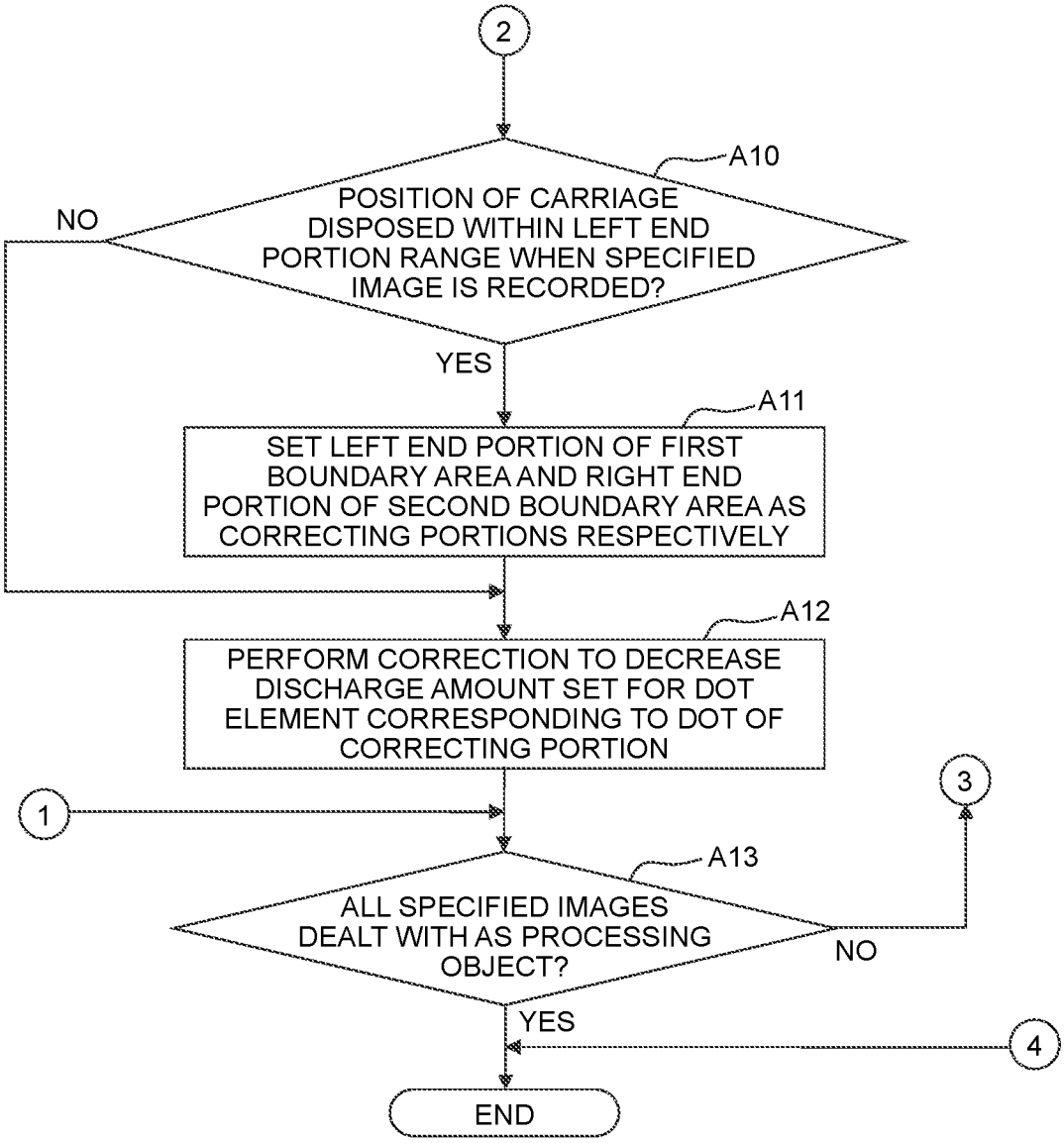

An explanation will be made below with reference to FIGS. 13A and 13B about a flow of the image data correcting process.

The controller 50 judges whether or not the specified image SI is present in the image to be recorded by the recording process on the basis of the image data IM stored in RAM 53 (A1). If it is judged that the specified image SI is absent (A1: NO), the controller 50 terminates this process.

On the other hand, if it is judged that the specified image SI is present (A1: YES), the controller 50 sets one of the specified images SI as the specified image SI which is the processing object (A2). Then, the controller 50 judges whether or not the specified image SI as the processing object is recorded while ranging over the boundary between the first dot recording range KL of the preceding recording pass and the second dot recording range KP of the following recording pass of the two times of the continuous recording passes (A3). Note that it is judged by what number of the recording pass the dot corresponding to each of the dot elements E of the image data IM is formed, depending on the position in the Y direction of the dot element E on the image data IM. Therefore, it is possible for the controller 50 to judge whether or not the specified image SI is recorded while ranging over the boundary between the first dot recording range KL and the second dot recording range KP, according to the position in the Y direction of each of the dot elements E of the specified image data ESI corresponding to the specified image SI.

If it is judged that the specified image SI as the processing object is not recorded while ranging over the boundary between the first dot recording range KL and the second dot recording range KP (A3: NO), the controller 50 proceeds to the process of A13. On the other hand, if it is judged that the specified image SI is recorded while ranging over the boundary (A3: YES), the controller 50 judges whether or not the specified image SI as the processing object is the text (A4). It is judged whether or not the specified image SI is the text, on the basis of the specified image data ESI corresponding to the specified image SI as the processing object.

If the specified image SI as the processing object is not the text (A4: NO), the controller 50 proceeds to the process of A13. If the specified image SI as the processing object is the text (A4: YES), the controller 50 judges whether the recording mode, which is provided when the image is recorded, is the bidirectional recording mode or the unidirectional recording mode (A5). In the process of A5, for example, the controller 50 performs the judgment on the basis of the signal which is inputted together with the recording instruction and which instructs the recording mode when the image is recorded. If it is judged that the recording is performed in the unidirectional recording mode (A5: NO), the controller 50 sets the left end portion of the first boundary area BL of the specified image SI as the processing object and the right end portion of the second boundary area BP as the correcting portions AM respectively (A6). If the process of A6 is terminated, the controller 50 proceeds to the process of A10.

If it is judged in the process of A5 that the recording is performed in the bidirectional recording mode (A5: YES), the controller 50 sets the end portion disposed on the downstream side in the movement direction of the carriage 11 in the preceding recording pass in the first boundary area BL of the specified image SI as the processing object and the end portion disposed on the downstream side in the movement direction of the carriage 11 in the following recording pass in the second boundary area BP as the correcting portions AM respectively (A7). After that, the controller 50 judges whether or not the recording position of each of the first boundary area BL and the second boundary area BP of the specified image SI as the processing object is disposed within the predetermined range about the center of the apex Pt (A8). Note that it is judged at what position in the scanning direction on the recording paper S the dot corresponding to each of the dot elements E of the image data IM is formed, depending on the position in the X direction of the dot element E on the image data IM. Therefore, it is possible for the controller 50 to judge whether or not the recording position of each of the first boundary area BL and the second boundary area BP is disposed within the predetermined range about the center of the apex Pt, from the position in the X direction of the dot element E corresponding to the dot of each of the first boundary area BL and the second boundary area BP of the specified image SI.

If it is judged that the recording positions of the first boundary area BL and the second boundary area BP are not disposed within the predetermined range (A8: NO), the controller 50 proceeds to the process of A10. On the other hand, if it is judged that the recording positions of the first boundary area BL and the second boundary area BP are disposed within the predetermined range (A8: YES), the controller 50 sets the end portion disposed on the upstream side in the movement direction of the carriage 11 in the preceding recording pass in the first boundary area BL of the specified image SI as the processing object and the end portion disposed on the upstream side in the movement direction of the carriage 11 in the following recording pass in the second boundary area BP as the correcting portions AM respectively (A9). If the process of A9 is terminated, the controller 50 proceeds to the process of A10.

In the process of A10, the controller 50 judges whether or not the position of the carriage 11 is disposed within the left end portion range when the specified image SI as the processing object is recorded. Note that the position of the carriage 11, which is provided when each of the dots is formed, is judged depending on the position in the X direction of the corresponding dot element E on the image data IM. Therefore, it is possible for the controller 50 to judge whether or not the position of the carriage 11, which is provided when the specified image SI is recorded, is disposed within the left end portion range, from the position in the X direction of the dot element E corresponding to each of the dots of the specified image SI.

If it is judged that the position of the carriage 11, which is provided when the specified image SI as the processing object is recorded, is not disposed within the left end portion range (A10: NO), the controller 50 proceeds to the process of A12. On the other hand, if it is judged that the position of the carriage 11, which is provided when the specified image SI as the processing object is recorded, is disposed within the left end portion range (A10: YES), the controller 50 sets the left end portion in the first boundary area BL of the specified image SI as the processing object and the right end portion in the second boundary area BP as the correcting portions AM respectively (A11). If the process of A11 is terminated, the controller 50 proceeds to the process of A12.

In the process of A12, the controller 50 performs the correction so that the discharge amount, which is set for the dot element E corresponding to the discharge dot D belonging to the correcting portion AM, is decreased from "extra-large droplet" to "large droplet" in the specified image data ESI of the specified image SI as the processing object. If the process of A12 is terminated, the controller 50 proceeds to the process of A13.

In the process of A13, the controller 50 judges whether or not all of the specified images SI, which are to be recorded by the recording process, are set as the specified images SI as the processing objects. If it is judged that any one of the specified images SI is not set as the specified image SI as the processing object (A13: NO), then the controller 50 returns to the process of A2, and the controller 50 sets one of the specified images SI having been not set as the specified image SI as the processing object yet, as the specified image SI as the processing object. On the other hand, if it is judged that all of the specified images SI are set as the specified images SI as the processing objects (A13: YES), the controller 50 terminates this process.

Note that in the first embodiment, in the image data correcting process of S1, the correcting portion AM is set by means of at least one of the processes of A6, A7, A9, and A11. The discharge of the ink directed from the nozzle 10 toward the recording paper S, which is performed in the recording pass brought about by the discharge process of S3 when the correction is performed to decrease the discharge amount set for the dot element E corresponding to the discharge dot D belonging to the correcting portion AM as in A12, corresponds to the "correcting discharge" of the present disclosure. Further, the discharge of the ink directed from the nozzle 10 toward the recording paper S, which is performed in the recording pass brought about by the discharge process of S3 when the foregoing correction is not performed in the image data correcting process of S1, corresponds to the "ordinary discharge" of the present disclosure.

Further, the condition, in which the specified image SI is the text, corresponds to the "first condition" and the "predetermined condition" of the present disclosure.

According to the first embodiment, when the specified image SI is the text, even if the deviation appears in the specified image SI on account of the factor of the difference between the upstream and the downstream in the conveyance direction of the gap, the fluctuation of the gap at the peak portion of the recording paper S, or the attitude change of the carriage 11 caused by the reaction force of the supply tube 27, then it is possible to decrease the size of the discharge dot D formed at the corner portion thereof. That is, it is possible to chamfer the corner portion of the deviation generated in the specified image SI. As a result, it is possible to make the deviation of the specified image SI hardly conspicuous.

On the other hand, when the specified image SI is any one other than the text, the controller 50 does not perform the correction as described above. Accordingly, it is possible to avoid the deterioration of the image quality of the image to be recorded.

Further, in the first embodiment, the controller 50 judges whether or not the correction as described above is performed individually for each of the plurality of specified images SI when the plurality of specified images are present. Accordingly, it is possible for the controller 50 to appropriately decide whether or not the correction as described above is performed for each of the specified images SI.

Second Embodiment

Figure 14A:
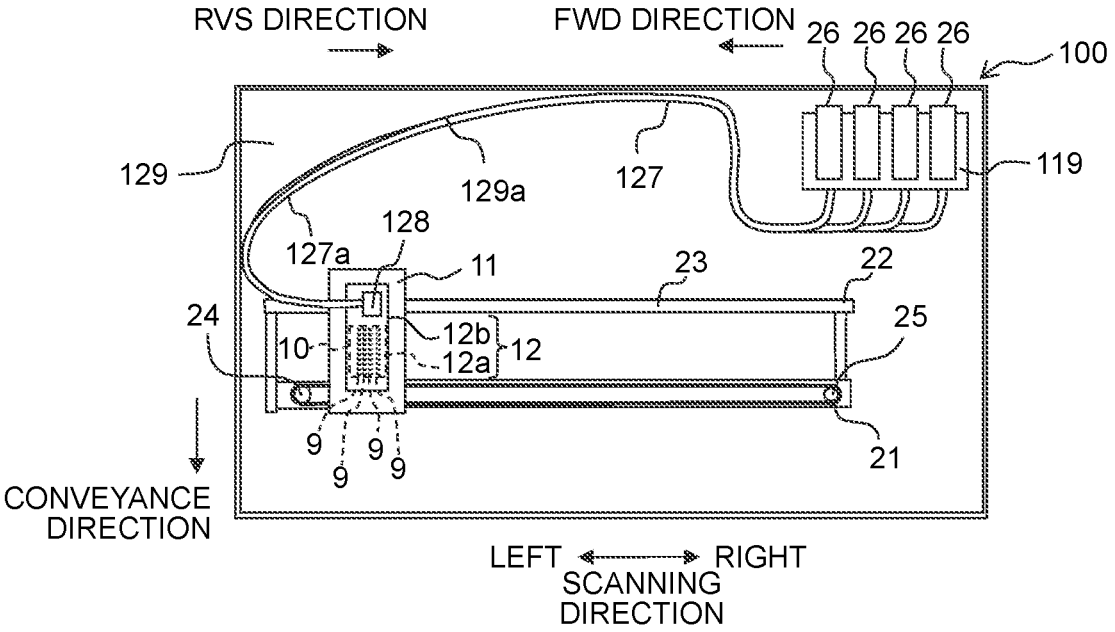
FIG. 14A depicts a drawing according to a second embodiment corresponding to FIG. 2A.

Next, a second embodiment of the present disclosure will be explained. For example, in the case of a large-sized printer, the attaching/detaching operation for an ink cartridge 26, which is to be performed by a user, is sometimes performed from the back surface side of the printer. As depicted in FIG. 14A, in the case of a printer 100 according to the second embodiment as well, in order that the user can perform the attaching/detaching operation for the ink cartridge 26 from the back surface side of the printer 100, a holder 119, to which the ink cartridges 26 are detachably installed, is arranged at the back of a carriage 11.

Further, a tube joint 128 is provided at a position disposed on the upstream side in the conveyance direction as compared with the middle position in the conveyance direction of the ink-jet head 12. Respective four supply tubes 127 connect the respective four ink cartridges 26 installed to a holder 119 and the tube joint 128. The four supply tubes 127 extend leftwardly from the connecting portion with respect to the tube joint 128, and the supply tubes 127 are bent on the left side from the ink-jet head 12 disposed in the printer 1 to change the direction and extend rightwardly, at which the supply tubes 127 have curved portions 127*a*. Further, a contact member 129, which supports the four supply tubes 127, is provided at the back of the carriage 11. A contact surface 129*a* of the contact member 129 makes contact with the four supply tubes 127 in a state in which the carriage 11 is positioned within the left end portion range in the movable range. In this situation, the supply tubes 127 receive the reaction force from the contact surface 129*a*, and thus the tube joint 128 is pressed rightwardly thereby.

In the configuration as described above, in the state in which the carriage 11 is positioned within the left end portion range, the carriage 11 undergoes the following situation. That is, the carriage 11 is slightly rotated so that the nozzles 10 disposed on the upstream side in the conveyance direction of the nozzle arrays 9 are moved to the right, and the nozzles 10 disposed on the downstream side are moved to the left. As a result, in the state in which the carriage 11 is positioned within the left end portion range, the respective discharge dots D, which are formed by the ink discharged in the same discharge cycle from the respective nozzles 10 of the nozzle arrays 9 in each of the recording passes, have the formation positions as follows. That is, the discharge dots D, which are disposed on the more downstream side in the conveyance direction, are positioned more leftwardly in the scanning direction.

Figure 14B:
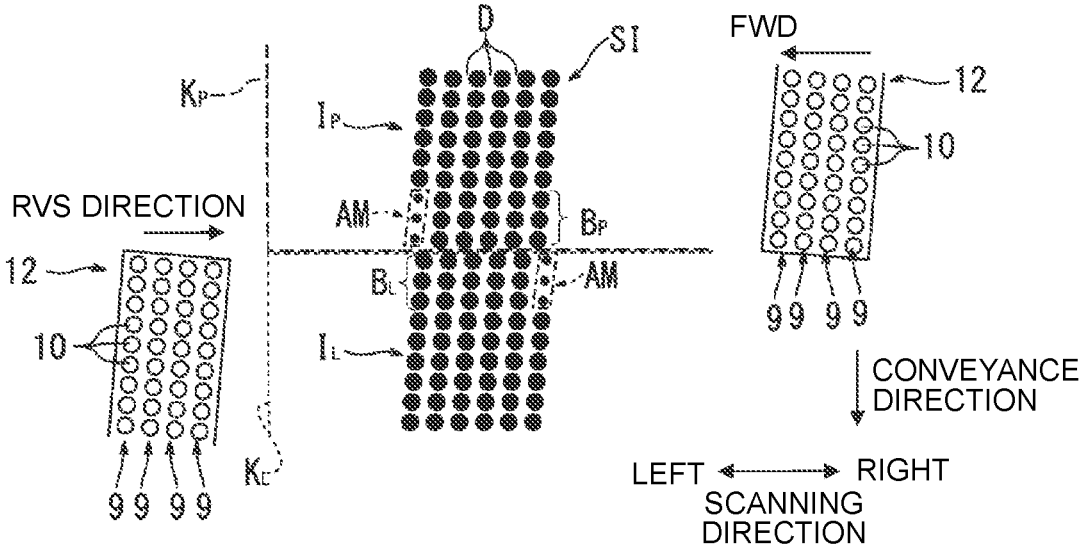
FIG. 14B depicts a specified image according to the second embodiment as provided when the position of a carriage is disposed within a left end portion range and the image data is corrected.

In view of the above, in the second embodiment, the controller 50 corrects the specified image data ESI as follows in the image data correcting process, as a countermeasure against the deviation of the specified image SI generated by the factor of the attitude change of the carriage 11. That is, when the specified image SI is recorded, if the position of the carriage 11 is disposed within the left end portion range, then the controller 50 sets the right end portion of the first boundary area BL and the left end portion of the second boundary area BP as the correcting portions AM respectively as depicted in FIG. 14B. Then, the controller 50 performs the correction in relation to the specified image data ESI so that the discharge amount set for the dot element E corresponding to the discharge dot D belonging to the correcting portion AM is changed from "extra-large droplet" to "large droplet". According to the above, even if the deviation is generated in the specified image SI on account of the factor of the attitude change of the carriage 11, it is possible to make the deviation hardly conspicuous.

Figure 15A:
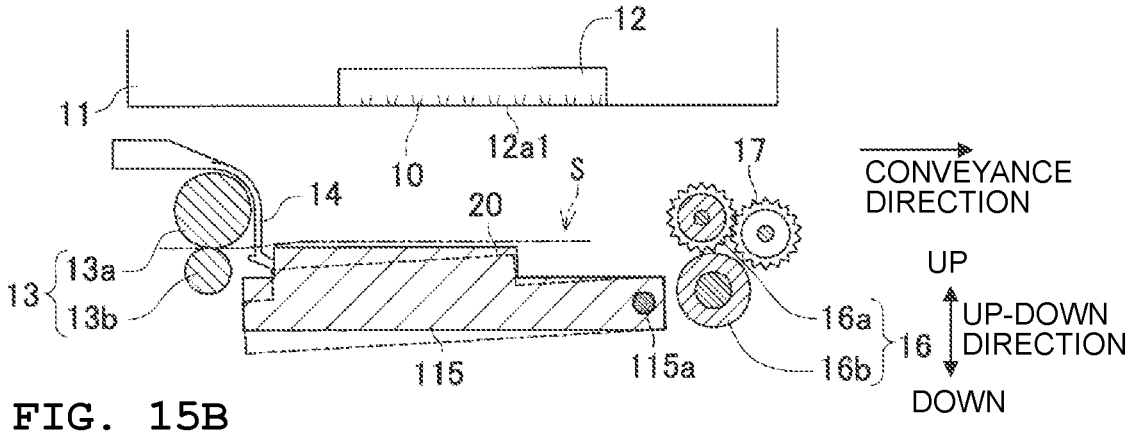
FIG. 15A depicts a drawing according to the second embodiment corresponding to FIG. 5A.
Figure 15B:
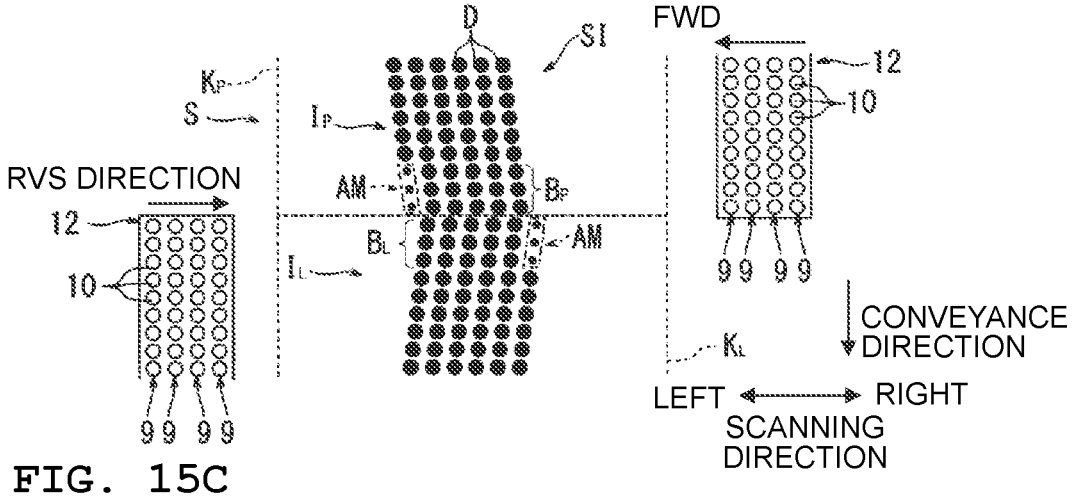
FIG. 15B depicts a specified image provided when the image data is corrected in the case of the bidirectional recording mode.

Further, in the second embodiment, as depicted in FIG. 15A, the platen 115 is swingably supported by a swinging shaft 115*a* which is provided at an end portion on the downstream side in the conveyance direction and which extends in the scanning direction. Further, the platen 115 is urged by an unillustrated spring or the like, and thus the platen 115 is positioned at the position indicated by solid lines in the drawing in a state in which the recording paper S is not conveyed. The platen 115 is pushed downwardly by the recording paper S held by the plate 14. As depicted by alternate long and short dash lines in FIG. 15A, the platen 115 makes swinging movement about the center of the swinging shaft 115*a*. Further, in this situation, the platen makes swinging movement more greatly as the thickness of the recording paper S is thicker. Further, in this embodiment, the nozzle 10, which is positioned on the most downstream side in the conveyance direction of the nozzle array 9, is set as the reference nozzle. Then, the discharge timing of the ink is set so that the positions in the scanning direction of the dot arrays formed by the ink discharged from the reference nozzles in each of the recording passes are identical with each other. Therefore, in the case of the bidirectional recording mode, as depicted in FIG. 15B, the second boundary area BP is deviated as a whole toward the downstream side in the movement direction of the carriage 11 in the following recording pass with respect to the first boundary area BL.

Accordingly, the controller 50 corrects the specified image data ESI as follows in the image data correcting process as a countermeasure against the deviation of the specified image SI generated as a result of the difference between the upstream and the downstream in the conveyance direction of the gap. That is, in the case of the bidirectional recording mode, as depicted in FIG. 15B, the controller 50 sets the end portion disposed on the downstream side in the movement direction of the carriage 11 in the preceding recording pass of the first boundary area BL and the end portion disposed on the downstream side in the movement direction of the carriage 11 in the following recording pass of the second boundary area BP as the correcting portions AM respectively. Then, the controller 50 performs the correction in relation to the specified image data ESI so that the discharge amount, which is set for the dot element E corresponding to the discharge dot D belonging to the correcting portion AM, is changed from "extra-large droplet" to "large droplet".

Figure 15C:
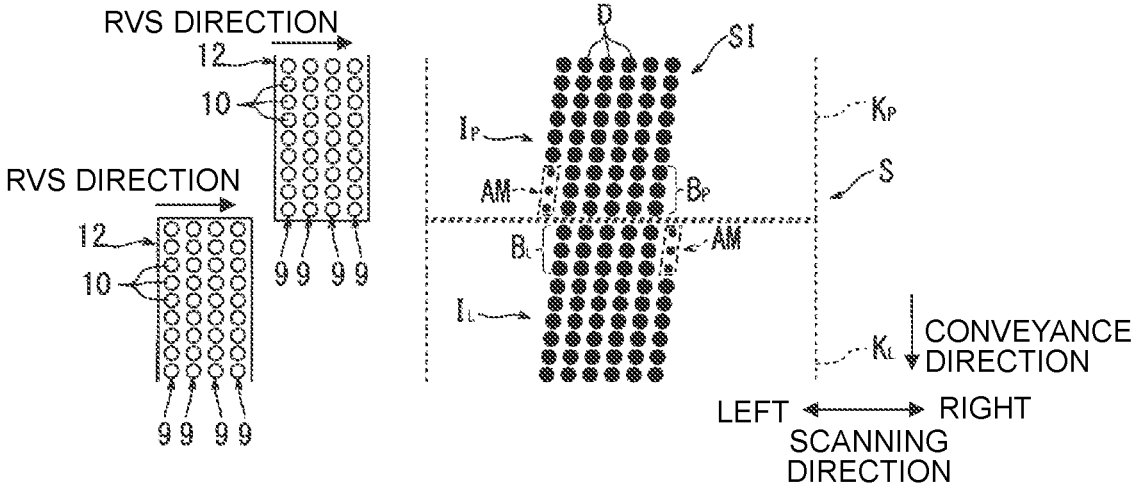
FIG. 15C depicts a specified image provided when the image data is corrected in the case of the unidirectional recording mode.

Note that in the case of the unidirectional recording mode, as depicted in FIG. 15C, the controller 50 sets the end portion (right end portion) disposed on the downstream side in the RVS direction in the first boundary area BL and the end portion (left end portion) disposed on the upstream side in the RVS direction in the second boundary area BP as the correcting portions AM respectively.

However, also in the second embodiment, if the specified image SI is the text, the correction of the discharge amount as described above is performed. If the specified image SI is any one other than the text, the correction of the discharge amount as described above is not performed.

Figure 16A:
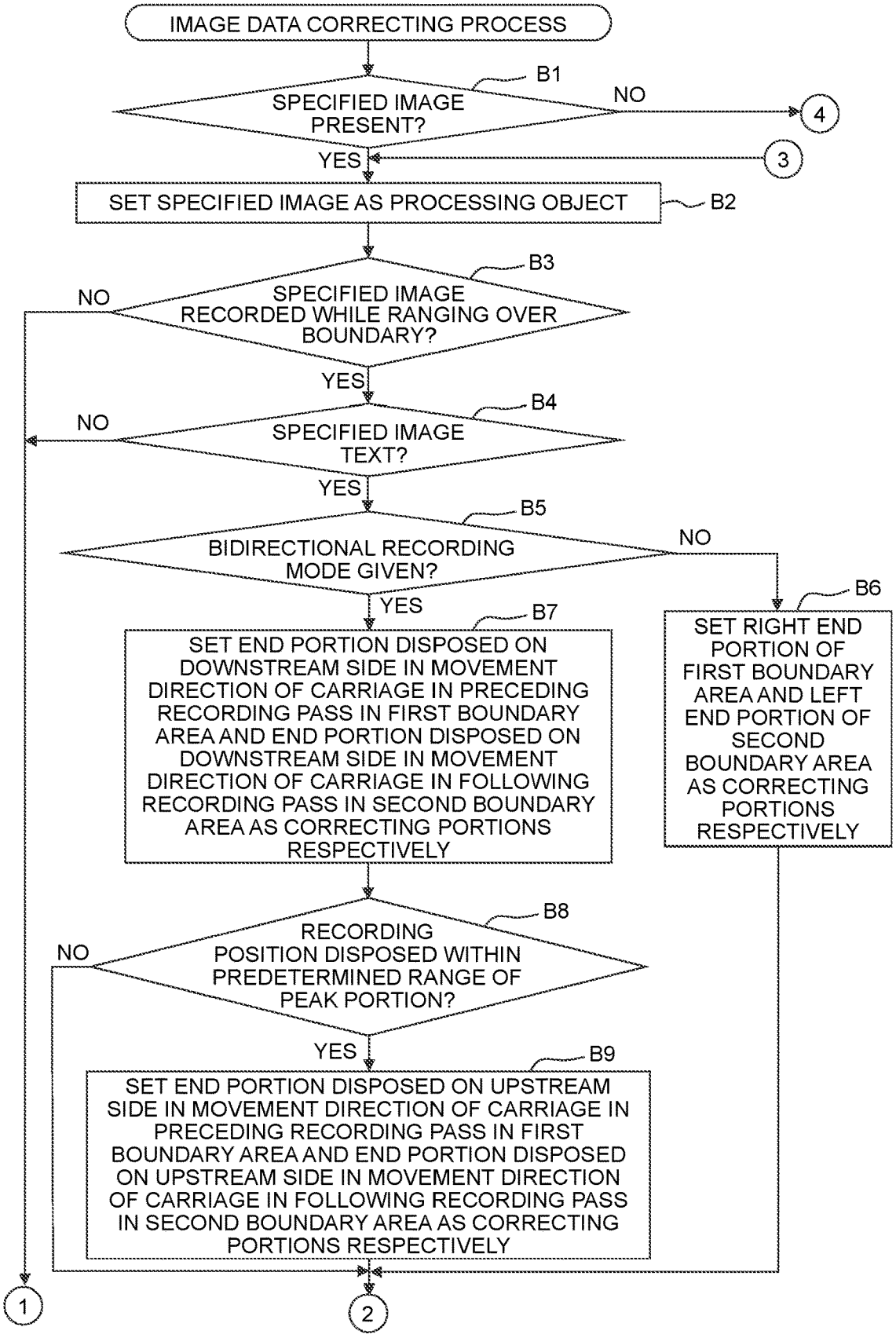
FIGS. 16A and 16B depict flow charts illustrating a flow of an image data correcting process according to the second embodiment.
Figure 16B:
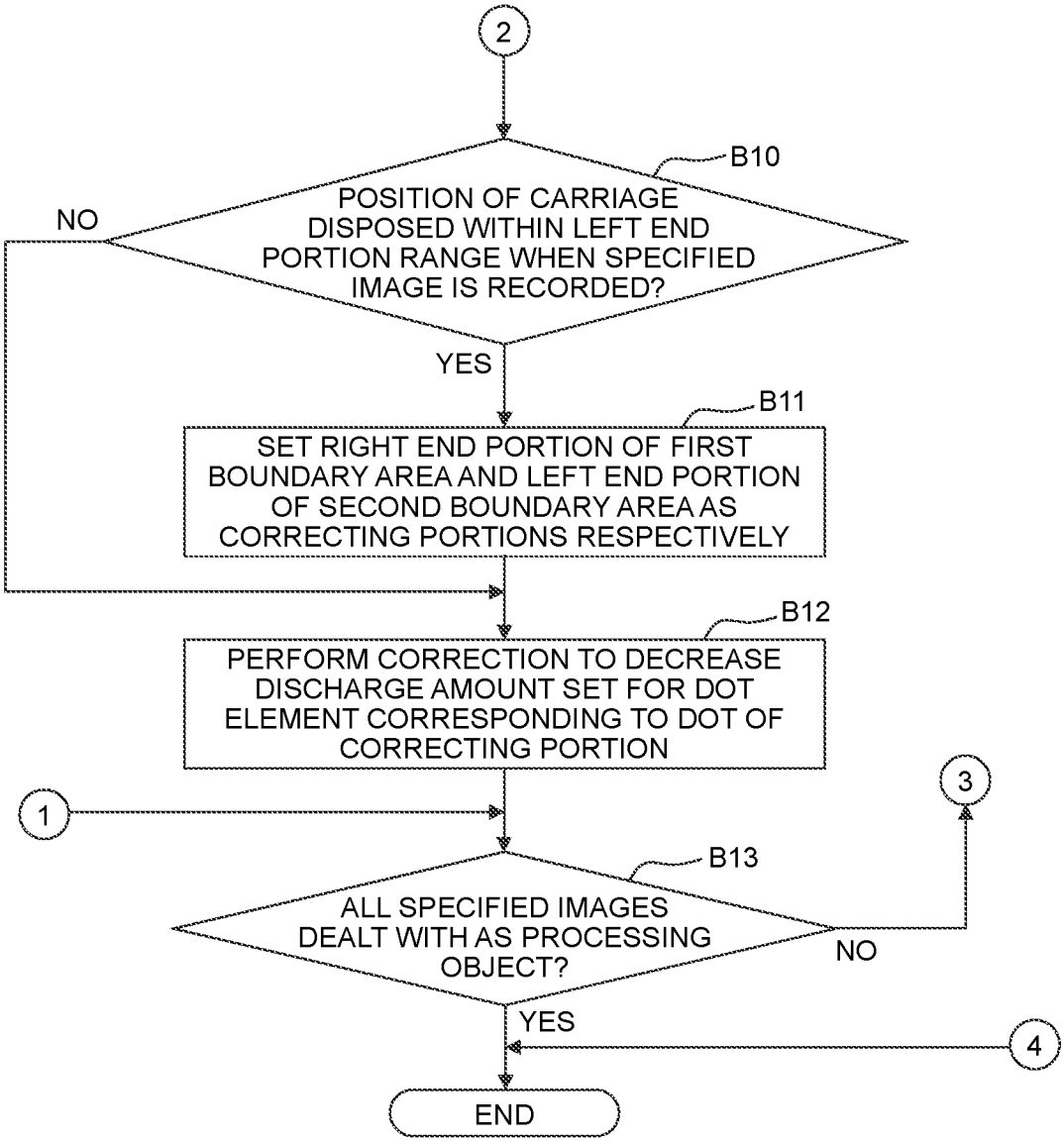

An explanation will be made below with reference to FIGS. 16A and 16B about a flow of the image data correcting process.

The controller 50 firstly executes the processes of B1 to B5 in the same manner as the processes of A1 to A5 described above. Then, if it is judged in the process of B5 that the recording is performed in the unidirectional recording mode (B5: NO), the controller 50 sets the right end portion of the first boundary area BL of the specified image SI as the processing object and the left end portion of the second boundary area BP as the correcting portions AM respectively (B6). If the process of B6 is terminated, the controller 50 proceeds to the process of B10.

If it is judged in the process of B5 that the recording is performed in the bidirectional recording mode (B5: YES), the controller 50 sets the end portion disposed on the downstream side in the movement direction of the carriage 11 in the preceding recording pass in the first boundary area BL of the specified image SI as the processing object and the end portion disposed on the downstream side in the movement direction of the carriage 11 in the following recording pass in the second boundary area BP as the correcting portions AM respectively (B7). After that, the controller 50 executes the processes of B8 and B9 in the same manner as the processes of A8 and A9 described above, and the controller 50 proceeds to the process of B10.

In the process of B10, the controller 50 judges whether or not the position of the carriage 11 is disposed within the left end portion range when the specified image SI as the processing object is recorded. Then, if it is judged that the position of the carriage 11, which is provided when the specified image SI as the processing object is recorded, is not disposed within the left end portion range (B10: NO), the controller 50 proceeds to the process of B12. On the other hand, if it is judged that the position of the carriage 11, which is provided when the specified image SI as the processing object is recorded, is disposed within the left end portion range (B10: YES), the controller 50 sets the right end portion in the first boundary area BL of the specified image SI as the processing object and the left end portion in the second boundary area BP as the correcting portions AM respectively (B11). If the process of B11 is terminated, the controller 50 proceeds to the process of B12.

Then, the controller 50 executes the processes of B12 and B13 in the same manner as the processes of A12 and A13 described above.

Note that in the second embodiment, in the image data correcting process of S1, the correcting portion AM is set by means of at least one of the processes of B6, B7, B9, and B11. The discharge of the ink directed from the nozzle 10 toward the recording paper S, which is performed in the recording pass brought about by the discharge process of S3 when the correction is performed to decrease the discharge amount set for the dot element E corresponding to the discharge dot D belonging to the correcting portion AM as in B12, corresponds to the "correcting discharge" of the present disclosure. Further, the discharge of the ink directed from the nozzle 10 toward the recording paper S, which is performed in the recording pass brought about by the discharge process of S3 when the foregoing correction is not performed in the image data correcting process of S1, corresponds to the "ordinary discharge" of the present disclosure.

Further, the condition, in which the specified image SI is the text, corresponds to the "first condition" and the "predetermined condition" of the present disclosure.

In the second embodiment as well, when the specified image SI is the text, even if the deviation appears in the specified image SI on account of the factor of the difference between the upstream and the downstream in the conveyance direction of the gap, the fluctuation of the gap at the peak portion of the recording paper S, or the attitude change of the carriage 11 caused by the reaction force of the supply tube 127, then it is possible to decrease the sizes of the discharge dots D formed at the corner portions. That is, it is possible to chamfer the corner portions of the deviation generated in the specified image SI. As a result, it is possible to make the deviation of the specified image SI hardly conspicuous. On the other hand, when the specified image SI is any one other than the text, then the controller 50 does not perform the correction as described above, and thus it is possible to avoid the deterioration of the image quality of the image to be recorded.

Further, in the second embodiment as well, the controller 50 judges whether or not the correction as described above is performed individually for each of the plurality of specified images SI when the plurality of specified images are present. Accordingly, it is possible for the controller 50 to appropriately decide whether or not the correction as described above is performed for each of the specified images SI.

Third Embodiment

Next, a third embodiment will be explained. In the third embodiment, the controller 50 performs a countermeasure against the deviation of the specified image SI caused by the factor of the air flow generated in the printer 1, in the image data correcting process. Note that the following explanation will be made assuming that the deviation is not caused in the specified image SI by any factor other than the air flow, for the sake of convenience.

Figure 17A:
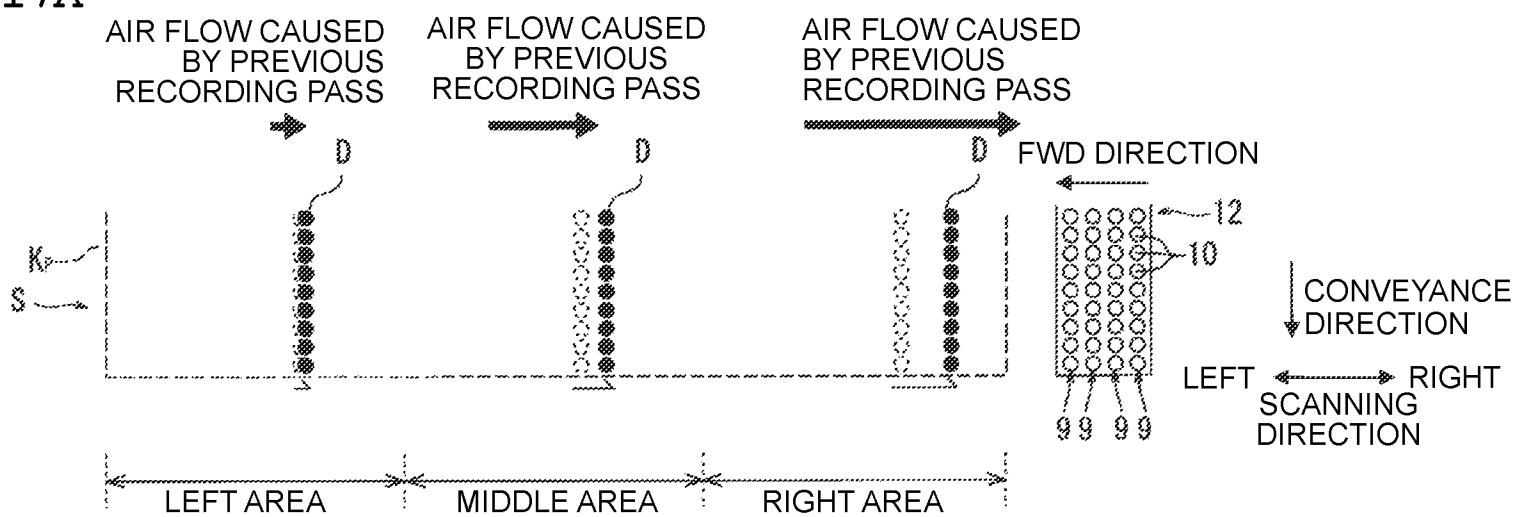
FIG. 17A explains the deviation of the ink landing position caused by an air flow.

At first, the air flow generated in the printer 1 will be explained. When the carriage 11 is moved in the scanning direction, the air flow, which flows in the movement direction of the carriage 11, is generated in the printer 1 in accordance with the movement of the carriage 11. Then, the air flow remains for a while even after the movement of the carriage 11 is terminated. On this account, when the carriage was moved in the direction different from the movement direction of the carriage 11 in the Nth recording pass, immediately before the Nth (N is a positive integer) recording pass, the air flow, which is in the direction opposite to the movement direction of the carriage 11, remains when the Nth recording pass is performed. As a result, as depicted in FIG. 17A, the formation positions of the dots to be formed by the Nth recording pass are deviated by the air flow toward the upstream side in the movement direction of the carriage 11 as compared with the ideal formation positions (depicted by dotted lines). Further, the size of the air flow is decreased as the time elapses. Therefore, the deviation amount of the formation position of the dot formed by the Nth recording pass with respect to the ideal formation position is more increased on the more upstream side in the movement direction of the carriage 11 in the Nth recording pass.

In this context, in the case of the unidirectional recording mode, the return operation is performed as described above between the two times of the continuous recording passes. On this account, when any one of the 2nd recording pass and the followings is performed, the air flow generated by the return operation remains. Therefore, the formation positions of the dots formed by each of the recording passes of the 2nd recording pass and the followings are deviated by the air flow toward the upstream side in the movement direction of the carriage 11 as compared with the ideal formation positions. However, in the case of the unidirectional recording mode, the movement direction of the carriage 11 in each of the recording passes is always the RVS direction. Therefore, the formation positions of the dots formed by each of the recording passes are evenly deviated to the left with respect to the ideal formation positions. As a result, in the case of the unidirectional recording mode, it is hardly possible that the first boundary area BL of the specified image SI may be deviated with respect to the second boundary area BP by being affected by the influence of the air flow.

Figure 17B:
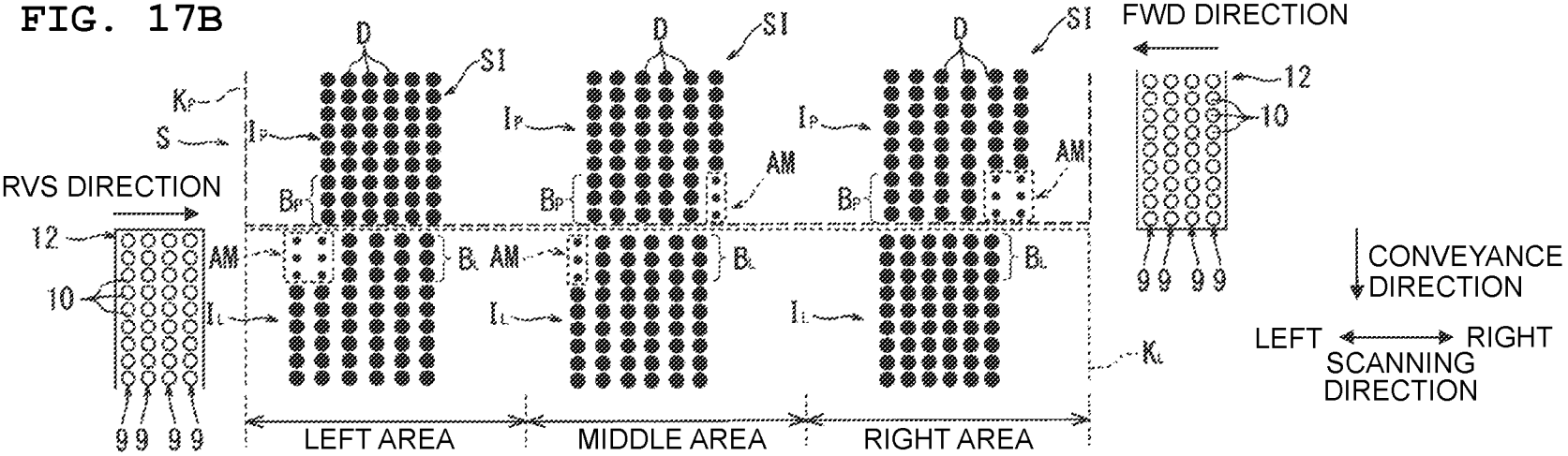
FIG. 17B depicts a specified image provided when the image data is corrected in the case of the bidirectional recording mode according to a third embodiment.

On the other hand, in the case of the bidirectional recording mode, the movement direction of the carriage 11 in the preceding recording pass of the two times of the continuous recording passes is mutually different from the movement direction of the carriage 11 in the following recording pass. Therefore, the directions, in which the formation positions of the dots formed by the two times of the continuous recording passes respectively are deviated with respect to the ideal formation positions, are different from each other. As a result, as depicted in FIG. 17B, in the case of the bidirectional recording mode, it is highly possible that the first boundary area BL of the specified image SI may be deviated with respect to the second boundary area BP by being affected by the influence of the air flow.

In the third embodiment, the controller 50 corrects the specified image data ESI as follows in the image data correcting process as a countermeasure against the deviation of the specified image SI generated by the factor of the air flow. That is, if the recording mode of the recording process is the bidirectional recording mode, the controller 50 sets the end portion disposed on the upstream side in the movement direction of the carriage 11 in the preceding recording pass of the first boundary area BL and the end portion disposed on the upstream side in the movement direction of the carriage 11 in the following recording pass of the second boundary area BP as the correcting portions AM respectively. Note that if the carriage 11 was not moved in the direction different from the movement direction of the carriage 11 in the first recording pass immediately before the first recording pass, then the air flow is not generated when the first recording pass is performed, and the formation positions of the respective dots in the first boundary area BL are the ideal formation positions subjected to the recording. Therefore, when the first boundary area BL is recorded by the first recording pass, if the carriage 11 is not moved immediately before the first recording pass, then the controller 50 does not set the end portion of the first boundary area BL as the correcting portion AM. The following explanation will be made assuming that the carriage 11 is moved in the direction different from the movement direction of the carriage 11 in the first recording pass for the sake of convenience of the explanation.

In this context, as described above, the deviation amount of the formation position of the dot caused by the influence of the air flow with respect to the ideal formation position is more increased on the more upstream side in the movement direction of the carriage 11 in the recording pass. Accordingly, the controller 50 more greatly increases the areal size of the correcting portion AM as the recording position of the first boundary area BL is positioned on the more upstream side in the movement direction of the carriage 11 in the recording pass when the first boundary area BL is recorded. Similarly, the controller 50 more greatly increases the areal size of the correcting portion AM as the recording position of the second boundary area BP is positioned on the more upstream side in the movement direction of the carriage 11 in the recording pass when the second boundary area BP is recorded. Accordingly, it is possible to make the deviation of the specified image SI more hardly conspicuous.

Specifically, in this embodiment, the size, which is set as the areal size of the correcting portion AM, has three levels, i.e., "large areal size", "small areal size", and "zero". The correcting portion AM, in which the size of the areal size is "large areal size", has a length in the scanning direction corresponding to 2 dots and a length in the conveyance direction corresponding to 3 dots. The correcting portion AM, in which the size of the areal size is "small areal size", has a length in the scanning direction corresponding to 1 dot and a length in the conveyance direction corresponding to 3 dots. In the case of the correcting portion AM in which the areal size is "zero", both of the length in the scanning direction and the length in the conveyance direction are zero. That is, the correction, in which the size of the discharge dot D is decreased, is not performed at the end portion in the scanning direction in which the correcting portion AM having the areal size of "zero" is set, in the first boundary area BL and the second boundary area BP.

Further, in this embodiment, the recording paper S is divided into three areas in the scanning direction, i.e., the left area, the middle area, and the right area. Then, as depicted in FIG. 17B, the controller 50 sets the areal size of the correcting portion AM set for the boundary area of the first boundary area BL and the second boundary area BP in which the recording is performed by the recording pass having the movement direction of the carriage 11 of the RVS direction, as "large areal size" when the recording position is disposed in the left area, "small areal size" when the recording position is disposed in the middle area, or "zero" when the recording position is disposed in the right area. On the other hand, the controller 50 sets the areal size of the correcting portion AM set for the boundary area of the first boundary area BL and the second boundary area BP in which the recording is performed by the recording pass having the movement direction of the carriage 11 of the FWD direction, as "large areal size" when the recording position is disposed in the right area, "small areal size" when the recording position is disposed in the middle area, or "zero" when the recording position is disposed in the left area.

On the other hand, if the recording mode of the recording process is the unidirectional recording mode, the controller 50 does not perform the correction with respect to the deviation of the specified image SI generated by the factor of the air flow as described above. However, when the recording is performed on the recording paper S by using the printer 1, as described above, the support state of the recording paper S, which is brought about by the roller pairs 13, 16, is changed in the period in which the recording paper S is conveyed in the conveyance direction in an order of (i) the state in which the recording paper S is nipped by the conveying roller pair 13 ("first conveying roller pair" of the present disclosure) and the recording paper S is not nipped by the discharge roller pair 16 ("second conveying roller pair" of the present disclosure), (ii) the state in which the recording paper S is nipped by both of the roller pairs 13, 16, and (iii) the state in which the recording paper S is not nipped by the conveying roller pair 13 and the recording paper S is nipped by the discharge roller pair 16.

Then, even in the case of the unidirectional recording mode, if the state of (i) described above is given in the preceding recording pass and the state of (ii) described above is given in the following recording pass, and if the state of (ii) described above is given in the preceding recording pass and the state of (iii) described above is given in the following recording pass, then the recording paper S is easily deviated in the scanning direction during the conveyance of the recording paper S in the conveying operation between the preceding recording pass and the following recording pass. Then, if the recording paper S is deviated in the scanning direction, the first boundary area BL of the specified image SI is deviated in the scanning direction with respect to the second boundary area BP.

In view of the above, even when the recording mode of the recording process is the unidirectional recording mode, if the support state of the recording paper S brought about by the roller pairs 13, 14 is changed between the preceding recording pass and the following recording pass, then the controller 50 sets the end portion disposed on one side in the scanning direction of the first boundary area BL and the end portion disposed on the other side in the scanning direction of the second boundary area BP as the correcting portions respectively. In this context, if the recording paper S is deviated in the following recording pass to the right in the scanning direction from the position provided in the preceding recording pass, then one side in the scanning direction is the right, and the other side in the scanning direction is the left. Further, if the recording paper S is deviated to the left in the scanning direction between the preceding recording pass and the following recording pass, then one side in the scanning direction is the left, and the other side in the scanning direction is the right.

In this context, when the recording paper S is conveyed, if the state is changed from the state of (i) to the state of (ii), or if the state is changed from the state of (ii) to the state of (iii), then the direction of the deviation of the recording paper S, which is selected from any one of the right and the left in the scanning direction, changes depending on the printer 1. However, the direction of the deviation of the recording paper S can be previously specified, for example, from an experiment. Accordingly, for example, the data on one side and the other side in the scanning direction is previously stored in a flash memory 54.

Further, in this situation, the areal size of the correcting portion may be the areal size corresponding to the degree of the deviation in the scanning direction of the recording paper S when the support state of the recording paper S brought about by the roller pairs 13, 14 is changed. For example, the areal size of the correcting portion is set as "small areal size" described above.

Further, when the recording mode of the recording process is the unidirectional recording mode, if the support state of the recording paper S brought about by the roller pairs 13, 16 is not changed between the preceding recording pass and the following recording pass, then the controller 50 does not correct the specified image data ESI in the image data correcting process.

Further, in the third embodiment as well, if the specified image SI is the text, the controller 50 performs the correction of the discharge amount as described above. If the specified image SI is any one other than the text, the controller 50 does not perform the correction of the discharge amount as described above.

Figure 18A:
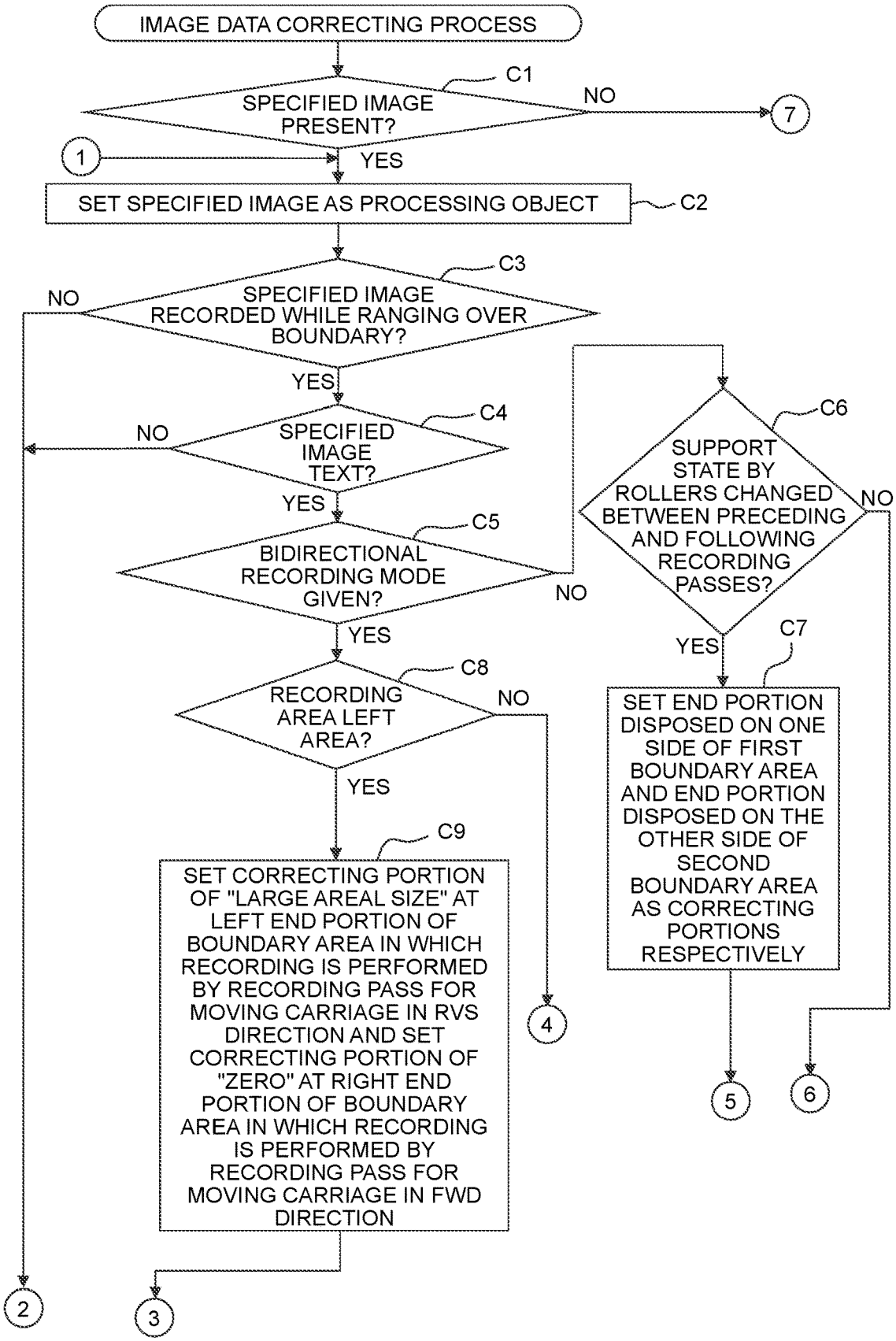
FIGS. 18A and 18B depict flow charts illustrating a flow of an image data correcting process according to the third embodiment.
Figure 18B:
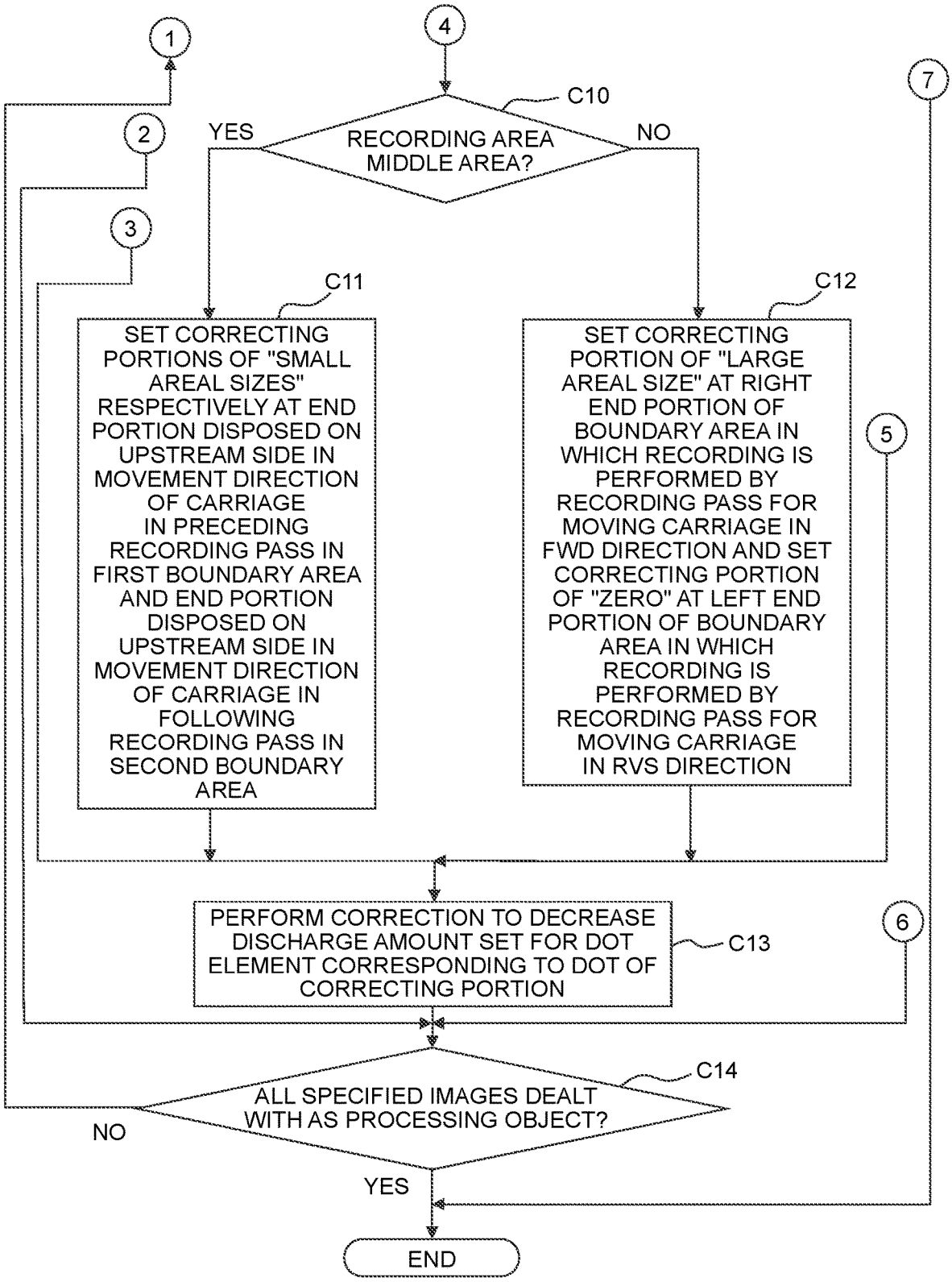

An explanation will be made below with reference to FIGS. 18A and 18B about a flow of the image data correcting process of the third embodiment.

The controller 50 executes the processes of C1 to C3 in the same manner as A1 to A3 described above. Then, if it is judged in the process of C3 that the specified image SI as the processing object is not recorded while ranging over the boundary between the first dot recording range KL and the second dot recording range KP (C3: NO), the controller 50 proceeds to the process of C14. On the other hand, if it is judged in the process of C3 that the specified image SI as the processing object is recorded while ranging over the boundary between the first dot recording range KL and the second dot recording range KP (C3: YES), the controller 50 judges whether or not the specified image SI as the processing object is the text (C4). If the specified image SI as the processing object is not the text (C4: NO), the controller 50 proceeds to the process of C14.

If the specified image SI as the processing object is the text (C4: YES), the controller 50 judges whether the recording mode, which is provided when the image is recorded, is the bidirectional recording mode or the unidirectional recording mode (C5). If it is judged that the recording mode is the unidirectional recording mode (C5: NO), the controller 50 judges whether or not the support state of the recording paper S, which is brought about by the roller pairs 13, 16, is changed between the preceding recording pass and the following recording pass (C6). If the support state of the recording paper S, which is brought about by the roller pairs 13, 16, is not changed (C6: NO), the controller 50 proceeds to the process of C14. If the support state of the recording paper S, which is brought about by the roller pairs 13, 16, is changed (C6: YES), then the controller 50 sets the end portion disposed on one side in the scanning direction of the first boundary area BL and the end portion disposed on the other side in the scanning direction of the second boundary area BP as the correcting portions respectively (C7), and the controller 50 proceeds to the process of C13.

If it is judged that the bidirectional recording mode is given (C5: Yes), the controller 50 judges whether or not the recording positions of the first boundary area BL and the second boundary area BP of the specified image SI as the processing object are disposed in the left area on the recording paper S (C8). If it is judged that the recording positions are disposed in the left area on the recording paper S (C8: YES), the controller 50 is operated as follows. That is, the correcting portion AM, in which the size of the areal size is "large areal size", is set at the left end portion of the boundary area recorded by the recording pass in which the movement direction of the carriage 11 is the RVS direction, of the first boundary area BL and the second boundary area BP, and the correcting portion AM, in which the size of the areal size is "zero", is set at the right end portion of the boundary area recorded by the recording pass in which the movement direction of the carriage 11 is the FWD direction (C9). If the process of C9 is terminated, the controller 50 proceeds to the process of C13.

Further, if the controller 50 judges in the process of C8 that the recording positions of the first boundary area BL and the second boundary area BP are not disposed in the left area on the recording paper S (C8: NO), the controller 50 judges whether the recording positions are disposed in the middle area or the right area on the recording paper S (C10). If it is judged that the recording positions are disposed in the middle area on the recording paper S (C10: YES), the controller 50 sets the correcting portions AM each having the size of the areal size of "small areal size" respectively at the end portion disposed on the upstream side in the movement direction of the carriage 11 in the preceding recording pass in the first boundary area BL and the end portion disposed on the upstream side in the movement direction of the carriage 11 in the following recording pass in the second boundary area BP (C11). If the process of C11 is terminated, the controller 50 proceeds to the process of C13.

If it is judged in the process of C10 that the recording positions of the first boundary area BL and the second boundary area BP are disposed in the right area on the recording paper S (C10: NO), then the controller 50 sets the correcting portion AM having the size of the areal size of "large areal size" at the right end portion of the boundary area recorded by the recording pass in which the movement direction of the carriage 11 is the FWD direction, of the first boundary area BL and the second boundary area BP, and the controller 50 sets the correcting portion AM having the size of the areal size of "zero" at the left end portion of the boundary area recorded by the recording pass in which the movement direction of the carriage 11 is the RVS direction. If the process of C12 is terminated, the controller 50 proceeds to the process of C13.

Then, the controller 50 executes the processes of C13 and C14 in the same manner as the processes of A12 and A13 described above.

Note that in the third embodiment, the correcting portion AM is set by at least one processes of C7, C9, C11, and C12 in the image data correcting process of S1. The discharge of the ink directed from the nozzle 10 toward the recording paper S in the recording pass based on the discharge process of S3, which is brought about when the correction is performed to decrease the discharge amount set for the dot element E corresponding to the discharge dot D belonging to the correcting portion AM in C13, corresponds to the "correcting discharge" of the present disclosure. Further, the discharge of the ink directed from the nozzle 10 toward the recording paper S in the recording pass based on the discharge process of S3, which is brought about when the correction is not performed in the image data correcting process of SI, corresponds to the "ordinary discharge" of the present disclosure.

Further, the condition that the specified image SI is the text corresponds to the "first condition" of the present disclosure. Further, the condition that the recording mode is the bidirectional recording mode corresponds to the "second condition" of the present disclosure. Then, the combination of the first condition and the second condition corresponds to the "predetermined condition" of the present disclosure.

Further, in the third embodiment, if the recording mode is the unidirectional recording mode, the predetermined condition (second condition) is not fulfilled. However, even in this case, if the support state of the recording paper S, which is brought about by the roller pairs 13, 16, is changed between the preceding recording pass and the following recording pass, the controller 50 performs the setting of the correcting portion AM of C7.

According to the third embodiment, when the specified image SI is the text and the recording mode is the bidirectional recording mode, even if the deviation appears in the specified image SI on account of the factor of the air flow, then it is possible to decrease the size of the discharge dot D formed at the corner portion. That is, it is possible to chamfer the corner portion of the deviation generated in the specified image SI. As a result, it is possible to make the deviation of the specified image SI hardly conspicuous. In a modified embodiment, all of the respective correcting portions AM may have the same areal size. In this case, it is possible to simplify the processing contents of the image data correcting process.

On the other hand, when the specified image SI is any one other than the text, and if the specified image SI is the text and the recording mode is the unidirectional recording mode, then the controller 50 does not perform the correction as described above, and thus it is possible to avoid the deterioration of the image quality of the image to be recorded.

However, even when the specified image SI is the text, and the recording mode is the unidirectional recording mode, if the support state of the recording paper S, which is brought about by the roller pairs 13, 16, is changed between the preceding recording pass and the following recording pass, then it is possible to decrease the size of the discharge dot D formed at the corner portion, even if the deviation appears in the specified image SI on account of the deviation in the scanning direction of the recording paper S between the preceding recording pass and the following recording pass.

Further, in the third embodiment as well, if the plurality of specified images SI are present, the controller 50 judges whether or not the correction as described above is performed individually for each of the plurality of specified images SI. Accordingly, it is possible for the controller 50 to appropriately decide whether or not the correction as described above is performed for each of the specified images SI.

Fourth Embodiment

Next, a fourth embodiment will be explained. As described above, when the specified image SI is recorded while ranging over the boundary between the first dot recording range KL and the second dot recording range KP, the first boundary area BL of the specified image SI is deviated in the scanning direction with respect to the second boundary area BP on account of various factors. However, the deviation direction, which is provided in this situation, differs depending on the factor. On this account, if a plurality of factors are assumed as the factors of the deviation in the scanning direction of the first boundary area BL with respect to the second boundary area BP, it is impossible in some cases for the controller 50 to judge in advance in what direction the first boundary area BL is deviated with respect to the second boundary area BP.

In view of the above, in the fourth embodiment, even if the first boundary area BL of the specified image SI is deviated in any direction of the scanning direction with respect to the second boundary area BP, the controller 50 performs the process to make the deviation generated in the specified image SI hardly conspicuous. That is, when the specified image SI is recorded while ranging over the boundary between the first dot recording range KL and the second dot recording range KP, the controller 50 sets the both end portions in the scanning direction of the first boundary area BL and the both end portions in the scanning direction of the second boundary area BP as the correcting portions AM respectively. However, in the fourth embodiment as well, the controller 50 performs the correction as described above if the specified image SI is the text. If the specified image SI is any one other than the text, the controller 50 does not perform the correction as described above.

Figure 19:
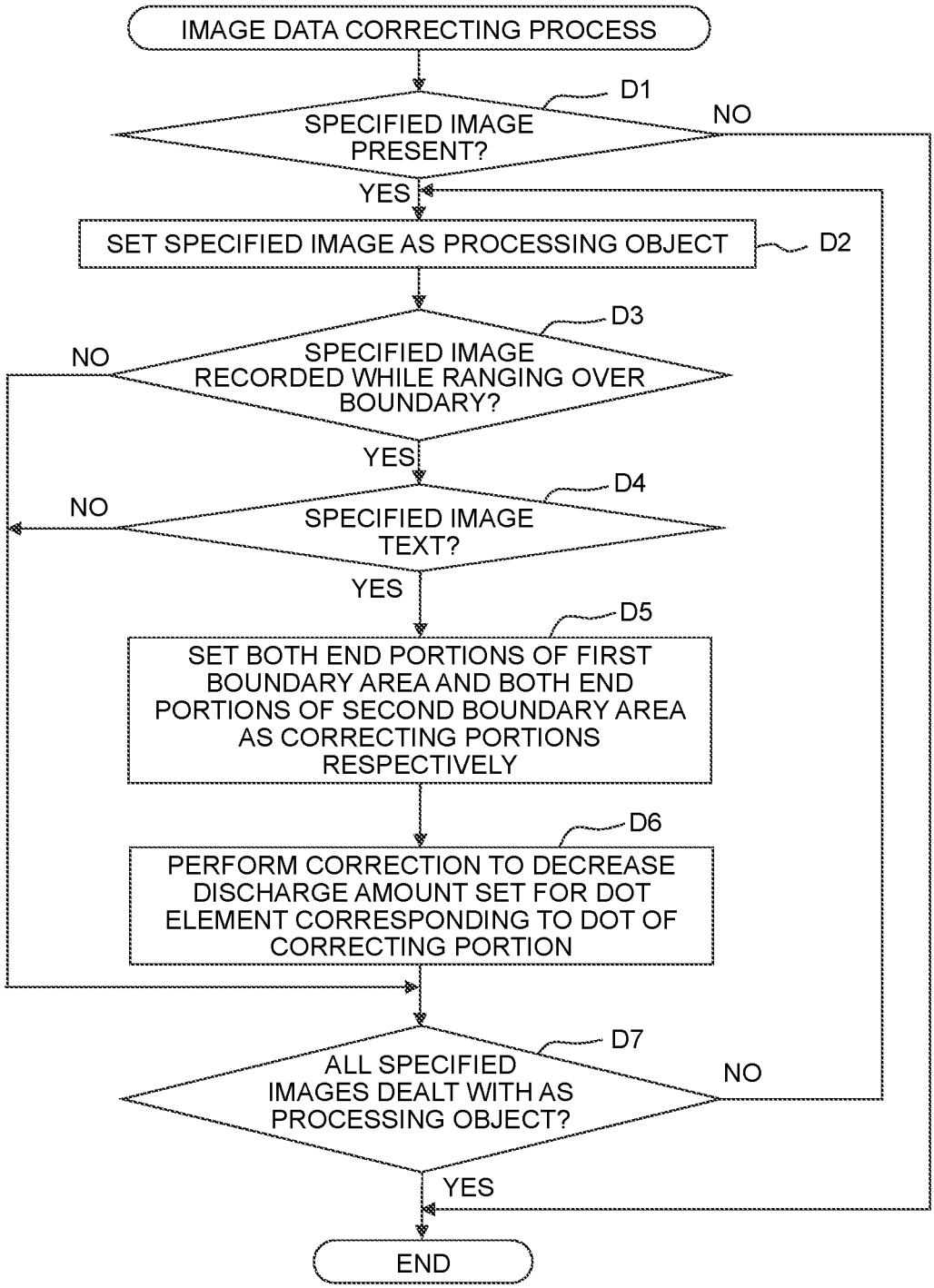
FIG. 19 depicts a flow chart illustrating a flow of an image data correcting process according to a fourth embodiment.

An explanation will be made below with reference to FIG. 19 about a flow of the image data correcting process of the fourth embodiment.

The controller 50 firstly executes the processes of D1 to D4 in the same manner as the processes of A1 to A4 described above. Then, if it is judged in the process of D4 that the specified image SI as the processing object is not the text (D4: NO), the controller 50 proceeds to the process of D7. If it is judged in the process of D4 that the specified image SI as the processing object is the text (D4: YES), then the controller 50 sets the both end portions in the scanning direction of the first boundary area BL of the specified image SI as the processing object and the both end portions in the scanning direction of the second boundary area BP as the correcting portions AM respectively (D5), and the controller 50 proceeds to the process of D6. The processes of D6 and D7 are the same as or equivalent to the processes of A12 and A13 described above.

Note that in the fourth embodiment, the correcting portion AM is set in accordance with the process of D5 in the image data correcting process of S1. The discharge of the ink directed from the nozzle 10 toward the recording paper S in the recording pass based on the discharge process of S3, which is brought about when the correction is performed to decrease the discharge amount set for the dot element E corresponding to the discharge dot D belonging to the correcting portion AM in C6, corresponds to the "correcting discharge" of the present disclosure. Further, the discharge of the ink directed from the nozzle 10 toward the recording paper S in the recording pass based on the discharge process of S3, which is brought about when the correction is not performed in the image data correcting process of SI, corresponds to the "ordinary discharge" of the present disclosure. Further, the condition that the specified image SI is the text corresponds to the "first condition" and the "predetermined condition" of the present disclosure.

As described above, according to the fourth embodiment, when the specified image SI is the text, even if the first boundary area BL of the specified image SI is deviated in any direction of the scanning direction with respect to the second boundary area BP, then the controller 50 can make the deviation of the specified image SI hardly conspicuous. Additionally, it is possible for the controller 50 to simplify the process contents of the image data correcting process. On the other hand, when the specified image SI is any one other than the text, then the correction as described above is not performed, and thus it is possible for the controller 50 to avoid the deterioration of the image quality of the image to be recorded.

Further, in the fourth embodiment as well, if the plurality of specified images SI are present, the controller 50 judges whether or not the correction as described above is performed individually for each of the plurality of specified images SI. Accordingly, it is possible for the controller 50 to appropriately decide whether or not the correction as described above is performed for each of the specified images SI.

Fifth Embodiment

Figure 20A:
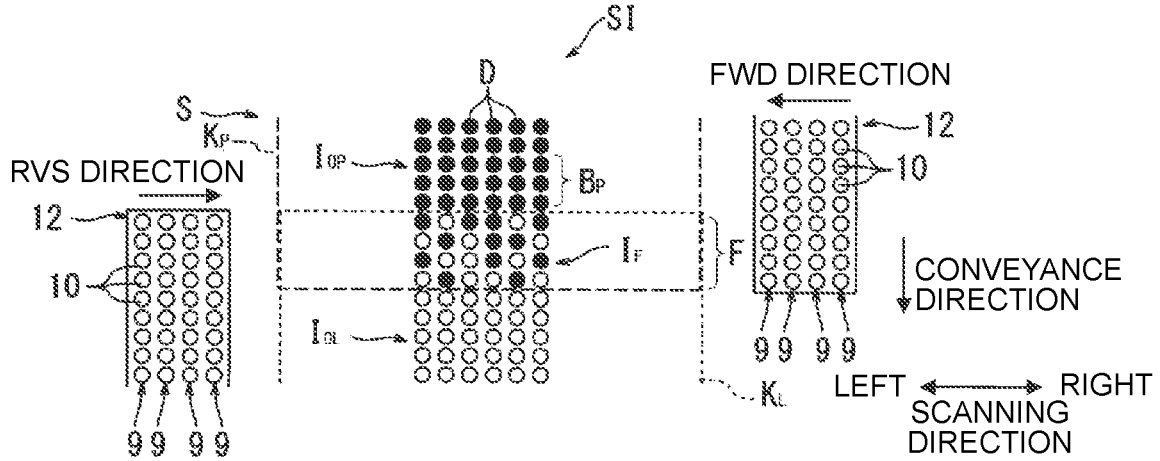
FIG. 20A depicts a specified image provided when no deviation occurs according to a fifth embodiment.

Next, a fifth embodiment will be explained. In the fifth embodiment, as depicted in FIG. 20A, the controller 50 conveys the recording paper S by a length which is shorter than the length Ln of the nozzle array 9 so that the first dot recording range KL of the preceding recording pass and the second dot recording range KP of the following recording pass are partially overlapped with each other in the conveying operation to be performed between the two times of the continuous recording passes. Then, the controller 50 records the image while being mutually complemented in the two times of the recording passes in the overlap area F in which the first dot recording range KL and the second dot recording range KP are partially overlapped with each other. That is, in the overlap area F, the controller 50 performs the recording in accordance with the so-called multiscan system in which the line image corresponding to one line composed of the plurality of dots in the scanning direction are recorded by means of two times of the continuous recording passes. In this procedure, the controller 50 records a thinned-out image in which different parts of the line image are thinned out on the basis of the mask data, by using the different nozzles 10 in the two times of the recording passes respectively.

Specifically, the controller 50 records the thinned-out image in the preceding recording pass on the basis of such image data that the image data IML (see FIG. 21), which corresponds to the first dot recording range KL of the preceding recording pass of the image data IM, is thinned out by using the first mask data. Further, the controller 50 records the thinned-out image in the following recording pass on the basis of such image data that the image data IMP (see FIG. 21), which corresponds to the second dot recording range KP of the following recording pass of the image data IM, is thinned out by using the second mask data that is in a complementary relationship with respect to the first mask data. Accordingly, the line image is completed in the overlap area F by mutually overlaying or superimposing the thinned-out images recorded in the two times of the continuous recording passes respectively. In this way, in the overlap area F, the image is recorded in accordance with the multiscan system. Accordingly, it is possible for the controller 50 to avoid the occurrence of the deterioration of the image quality such as the uneven density, the white stripe or the like extending in the scanning direction at the joint portion of the images of the two times of the continuous recording passes, which would be otherwise caused, for example, by the scattering of the conveyance amount of the recording paper S.

Figure 20B:
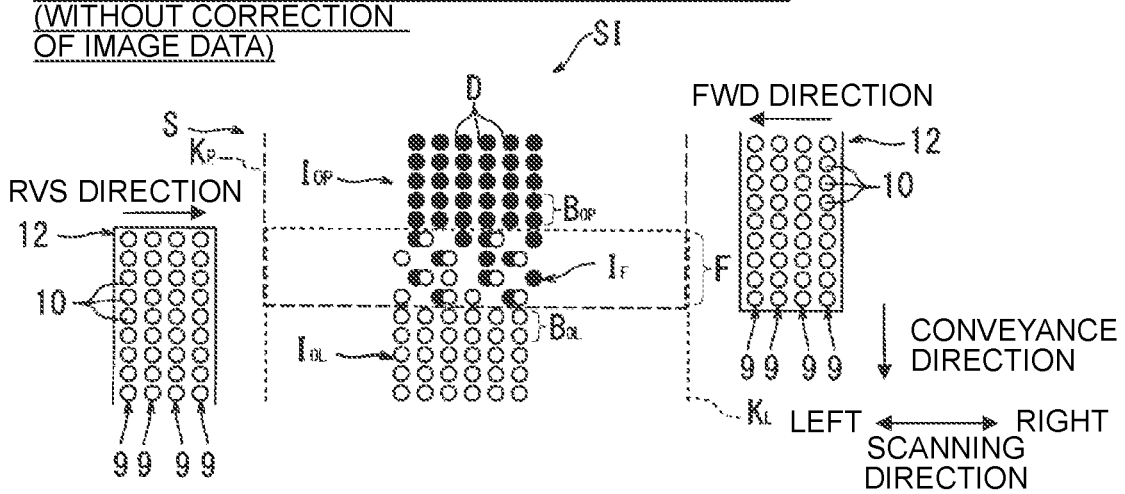
FIG. 20B depicts a specified image provided when the image data is not corrected.
Figure 20C:
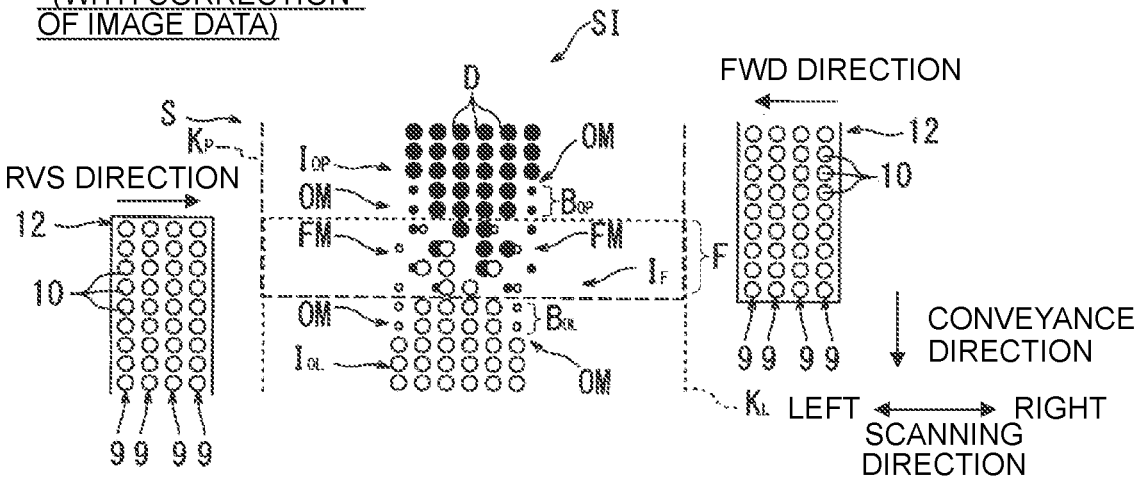
FIG. 20C depicts a specified image provided when the image data is corrected.

However, in this embodiment as well, as depicted in FIG. 20B, when the specified image SI is recorded while ranging over the overlap area F, the deviation occurs in the specified image SI on account of various factors. In view of the above, in this embodiment, as depicted in FIG. 20C, the controller 50 sets the both end portions in the scanning direction of the image area IF recorded on the overlap area F of the specified image SI as the correcting portions FM. The length in the conveyance direction of the correcting portion FM is equal to the length in the conveyance direction of the overlap area F. Note that in FIGS. 20B and 20C, for the sake of convenience, the discharge dots D, which are formed by the preceding recording pass, are depicted with white-painted circles, while the discharge dots D, which are formed by the following recording pass, are depicted with black-painted circles.

Further, in this embodiment, in order to make the deviation of the image more hardly conspicuous, the size of the areal size of the correcting portion FM is not changed between when the discharge dots D are formed in the preceding recording pass and when the discharge dots D are formed in the following recording pass, but the shape thereof is slightly changed. That is, as understood from FIG. 21 as well, the length in the scanning direction of the correcting portion FM is more lengthened at positions disposed on the more upstream side in the conveyance direction in the preceding recording pass. On the other hand, the length in the scanning direction of the correcting portion FM is more lengthened at positions disposed on the more downstream side in the conveyance direction in the following recording pass. Note that in FIG. 21, the correcting portions FM and the dot elements E corresponding to the dots belonging to the correcting portions OM are depicted while being hatched and painted out.

Additionally, the controller 50 also sets the correcting portions OM at the image area IOL recorded in the non-overlap area other than the overlap area F of the first dot recording range KL of the specified image SI and the image area IOP recorded in the non-overlap area other than the overlap area F of the second dot recording range KP. Specifically, the controller 50 sets the both end portions in the scanning direction of the boundary area BOL adjacent to the overlap area F in the image area IOL as the correcting portions OM. Further, the controller 50 sets the both end portions in the scanning direction of the boundary area BOP adjacent to the overlap area F in the image area IOP as the correcting portions OM. The areal size of the correcting portion OM is smaller than the areal size of the correcting portion FM.

Figure 21:
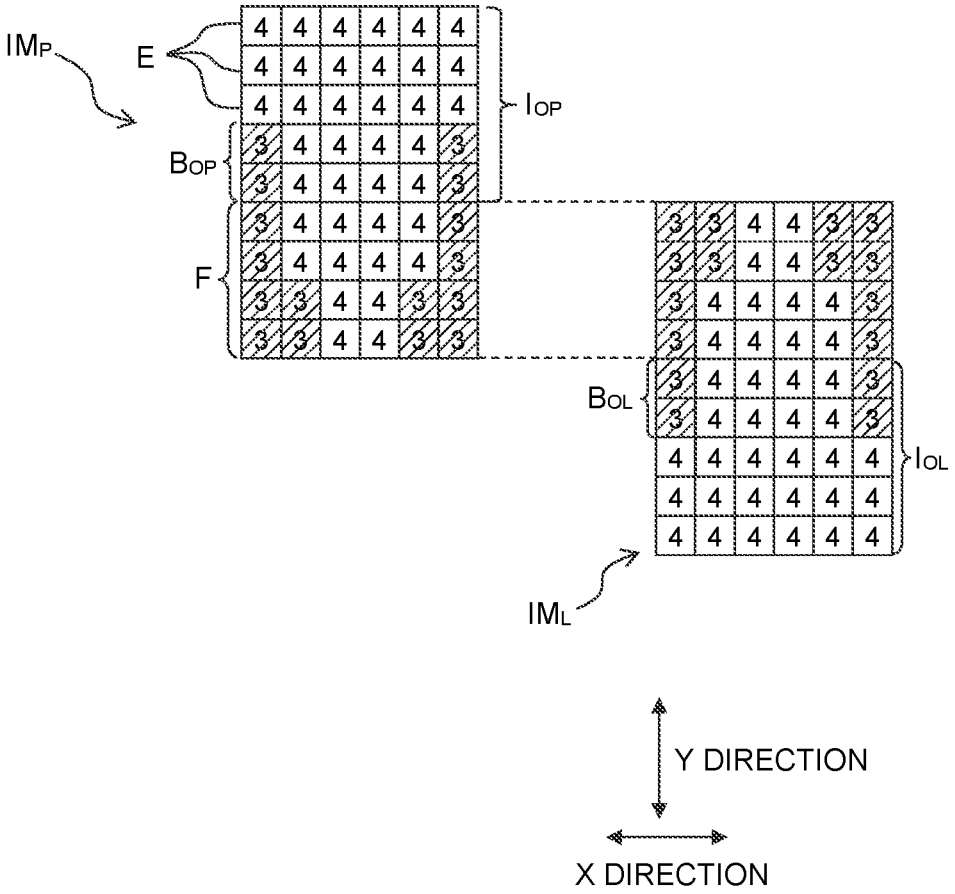
FIG. 21 explains an image data correcting process according to a fifth embodiment.

Then, as depicted in FIG. 21, the controller 50 performs the correction for the specified image data ESI so that the discharge amounts set for the dot elements E corresponding to the discharge dots D belonging to the correcting portion FM and the correcting portion OM are changed from "extra-large droplet" to "large droplet".

According to the above, in the fifth embodiment as well, when the specified image SI is the text, even if the deviation arises in the specified image SI, then it is possible for the controller 50 to decrease the size of the discharge dot D formed at the corner portion. That is, it is possible to chamfer the corner portion of the deviation generated in the specified image SI. As a result, it is possible to make the deviation of the specified image SI hardly conspicuous. On the other hand, when the specified image SI is any one other than the text, then the controller 50 does not perform the correction as described above, and thus it is possible to avoid the deterioration of the image quality of the image to be recorded.

Further, in the fifth embodiment as well, if the plurality of specified images SI are present, the controller 50 judges whether or not the correction as described above is performed individually for each of the plurality of specified images SI. Accordingly, it is possible for the controller 50 to appropriately decide whether or not the correction as described above is performed for each of the specified images SI.

Sixth Embodiment

Next, a sixth embodiment will be explained. The printers of the first to fifth embodiments are the so-called serial type printers in which the image is recorded on the recording paper S while moving the carriage 11 carried with the ink-jet head 12 in the scanning direction intersecting the conveyance direction of the recording paper S. However, a printer 200 of the sixth embodiment is a line type printer in which the image is recorded on the recording paper S conveyed by a conveying device (conveyer) 201 in a state in which an ink-jet head 222 is fixed.

Figure 22A:
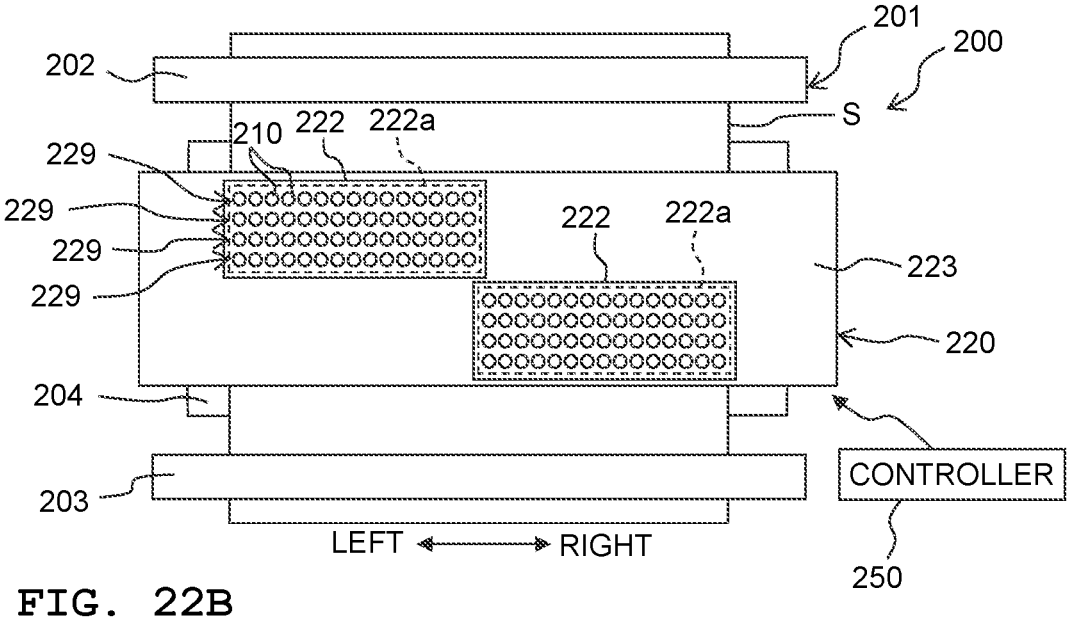
FIG. 22A depicts a plan view illustrating an ink-jet printer according to a sixth embodiment.

As depicted in FIG. 22A, the printer 200 is provided with the conveying device 201, a recording head unit 220 (corresponding to a head bar of the present disclosure), and a controller 250. The conveying device 201 has two conveying rollers 202, 203 and a platen 204.

The platen 204 supports, on an upper surface thereof, the recording paper S conveyed by the two conveying rollers 202, 203. The two conveying rollers 202, 203 are arranged respectively on the back side and the front side with respect to the platen 204. The two conveying rollers 202, 203 are driven respectively by a conveying motor (not depicted) to convey the recording paper S on the platen 204 in the conveyance direction orthogonal to the left-right direction.

The recording head unit 220 is arranged over or above the platen 204. Inks of four colors (black, yellow, cyan, and magenta) are supplied from unillustrated ink cartridges to the recording head unit 220. The recording head unit 220 is provided with two ink-jet heads 222 which are arranged while being aligned in the left-right direction. The two ink-jet heads 222 are retained by a support member 223 respectively.

The left ink-jet head 222, which is included in the two ink-jet heads 222, is arranged on the back side in the conveyance direction, and the right ink-jet head 222 is arranged on the front side. Further, the two ink-jet heads 222 (in particular, the central positions thereof in the left-right direction) are arranged at mutually different positions in the left-right direction. Additionally, the two respective ink-jet heads 222 are arranged so that arrangement areas 222, in which the nozzles 210 are arranged, are not overlapped with each other in the conveyance direction. That is, the arrangement areas 222*a* of the two ink-jet heads 222 are arranged at different positions in the left-right direction.

Each of the two ink-jet heads 222 has substantially the same structure as that of the ink-jet head 12 described above. A plurality of nozzles 210 are formed on an ink discharge surface of the lower surface of one ink-jet head 222. In particular, four nozzle arrays 229 are formed, in each of which the plurality of nozzles 210 are arranged in one array in the left-right direction. Further, the four nozzle arrays 229 are aligned in the conveyance direction. The inks of black, yellow, cyan, and magenta are discharged from the plurality of nozzles 210 in an order starting from those which form the nozzle array 229 disposed on the downstream side in the conveyance direction.

The controller 250 is constructed in approximately the same manner as the controller 50 described above. The controller 250 has, for example, RAM for storing the image data IM. Further, the controller 250 is operated as follows in the recording process in which the image concerning the image data IM is recorded on the recording paper S. That is, the dots are formed on the recording paper S by discharging the inks from the nozzles 210 of the two ink-jet heads 222 while conveying the recording paper S frontwardly with the conveying device 201.

Figure 22B:
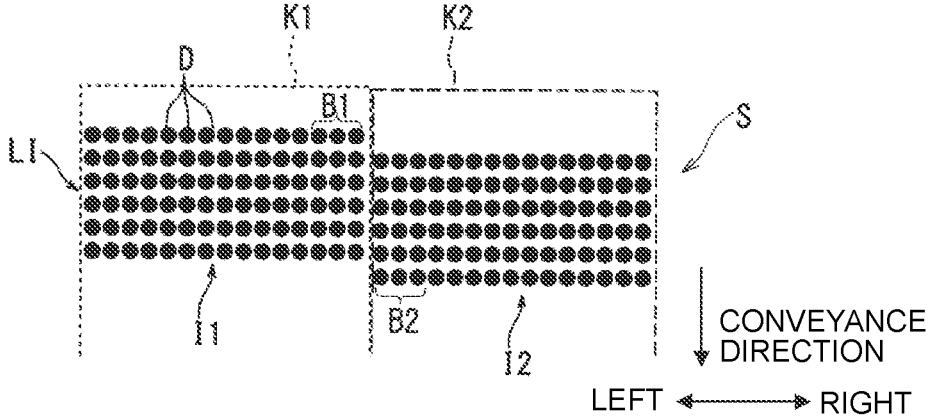
FIG. 22B depicts a specified image provided when the image data is not corrected.

Note that in this embodiment, as described above, the arrangement areas 222*a* of the two ink-jet heads 222 are not overlapped with each other in the conveyance direction. On this account, as depicted in FIG. 22B, a dot recording range K1 in which the dots are formed on the recording paper S by the left ink-jet head 222 and a dot recording range K2 in which the dots are formed by the right ink-jet head 222 are not overlapped with each other, and they are adjacent to one another in the left-right direction.

In the configuration described above, when the specified image LI is recorded while ranging over the boundary between the dot recording range K1 and the dot recording range K2, the deviation may appear in the specified image LI on account of any factor including, for example, the difference in the discharge characteristic between the two ink-jet heads 222 and the deviation of the assembling position. That is, the deviation is generated between the image area I1 recorded in the dot recording range K1 of the specified image LI and the image area I2 recorded in the dot recording range K2 of the specified image LI. In particular, the boundary area B1, which is adjacent to the dot recording range K2 in the image area I1, is deviated as a whole in the conveyance direction with respect to the boundary area B2 which is adjacent to the dot recording range K1 in the image area I2. Note that the specified image LI is composed of the plurality of discharge dots D, and the specified image LI has a width corresponding to a plurality of dots in each of the conveyance direction and the left-right direction. The specified image LI is exemplified, for example, by a line (for example, a line for constructing the text) which is interposed by the undischarge dots from the both sides in the conveyance direction, which has a width corresponding to a plurality of dots (for example, an amount of six dots) in the conveyance direction, and which extends in the left-right direction. Further, the length in the left-right direction of the boundary area B1 is shorter than the length in the left-right direction of the dot recording range K1. Similarly, the length in the left-right direction of the boundary area B2 is shorter than the length in the left-right direction of the dot recording range K2.

The controller 250 performs the image data correcting process for correcting the image data IM as a countermeasure against the deviation of the specified image LI. Note that in the first to fourth embodiments described above, the deviation of the image, which is generated at the joint portion of the dot recording ranges of the two times of the continuous recording passes, is referred to as the problem. In this embodiment, the deviation of the image, which is generated at the joint portion of the dot recording ranges of the two ink-jet heads, is referred to as the problem. Although the deviation of the image as the target differs, the countermeasure thereagainst is basically unchanged.

Figure 22C:
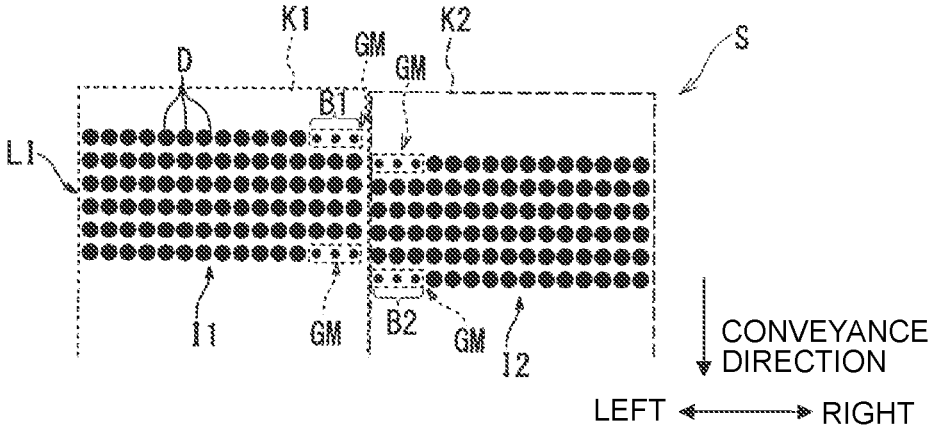
FIG. 22C depicts a specified image provided when the image data is corrected.

In this embodiment, in order to make the deviation of the specified image LI hardly conspicuous even when the boundary area B1 is deviated to any one of the upstream side and the downstream side in the conveyance direction with respect to the boundary area B2, as depicted in FIG. 22C, the controller 250 sets the both end portions in the conveyance direction of the boundary area B1 and the both end portions in the conveyance direction of the boundary area B2 as the correcting portions GM respectively. As for the correcting portion GM, the length in the conveyance direction is shorter than the length in the left-right direction. Then, the controller 250 performs the correction for the image data IM to decrease the discharge amount set for the dot element E corresponding to the discharge dot D belonging to the correcting portion GM.

In this case, in the sixth embodiment, when the correcting portion GM is set as described above, if the correction is performed to decrease the discharge amount set for the dot element E corresponding to the discharge dot D belonging to the correcting portion GM, then the density of the correcting portion GM is thinned as compared with if the correction is not performed. On the other hand, when the specified image LI is the text, the duty is low in the area which is adjacent in the conveyance direction to the correcting portion GM. Therefore, the thinned density of the correcting portion GM is hardly conspicuous in the same manner as explained in the first embodiment. On the contrary, when the specified image LI is any one such as a picture, a photograph or the like other than the text, then the duty is high in the area which is adjacent in the conveyance direction to the correcting portion GM, and the correcting portion GM and the portion having the high duty are aligned adjacently in the conveyance direction. Therefore, the thinned density of the correcting portion GM is easily conspicuous due to the difference in the density between these portions. Then, in this case, it is feared that the image quality of the image to be recorded may be conversely deteriorated by performing the correction as described above.

Accordingly, in the sixth embodiment, if the specified image LI is the text, the controller 250 performs the correction as described above. If the specified image LI is any one other than the text, the controller 250 does not perform the correction as described above. Note that in the sixth embodiment, the condition that the specified image LI is the text corresponds to the "predetermined condition" of the present disclosure.

Then, in the sixth embodiment, when the specified image LI is the text, if the image is recorded on the recording paper S in accordance with the image data IM corrected as described above, then it is possible for the controller 250 to decrease the size of the discharge dot D formed at the corner portion even when the deviation occurs in the specified image LI. That is, it is possible to chamfer the corner portion of the deviation generated in the specified image LI. As a result, it is possible to make the deviation of the specified image LI hardly conspicuous. On the other hand, when the specified image LI is any one other than the text, then the controller 250 does not perform the correction as described above, and thus it is possible to avoid the deterioration of the image quality of the image to be recorded.

Seventh Embodiment

Figure 23A:
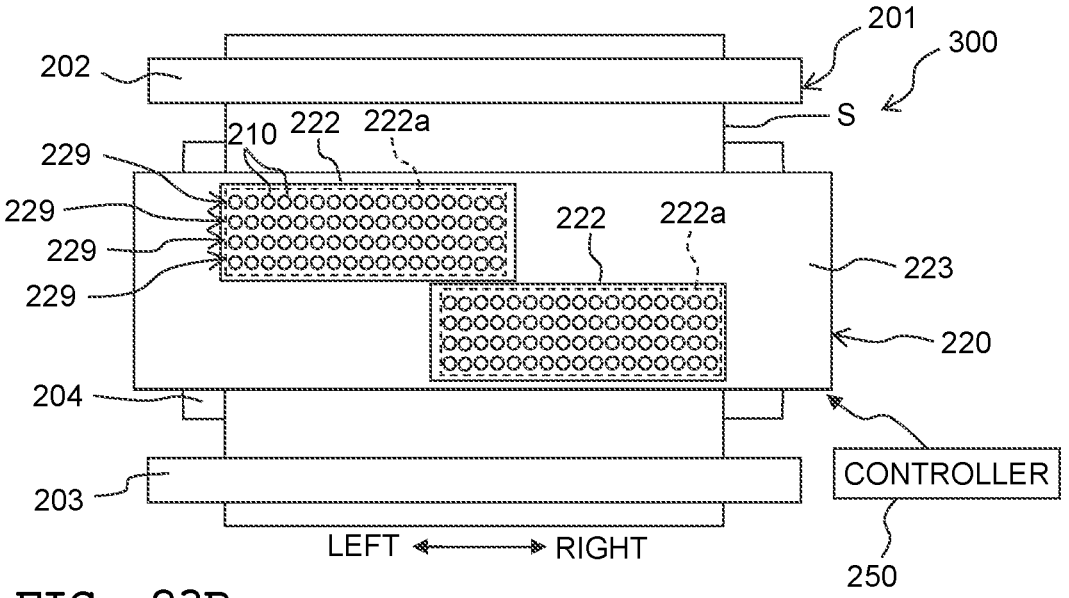
FIG. 23A depicts a plan view illustrating an ink-jet printer according to a seventh embodiment.
Figure 23B:
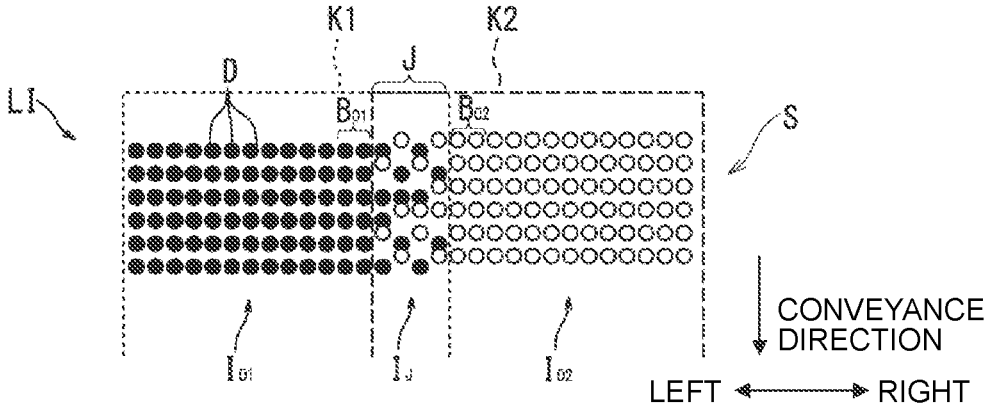
FIG. 23B depicts a specified image provided when the image data is not corrected.

Next, a seventh embodiment will be explained. A printer 300 of the seventh embodiment is a line printer in the same manner as the printer 200 of the sixth embodiment. However, in the case of the printer 300 of the seventh embodiment, as depicted in FIG. 23A, arrangement areas of two ink-jet heads 222 are arranged so that they are partially overlapped with each other in the conveyance direction. On this account, as depicted in FIG. 23B, a dot recording range K1 in which the dots are formed by the left ink-jet head 222 and a dot recording range K2 in which the dots are formed by the right ink-jet head are partially overlapped with each other on the recording paper S. Then, the controller 250 records the image with the two ink-jet heads 222 while being mutually complemented in an overlap area J in which the dot recording range K1 and the dot recording range K2 are overlapped with each other. That is, in the overlap area J, thinned-out images, in which different parts of a line image are thinned out on the basis of the mask data, are recorded with the two ink-jet heads 222 respectively for the line image corresponding to one line composed of a plurality of dots disposed in the conveyance direction. Accordingly, the thinned-out images, which are recorded with the two ink-jet heads 222 respectively, are mutually overlaid or superimposed in the overlap area J, and thus the line image is completed. In this way, in the overlap area J, the image is recorded with the two ink-jet heads 222. Accordingly, it is possible to avoid the occurrence of the deterioration the image quality such as the uneven density, the white stripe or the like extending in the conveyance direction at the joint portion of the images of the two ink-jet heads 222, which would be otherwise caused, for example, by the assembling error of the ink-jet heads 222. Note that in FIGS. 23B and 23C, for the sake of convenience, the discharge dots D, which are formed by the left ink-jet head 222, are depicted with black-painted circles, while the discharge dots D, which are formed by the right ink-jet head 222, are depicted with white-painted circles.

In the configuration described above, when the specified image LI is recorded while ranging over the overlap area J, the deviation may appear in the specified image LI on account of the factors of, for example, the difference in the ink discharge characteristic and the deviation of the assembling position between the two ink-jet heads 222. In view of the above, the controller 250 performs the image data correcting process for correcting the image data IM as a countermeasure against the deviation of the specified image LI. Note that in the fifth embodiment described above, the deviation of the image, which is generated in the overlap area F of the dot recording ranges of the two times of the continuous recording passes, is referred to as the problem. In this embodiment, the deviation of the image, which is generated in the overlap area J of the two ink-jet heads, is referred to as the problem. Although the deviation of the image as the target differs, the countermeasure thereagainst is basically unchanged.

Figure 23C:
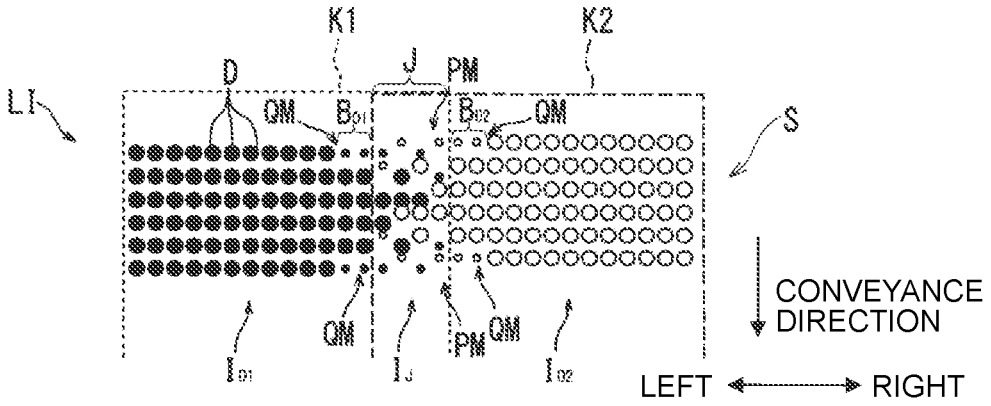
FIG. 23C depicts a specified image provided when the image data is corrected.

In this embodiment, as depicted in FIG. 23C, the controller 250 sets the both end portions in the conveyance direction of the image area IJ recorded in the overlap area J of the specified image LI as the correcting portions PM. The length in the left-right direction of the correcting portion PM is equal to the length in the left-right direction of the overlap area J.

Further, in this embodiment, the controller 250 does not change the size of the areal size of the correcting portion PM, but the controller 250 slightly changes the shape between when the discharge dots D are formed by the left ink-jet head 222 and when the discharge dots D are formed by the right ink-jet head 222. That is, in the case of the left ink-jet head 222, the controller 250 lengthens the length in the conveyance direction of the correcting portion PM at positions disposed more rightwardly. On the other hand, in the case of the right ink-jet head 222, the controller 250 lengthens the length in the conveyance direction of the correcting portion PM at positions disposed more leftwardly.

Additionally, the controller 250 also sets the correcting portions QM for the specified image LI at an image area I01 recorded in the non-overlap area other than the overlap area J of the dot recording range K1 and an image area I02 recorded in the non-overlap area other than the overlap area J of the dot recording range K2. Specifically, the controller 250 sets the both end portions in the conveyance direction of the boundary area B01 adjacent to the overlap area J in the image area I01 as the correcting portions QM. Further, the controller 250 sets the both end portions in the conveyance direction of the boundary area B02 adjacent to the overlap area J in the image area I02 as the correcting portions QM. The areal size of the correcting portion QM is smaller than the areal size of the correcting portion PM.

Then, the controller 250 performs the correction to decrease the discharge amounts set for the dot elements E corresponding to the discharge dots D belonging to the correcting portion PM and the correcting portion QM in the image data IM.

However, also in the seventh embodiment, if the specified image LI is the text, the controller 250 performs the correction of the discharge amount as described above. If the specified image LI is any one other than the text, the controller does not perform the correction of the discharge amount as described above.

Then, in the seventh embodiment, when the specified image LI is the text, if the image is recorded on the recording paper S in accordance with the image data IM corrected as described above, then it is possible to decrease the size of the discharge dot D formed at the corner portion even when the deviation arises in the specified image LI. That is, it is possible to chamfer the corner portion of the deviation generated in the specified image LI. As a result, it is possible to make the deviation of the specified image LI hardly conspicuous. On the other hand, when the specified image LI is any one other than the text, then the correction as described above is not performed, and thus it is possible to avoid the deterioration of the image quality of the image to be recorded.

Eighth Embodiment

Next, an eighth embodiment will be explained. The printer of the eighth embodiment is a serial type printer 1 in the same manner as the first embodiment. However, the discharge amount of the ink, which can be discharged from the nozzle 10 in one discharge cycle, includes "super-extra-large droplet" in addition to the five types of "extra-large droplet", "large droplet", "middle droplet", "small droplet", and "undischarge". The "super-extra-large droplet" has a discharge amount which is an amount larger than that of the "extra-large droplet". The controller 50 drives the actuator of the ink-jet head 12 so that at least one of the number of liquid droplets discharged from the nozzle 10 in one discharge cycle and the liquid droplet amount (volume) of one liquid droplet is larger than that of the "extra-large droplet". Thus, it is possible to discharge the ink of the "super-extra-large droplet" from the nozzle 10.

Figure 24A:
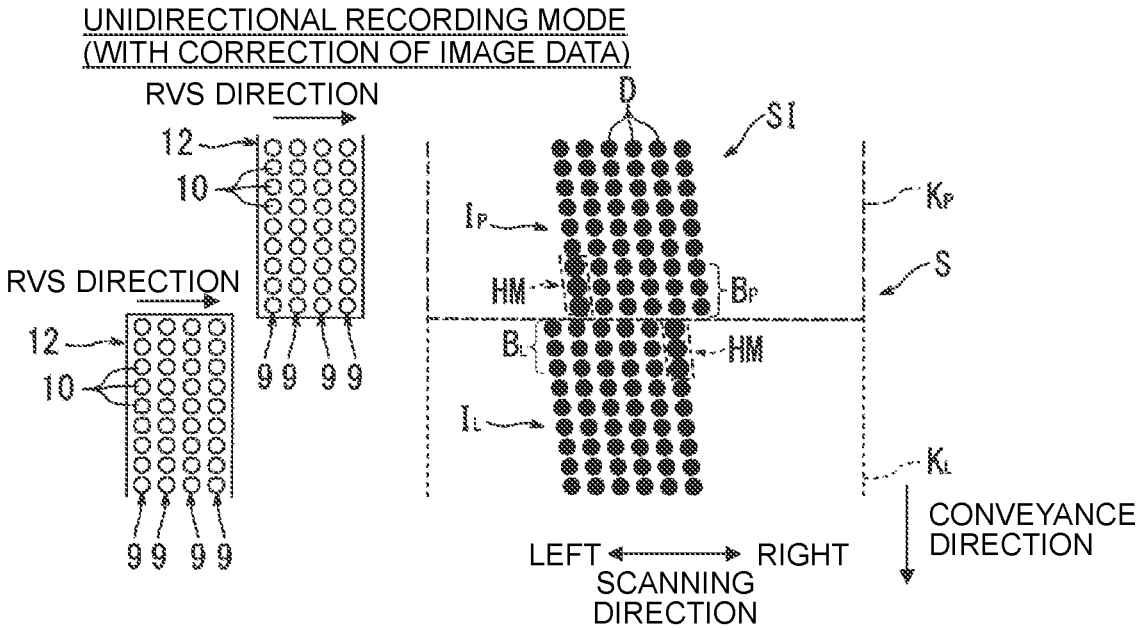
FIG. 24A depicts a specified image provided when the image data is corrected according to an eighth embodiment.

Further, in the eighth embodiment, the processing contents of the image data correcting process performed by the controller 50 are different from those of the first embodiment described above. In particular, in the first embodiment described above, for example, if it is assumed that the first boundary area BL is deviated leftwardly as a whole with respect to the second boundary area BP, the controller 50 sets the left end portion of the first boundary area BL and the right end portion of the second boundary area BP as the correcting portions AM respectively as depicted in FIG. 10A. On the other hand, in the eighth embodiment, if it is assumed that the first boundary area BL is deviated leftwardly as a whole with respect to the second boundary area BP, the controller 50 sets the right end portion of the first boundary area BL and the left end portion of the second boundary area BP as the correcting portions HM respectively as depicted in FIG. 24A. Similarly, if it is assumed that the first boundary area BL is deviated rightwardly as a whole with respect to the second boundary area BP, the controller 50 sets the left end portion of the first boundary area BL and the right end portion of the second boundary area BP as the correcting portions HM respectively. The shape of the correcting portion HM is set, in the same manner as the correcting portion AM described above, for example, as a rectangular shape in which the length in the scanning direction is a length corresponding to one dot and the length in the conveyance direction is a length corresponding to three dots, if the specified image SI is a line having a width corresponding to six dots in the scanning direction.

Then, in the eighth embodiment, the controller 50 performs the correction to increase the discharge amount set for the dot element E corresponding to the discharge dot D belonging to the correcting portion HM in relation to the specified image data ESI. Specifically, the controller 50 performs the correction so that the discharge amount set for the dot element E corresponding to the discharge dot D belonging to the correcting portion HM is changed from "extra-large droplet" to "super-extra-large droplet".

When the image is recorded on the recording paper S in accordance with the image data IM corrected as described above, it is possible to increase the sizes of the discharge dots D belonging to the correcting portions HM of the first boundary area BL and the second boundary area BP as depicted in FIG. 24A. As a result, even when the deviation arises in the specified image SI, it is possible to decrease the deviation of the specified image SI. Accordingly, it is possible to make the deviation of the specified image SI hardly conspicuous.

In this case, when the correcting portion HM is set as described above, and the correction is performed to increase the discharge amount set for the dot element E corresponding to the discharge dot D belonging to the correcting portion HM, then the density of the correcting portion HM is thickened as compared with when the correction is not performed.

On the other hand, when the specified image SI is the text, then there are many blanks (dots in which the discharge amount set for the dot element E is zero (undischarge)) around the specified image SI as described above, and the duty is low in the area which is adjacent in the scanning direction to the correcting portion HM. Then, in this case, the correcting portion HM is adjacent in the scanning direction to the area in which the duty is low. Therefore, the thick density of the correcting portion HM is hardly conspicuous.

Figure 25:
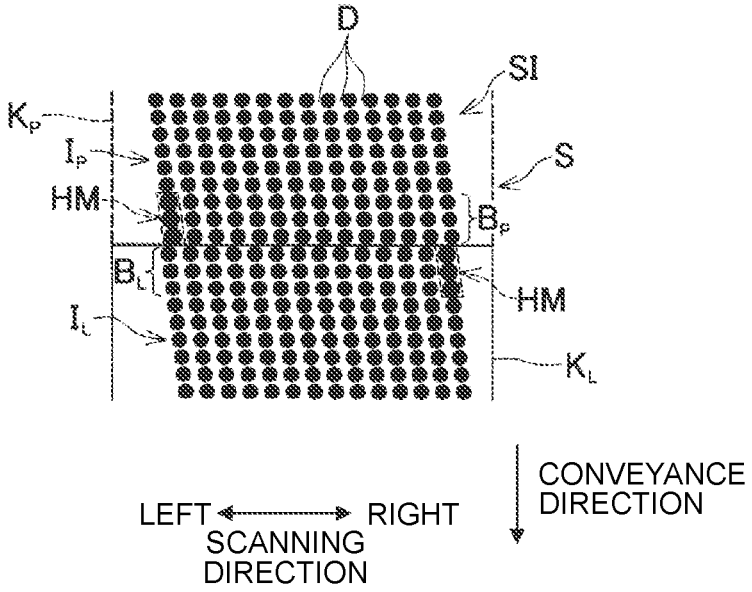
FIG. 25 depicts a dot arrangement provided when the duty is high in an area adjacent in the conveyance direction of a correcting portion, the drawing corresponding to FIG. 24A.

On the contrary, if the specified image SI is any one such as a picture, a photograph or the like other than the text, the duty is high in the area which is adjacent in the scanning direction to the correcting portion HM as depicted in FIG. 25. In this context, FIG. 25 depicts an exemplary arrangement of the dots corresponding to FIG. 24A when the specified image SI is any one such as a picture, a photograph or the like other than the text. Then, in this case, the correcting portion HM in which the density is thickened and the portion in which the duty is high are aligned while being adjacent to one another in the scanning direction. Therefore, the thickened density of the correcting portion HM is easily conspicuous on account of the difference in the density between these portions. Then, in this case, it is feared that the image quality of the image to be recorded may be conversely lowered as a result of the execution of the correction as described above.

In view of the above, in the eighth embodiment, if the specified image SI is the text, the controller 50 performs the correction as described above. If the specified image SI is any one other than the text, the controller 50 does not perform the correction of the discharge amount as described above.

In this way, according to the eighth embodiment, when the specified image SI is the text, even if the deviation appears in the specified image SI on account of the factor of the difference between the upstream and the downstream in the conveyance direction of the gap, the fluctuation of the gap at the peak portion of the recording paper S, or the attitude change of the carriage 11 caused by the reaction force of the supply tube 27, then the controller 50 increases the sizes of the discharge dots D formed at the corner portions, and thus it is possible to make the deviation of the specified image SI hardly conspicuous. On the other hand, when the specified image SI is any one other than the text, then the controller 50 does not perform the correction as described above, and thus it is possible to avoid the deterioration of the image quality of the image to be recorded.

Further, in the eighth embodiment, if the plurality of specified images SI are present, the controller 50 judges whether or not the correction as described above is performed individually for each of the plurality of specified images SI. Accordingly, it is possible for the controller 50 to appropriately decide whether or not the correction as described above is performed for each of the specified images SI.

Ninth Embodiment

Figure 24B:
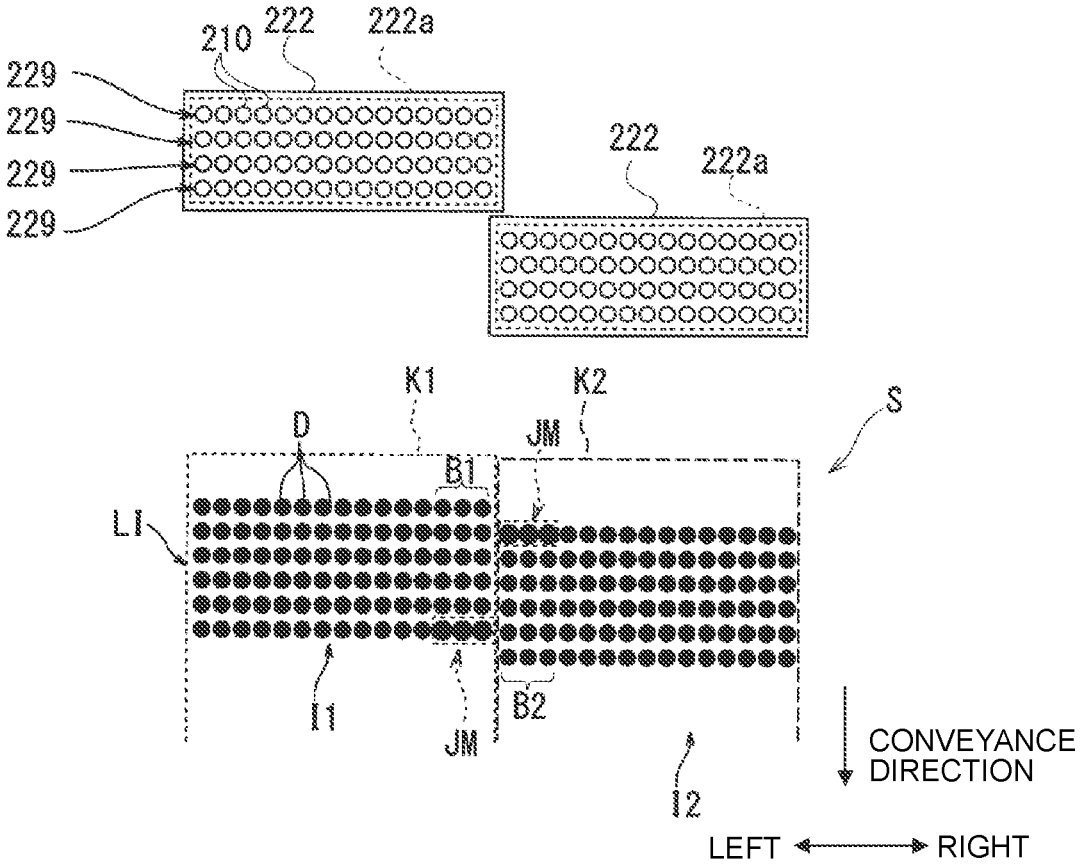
FIG. 24B depicts a specified image provided when the image data is corrected according to a ninth embodiment.

Next, a ninth embodiment will be explained. In the ninth embodiment, the discharge amount of the ink, which can be discharged from the nozzle 10 in one discharge cycle, includes "super-extra-large droplet" in addition to the five types of "extra-large droplet", "large droplet", "middle droplet", "small droplet", and "undischarge" in the same manner as the eighth embodiment. Further, the printer of the ninth embodiment is a line type printer 200 in the same manner as the sixth embodiment. Therefore, as depicted in FIG. 24B, the dot recording range K1 in which the dots are formed by the left ink-jet head 222 and the dot recording range K2 in which the dots are formed by the right ink-jet head 222 are not overlapped with each other, but they are adjacent to one another in the left-right direction. Then, when the specified image LI is recorded while ranging over the boundary between the dot recording range K1 and the dot recording range K2, the deviation may appear in the specified image LI.

The controller 250 performs the image data correcting process for correcting the image data IM as a countermeasure against the deviation of the specified image LI. Note that in the eighth embodiment described above, the deviation of the image, which is generated at the joint portion of the dot recording ranges of the two times of the continuous recording passes, is referred to as the problem. In this embodiment, the deviation of the image, which is generated at the joint portion of the dot recording ranges of the two ink-jet heads, is referred to as the problem. Although the deviation of the image as the target differs, the countermeasure thereagainst is basically unchanged.

Specifically, if it is assumed that the boundary area B1 is deviated as a whole to the upstream side in the conveyance direction with respect to the boundary area B2, the controller 250 sets the end portion disposed on the downstream side in the conveyance direction of the boundary area B1 and the end portion disposed on the upstream side in the conveyance direction of the boundary area B2 as the correcting portions JM respectively as depicted in FIG. 24B. Similarly, if it is assumed that the boundary area B1 is deviated as a whole to the downstream side in the conveyance direction with respect to the boundary area B2, the controller 250 sets the end portion disposed on the upstream side in the conveyance direction of the boundary area B1 and the end portion disposed on the downstream side in the conveyance direction of the boundary area B2 as the correcting portions JM respectively.

Then, in the ninth embodiment, the controller 250 performs the correction to increase the discharge amount set for the dot element E corresponding to the discharge dot D belonging to the correcting portion JM in relation to the specified image data ESI. Specifically, the controller 250 performs the correction so that the discharge amount set for the dot element E corresponding to the discharge dot D belonging to the correcting portion JM is changed from "extra-large droplet" to "super-extra-large droplet".

When the image is recorded on the recording paper S in accordance with the image data IM corrected as described above, it is possible to increase the sizes of the discharge dots D belonging to the correcting portions JM of the boundary area B1 and the boundary area B2 as depicted in FIG. 24B. As a result, even when the deviation appears in the specified image LI, it is possible to decrease the deviation of the specified image LI. Accordingly, it is possible to make the deviation of the specified image LI hardly conspicuous.

In this case, in the ninth embodiment, when the correcting portion JM is set as described above, if the correction is performed to increase the discharge amount set for the dot element E corresponding to the discharge dot D belonging to the correcting portion JM, then the density of the correcting portion JM is thickened as compared with if the correction is not performed. Then, when the specified image LI is the text, the duty is low in the portion which is adjacent in the conveyance direction to the correcting portion JM. Therefore, the thickened density of the correcting portion JM is hardly conspicuous in the same manner as explained in the eighth embodiment. On the other hand, when the specified image LI is any one such as a picture, a photograph or the like other than the text, then the duty is high in the area which is adjacent in the conveyance direction to the correcting portion JM, and the correcting portion JM having the thickened density and the portion having the high duty are aligned adjacently in the conveyance direction. Therefore, the thickened density of the correcting portion JM is easily conspicuous due to the difference in the density between these portions. Then, in this case, it is feared that the image quality of the image to be recorded may be conversely deteriorated by performing the correction as described above.

In view of the above, in the ninth embodiment, if the specified image LI is the text, then the controller 250 sets the correcting portion JM as described above, and the controller 250 performs the correction to decrease the discharge amount set for the dot element E corresponding to the discharge dot D belonging to the correcting portion JM. On the other hand, if the specified image LI is any one other than the text, the correction of the discharge amount as described above is not performed.

As described above, according to the ninth embodiment, when the specified image LI is the text, the image is recorded on the recording paper S in accordance with the image data IM corrected as described above. By doing so, even if the deviation appears in the specified image LI, then the sizes of the discharge dots D formed at the corner portions are increased, and thus it is possible to make the deviation of the specified image LI hardly conspicuous. On the other hand, when the specified image LI is any one other than the text, then the correction as described above is not performed, and thus it is possible to avoid the deterioration of the image quality of the image to be recorded.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

At first, a modified embodiment of the first embodiment will be explained with reference to FIG. 26A. In this modified embodiment, the discharge amount of the ink, which can be discharged from the nozzle 10 in one discharge cycle, includes "super-extra-large droplet" in addition to the five types of "extra-large droplet", "large droplet", "middle droplet", "small droplet", and "undischarge" described above in the same manner as the eighth embodiment described above. Then, if the end portion, which is included in the end portions in the scanning direction of the second boundary area BP and which is disposed on the same side in the scanning direction as that of the end portion at which the correcting portion AM is set in the first boundary area BL, is not set as the correcting portion AM, the controller 50 sets the end portion as the specified end portion XM in the image data correcting process. Similarly, if the end portion, which is included in the end portions in the scanning direction of the first boundary area BL and which is disposed on the same side in the scanning direction as that of the end portion at which the correcting portion AM is set in the second boundary area BP, is not set as the correcting portion AM, the controller 50 sets the end portion as the specified end portion XM. In the example depicted in FIG. 26A, the left end portion of the first boundary area BL is set as the correcting portion AM, and the left end portion of the second boundary area BP is not set as the correcting portion AM. Therefore, the controller 50 sets the left end portion of the second boundary area BP as the specified end portion XM. Further, the right end portion of the second boundary area BP is set as the correcting portion AM, and the right end portion of the first boundary area BL is not set as the correcting portion AM. Therefore, the controller 50 sets the right end portion of the first boundary area BL as the specified end portion XM.

Then, the controller 50 also performs the correction such that the discharge amount, which is set for the dot element E corresponding to the discharge dot D belonging to the specified end portion XM in the specified image data ESI, is changed from "extra-large droplet" to "super-extra-large droplet".

Figure 26A:
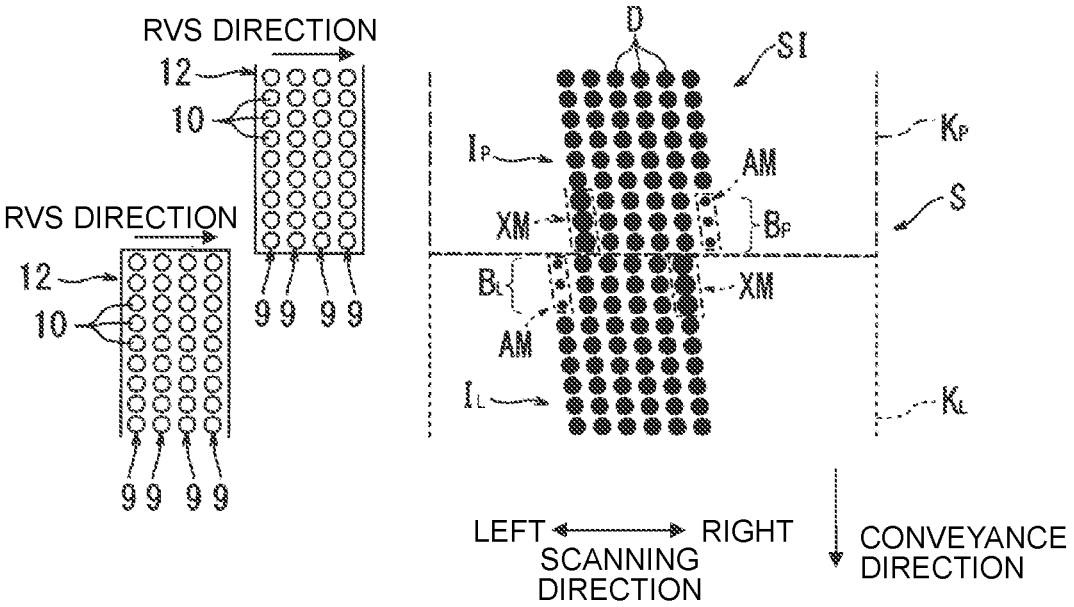
FIG. 26A depicts a specified image provided when the image data is corrected according to a modified embodiment of the first embodiment.

When the image is recorded on the recording paper S in accordance with the image data IM corrected as described above, it is possible to increase the sizes of the discharge dots D belonging to the specified end portions XM of the first boundary area BL and the second boundary area BP as depicted in FIG. 26A. As a result, it is possible to make the deviation of the specified image SI more hardly conspicuous.

Figure 26B:
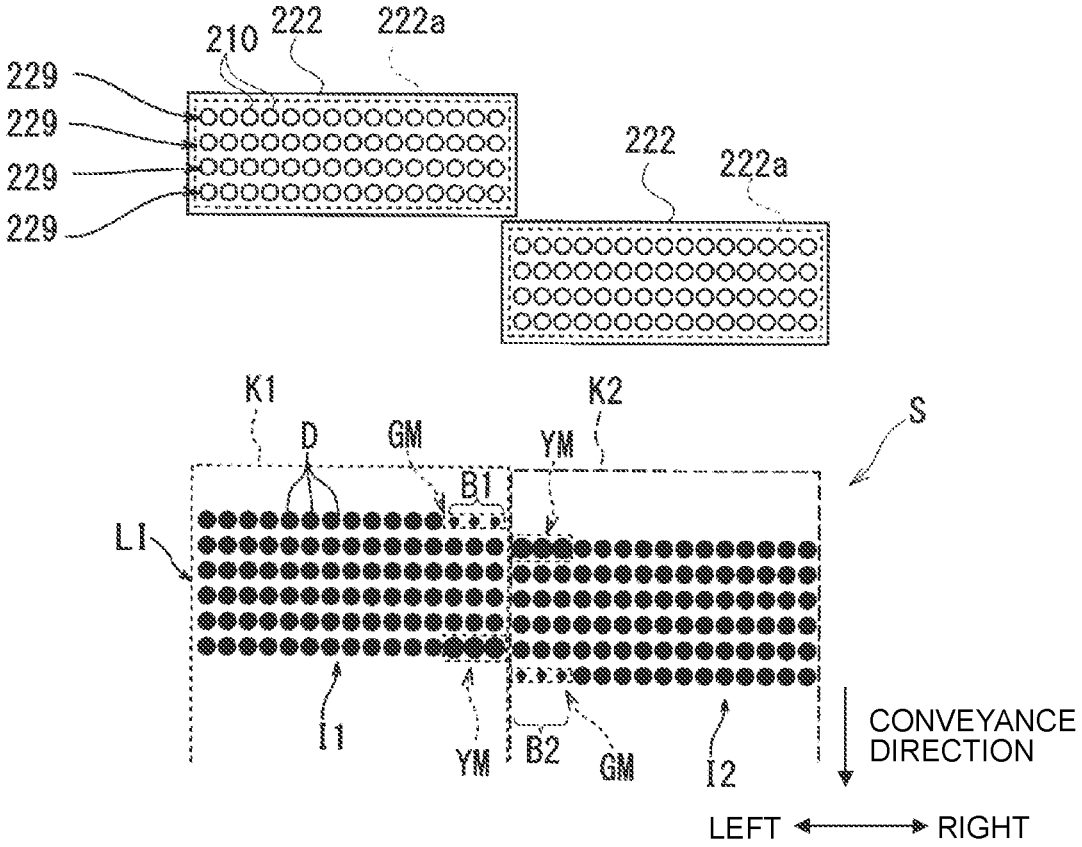
FIG. 26B depicts a specified image provided when the image data is corrected according to a modified embodiment of the sixth embodiment.

Next, a modified embodiment of the sixth embodiment will be explained with reference to FIG. 26B. In this modified embodiment, the controller 250 does not set the both end portions in the conveyance direction of the boundary area B1 as the correcting portions GM, but the controller 250 sets the correcting portion GM at only one end portion in the conveyance direction of the boundary area B1. Similarly, the controller 250 does not set the both end portions in the conveyance direction of the boundary area B2 as the correcting portions GM, but the controller 250 sets the correcting portion GM at only one end portion in the conveyance direction of the boundary area B2. Specifically, if it is assumed that the boundary area B1 is deviated as a whole to the upstream side in the conveyance direction with respect to the boundary area B2, the controller 250 sets the end portion disposed on the upstream side in the conveyance direction of the boundary area B1 and the end portion disposed on the downstream side in the conveyance direction of the boundary area B2 as the correcting portions GM respectively as depicted in FIG. 26B. Similarly, if it is assumed that the boundary area B1 is deviated as a whole to the downstream side in the conveyance direction with respect to the boundary area B2, the controller 250 sets the end portion disposed on the downstream side in the conveyance direction of the boundary area B1 and the end portion disposed on the upstream side in the conveyance direction of the boundary area B2 as the correcting portions GM respectively.

Further, in this modified embodiment as well, the discharge amount of the ink, which can be discharged from the nozzle 10 in one discharge cycle, includes "super-extra-large droplet" in addition to the five types of "extra-large droplet", "large droplet", "middle droplet", "small droplet", and "undischarge" described above in the same manner as the eighth embodiment described above. Then, if the end portion, which is included in the end portions in the conveyance direction of the boundary area B2 and which is disposed on the same side in the conveyance direction as that of the end portion at which the correcting portion GM is set in the boundary area B1, is not set as the correcting portion GM, the controller 250 sets the end portion as the specified end portion YM. Similarly, if the end portion, which is included in the end portions in the conveyance direction of the boundary area B1 and which is disposed on the same side in the conveyance direction as that of the end portion at which the correcting portion GM is set in the boundary area B2, is not set as the correcting portion GM, the controller 250 sets the end portion as the specified end portion YM. In the example depicted in FIG. 26B, the end portion disposed on the downstream side in the conveyance direction of the boundary area B2 is set as the correcting portion GM, and the end portion disposed on the downstream side in the conveyance direction of the boundary area B1 is not set as the correcting portion GM. Therefore, the controller 250 sets the end portion disposed on the downstream side in the conveyance direction of the boundary area B1 as the specified end portion YM. Further, the end portion disposed on the upstream side in the conveyance direction of the boundary area B1 is set as the correcting portion GM, and the end portion disposed on the upstream side in the conveyance direction of the boundary area B2 is not set as the correcting portion GM. Therefore, the controller 250 sets the end portion disposed on the upstream side in the conveyance direction of the boundary area B2 as the specified end portion YM.

Then, the controller 250 also performs the correction such that the discharge amounts, which are set for the dot elements E corresponding to the discharge dots D belonging to the specified end portions YM of the boundary area B1 and the boundary area B2 in the specified image data ESI, are changed from "extra-large droplet" to "super-extra-large droplet" in the image data correcting process.

When the image is recorded on the recording paper S in accordance with the image data IM corrected as described above, it is possible to increase the sizes of the discharge dots D belonging to the specified end portions YM of the boundary area B1 and the boundary area B2 as depicted in FIG. 26B. As a result, it is possible to make the deviation of the specified image LI more hardly conspicuous.

Other modified embodiments will be explained below.

The method for setting the correcting portion is not limited to those of the embodiments described above. For example, in the first to fourth embodiments described above, the controller 50 sets the correcting portions AM for the first boundary area BL and the second boundary area BP of the specified image SI respectively. However, the correcting portion AM may be set for only any one of the boundary areas. Similarly, in the sixth embodiment, the controller 250 sets the correcting portions GM for the boundary area B1 and the boundary area B2 of the specified image LI respectively. However, the correcting portion GM may be set for only any one of the boundary areas.

Further, as described above, the first boundary area BL of the specified image SI is deviated in the scanning direction with respect to the second boundary area BP on account of various factors. However, the deviation direction, which is provided in such a situation, differs depending on the factor. Additionally, the deviation amount, by which the first boundary area BL is deviated with respect to the second boundary area BP on account of each of the factors, differs for each of the printers in some cases. On this account, the deviation direction, in which the first boundary area BL is deviated with respect to the second boundary area BP, differs for each of the printers in some cases. Accordingly, the deviation information, which relates to the deviation direction, is stored in RAM 53 provided for the controller 50, 250 or a memory such as an unillustrated flash memory or the like. The deviation information can be acquired, for example, such that a test pattern or the like is recorded on the recording paper S, and a recording result thereof is read by the reading unit 5. Further, if the deviation direction is not changed in a time-dependent manner, then the deviation information may be acquired upon the shipping from the factory, and the deviation information may be previously stored in the memory of the controller 50, 250. Then, if the specified image SI is recorded while ranging over the boundary between the first dot recording range KL and the second dot recording range KP, the controller 50, 250 decides, on the basis of the deviation information, what end portion of the both end portions in the scanning direction of the first boundary area BL is set as the correcting portion AM and what end portion of the both end portions in the scanning direction of the second boundary area BP is set as the correcting portion AM. According to the configuration as described above, it is possible to more reliably make the deviation of the specified image SI hardly conspicuous.

Further, in the fifth embodiment described above, the controller 50 sets the both end portions in the scanning direction of the image area IF recorded in the overlap area F as the correcting portions FM. However, it is also allowable that only one end portion in the scanning direction of the image area IF is set as the correcting portion FM. Further, in the fifth embodiment, it is also allowable that the controller 50 does not set the correcting portion OM at the boundary area BOL and the boundary area BOP.

Similarly, in the seventh embodiment described above, the controller 250 sets the both end portions in the scanning direction of the image area IJ recorded in the overlap area J as the correcting portions PM. However, it is also allowable that only one end portion in the conveyance direction of the image area IJ is set as the correcting portion PM. Further, in the seventh embodiment, it is also allowable that the controller 250 does not set the correcting portion QM at the boundary area B01 and the boundary area B02.

Further, in the sixth, seventh, and ninth embodiments described above, the number of the ink-jet heads 222 possessed by the recording head unit 220 is two. However, the number is not specifically limited thereto. The number may be three or more. Also in this case, the deviation of the image may occur at the joint portions of the images of the respective two ink-jet heads 222 adjacent to one another in the left-right direction. Therefore, it is necessary to perform the correction of the image data as described above for the respective joint portions.

Further, in the image data correcting process, the controller 50, 250 performs the correction such that the discharge amount, which is set for the dot element E corresponding to the dot belonging to the correcting portion, is decreased from "extra-large droplet" to "large droplet". However, the present disclosure is not specifically limited thereto. It is appropriate to perform the correction in which the discharge amount is decreased. That is, it is also allowable to perform the correction in which the discharge amount is changed from "extra-large droplet" to "undischarge". Further, the discharge amount is evenly decreased by the same amount for the respective dot elements corresponding to the dots belonging to the correcting portion. However, the present disclosure is not specifically limited thereto. The amount of decrease may be changed depending on the position of the corresponding dot. That is, it is also allowable that when the respective dots belonging to the correcting portion are formed, the discharge amounts of the ink discharged from the nozzles 10 are not the same amount. For example, in the first to fifth embodiments, as for the dots belonging to the correcting portions AM of the first boundary area BL and the second boundary area BP, the dots, which are disposed nearer to the boundary between the first dot recording range KL and the second dot recording range KP, may be formed while more decreasing the discharge amounts of the ink. Further, in the sixth embodiment, as for the dots belonging to the correcting portions GM of the boundary area B1 and the boundary area B2, the dots, which are disposed nearer to the boundary between the dot recording range K1 and the dot recording range K2, may be formed while more decreasing the discharge amounts of the ink. Further, in the eighth embodiment, as for the dots belonging to the correcting portions HM of the first boundary area BL and the second boundary area BP, the dots, which are disposed nearer to the boundary between the first dot recording range KL and the second dot recording range KP, may be formed while more increasing the discharge amounts of the ink. Further, in the ninth embodiment, as for the dots belonging to the correcting portions JM of the boundary area B1 and the boundary area B2, the dots, which are disposed nearer to the boundary between the dot recording range K1 and the dot recording range K2, may be formed while more increasing the discharge amounts of the ink.

Further, in the first embodiment described above, the controller 50 sets the nozzle 10 which is positioned on the most upstream in the conveyance direction of the nozzle array 9, as the reference nozzle. However, the present disclosure is not specifically limited thereto. For example, the controller 50 may set the nozzle 10 which is positioned on the most downstream in the conveyance direction of the nozzle array 9, as the reference nozzle. The controller 50 may set the discharge timing of the ink so that the positions in the scanning direction of the dot arrays formed by the ink discharged from the reference nozzle in the respective recording passes are identical with each other. In this situation, in the case of the bidirectional recording mode, the second boundary area BP is deviated as a whole toward the upstream side in the movement direction of the carriage 11 in the following recording pass, with respect to the first boundary area BL. Therefore, the controller 50 sets the end portion disposed on the upstream side in the movement direction of the carriage 11 in the preceding recording pass of the first boundary area BL and the end portion disposed on the upstream side in the movement direction of the carriage 11 in the following recording pass of the second boundary area BP as the correcting portions AM respectively.

Similarly, in the second embodiment described above, the controller 50 sets the nozzle 10 which is positioned on the most downstream in the conveyance direction of the nozzle array 9, as the reference nozzle. However, the present disclosure is not specifically limited thereto. For example, the controller 50 may set the nozzle 10 which is positioned on the most upstream in the conveyance direction of the nozzle array 9, as the reference nozzle. In this situation, the controller 50 sets the end portion disposed on the upstream side in the movement direction of the carriage 11 in the preceding recording pass of the first boundary area BL and the end portion disposed on the upstream side in the movement direction of the carriage 11 in the following recording pass of the second boundary area BP as the correcting portions AM respectively.

In the third embodiment described above, when the specified image SI is the text, and the recording mode is the unidirectional recording mode, if the support state of the recording paper S, which is brought about by the roller pairs 13, 16, is not changed between the preceding recording pass and the following recording pass, then the controller 50 does not perform the correction as described above. On the other hand, even when the recording is performed in the unidirectional recording mode, if the support state of the recording paper S, which is brought about by the roller pairs 13, 16, is changed between the preceding recording pass and the following recording pass, then the controller 50 sets the end portion disposed on the one side of the first boundary area BL and the end portion disposed on the other end side of the second boundary area BP as the correcting portions, and the controller 50 performs the correction to decrease the sizes of the discharge dots D belonging to the correcting portions. However, the present disclosure is not limited thereto.

For example, in the third embodiment, if the deviation in the scanning direction of the recording paper S is scarcely caused by the conveyance of the recording paper S when the state is changed between the state in which the recording paper S is nipped by only one of the roller pairs 13, 16 and the state in which the recording paper S is nipped by the both, then it is also allowable that the controller 50 does not perform the correction as described above at all times when the recording is performed in the unidirectional recording mode.

Alternatively, in the third embodiment, if the recording mode is the unidirectional recording mode irrelevant to whether or not the specified image SI is the text, and the support state of the recording paper S, which is brought about by the roller pairs 13, 16, is changed between the preceding recording pass and the following recording pass, then the controller 50 may set the correcting portions as in the process of C7.

Further, in the example described above, the controller 50, 250 judges whether or not the duty is less than the threshold value in the area adjacent to the correcting portion of the recording paper S depending on whether or not the specified image is the text. However, the present disclosure is not limited thereto. For example, the following procedure is also available. That is, the controller 50, 250 calculates the duty of each of the areas of the recording paper S on the basis of the image data to judge whether or not the duty is less than the threshold value in the area adjacent to the correcting portion on the basis of an obtained result.

Further, in the example described above, for example, the condition that the specified image is the text is exemplified in relation to the condition relevant to the duty, and the controller 50, 250 judges whether or not the correcting portion is set depending on whether or not the condition that the duty is less than the threshold value is fulfilled. However, the present disclosure is not limited thereto. It is also allowable for the controller 50, 250 to judge whether or not the correcting portion is set depending on whether or not another condition relevant to the duty is fulfilled.

Further, in the third embodiment, the controller 50 judges whether or not the correcting portion is set depending on whether or not the condition that the recording mode is the bidirectional recording mode is fulfilled, as the condition which relates to the positional deviation in the scanning direction of the landing position of the ink discharged from the nozzle 10 between the two continuous recording passes. However, the present disclosure is not limited thereto. It is also allowable for the controller 50 to judge whether or not the correcting portion is set on the basis of whether or not any condition other than the condition that the recording mode is the bidirectional recording mode, which relates to the positional deviation in the scanning direction of the landing position of the ink discharged from the nozzle 10 between the two continuous recording passes, is fulfilled.

Further, in the example described above, the controller 50, 250 judges whether or not the correction of the discharge amount as described above is performed individually for each of the specified images. However, the present disclosure is not limited thereto. For example, the following procedure is also available. That is, the controller 50, 250 calculates an average value for the duties for each of the areas of the recording paper S on the basis of the image data of the image to be recorded. If the average value of the duties is less than a threshold value, the correction as described above is performed for all of the specified images. If the average value of the duties is not less than a predetermined value, the correction as described above is not performed for all of the specified images.

Further, in the first to fifth embodiments described above, the configuration is provided such that the difference arises between the upstream and the downstream in the conveyance direction in relation to the gap between the recording paper S and the discharge surface 12*a*1. However, the present disclosure is not limited thereto. It is also allowable that any difference does not arise between the upstream and the downstream in the conveyance direction, and the gap is uniform. In this case, it is unnecessary to take any countermeasure against the deviation of the image caused by the factor of the difference between the upstream and the downstream in the conveyance direction of the gap. Further, it is also allowable that any wavy shape generating mechanism is not provided, and the gap between the recording paper S and the discharge surface 12*a*1 is unchanged and uniform in the scanning direction. In this case, it is unnecessary to take any countermeasure against the deviation of the image caused by the factor of the fluctuation of the gap at the peak portion of the recording paper S. Further, it is also allowable to provide such configuration that the attitude of the carriage 11 is not changed. In this case, it is unnecessary to take any countermeasure against the deviation of the image caused by the factor of the attitude change of the carriage 11.

Further, in the first to fifth embodiments described above, the wavy shape generating mechanism, which generates the wavy shape of the recording paper S, is the mechanism constructed by combining the ribs 20, the lower rollers 16*b*, the plates 14, and the spurs 17. However, the present disclosure is not specifically limited thereto. For example, it is also allowable to provide such a mechanism that the spurs 17 are not provided, and the recording paper S is held from the upper positions by only the plates 14. In this way, even when the recording paper S is held from the upper positions by only the plates 14 as described above, it is possible to generate the wavy shape of the recording paper S.

Further, the holding member, which holds the recording paper S from the upper position, is not limited to the plate 14 and the spur 17 described above. For example, the holding member may be any member which holds the recording paper S from the upper position on the upstream side in the conveyance direction as compared with the ink-jet head 12, for example, in order to prevent the recording paper S from floating and making contact with the discharge surface 12*a*1.

In the second embodiment described above, the holder 119 to which the ink cartridges 26 are detachably installed and the contact member 129 which makes contact with the curved section 127*a* of the supply tubes 127 are arranged at the back of the carriage 11. However, the holder 119 and the contact member 129 may be arranged in front of the carriage 11 in the same manner as the first embodiment. Also in this case, when the tube joint 128, to which the supply tubes 127 are connected, is provided at a position disposed on the upstream side in the conveyance direction as compared with the middle position in the conveyance direction of the ink-jet head 12, the carriage 11 is slightly rotated in a state in which the carriage 11 is positioned within the left end portion range so that the nozzles 10 disposed on the upstream side in the conveyance direction of the nozzle array 9 are moved rightwardly, and the nozzles 10 disposed on the downstream side are moved leftwardly.

Further, in the embodiment described above, the supply tubes 27, 127 are directly connected to the ink cartridges 26 installed to the holder 19, 119. However, the present disclosure is not specifically limited thereto. For example, when flow passages, which are communicated with the installed ink cartridges 26, are provided, for example, at the inside of or on side surfaces of the holder 19, 119, the supply tubes 27, 127 may be connected to the ink cartridges 26 via the flow passages.

In the foregoing description, the explanation has been made about the example in which the present disclosure is applied to the printer for recording the image on the recording paper S by discharging the inks from the nozzles. However, the present disclosure is not limited thereto. The present disclosure is also applicable to an image recording apparatus for recording an image by discharging inks from nozzles with respect to any recording medium other than the recording paper S, for example, a corrugated cardboard or a case of a portable terminal such as a smartphone or the like. Further, the present disclosure is also applicable to an image recording apparatus for recording an image by discharging inks of black, yellow, cyan, and magenta from a head after performing the printing with a white ink as an undercoat on a recording medium composed of a transparent resin such as a transparent film or the like. Further, in the embodiment described above, the image recording apparatus is provided to record the image by discharging the four color inks of black, yellow, cyan, and magenta from the head. However, the present disclosure is not limited thereto. For example, an image recording apparatus is also available, which records an image by discharging six color inks of black, yellow, cyan, magenta, light cyan, and light magenta from a head. Further, the present disclosure is also applicable to an image recording apparatus for recording an image on a recording medium by using any liquid other than the ink.

Further, in the foregoing description, the conveying mechanism for conveying the recording medium is the roller conveying mechanism which uses the conveying roller. However, the present disclosure is not limited thereto. For example, such a conveying mechanism is also available that a recording medium is placed on a belt, and the recording medium is conveyed by allowing the belt to travel or move. Alternatively, such a conveying mechanism is also available that a recording medium is placed on a table, and the recording medium is conveyed by moving the table by means of any moving mechanism such as a ball screw or the like.

What is claimed is:

1. An image recording apparatus comprising:

a conveyer configured to convey a recording medium in a conveyance direction;

a carriage configured to move reciprocatively in a scanning direction intersecting the conveyance direction;

a recording head held on the carriage and including a discharge surface in which nozzle arrays including a plurality of nozzles arranged in the conveyance direction are opened;

a memory configured to store image data which includes a plurality of dot elements corresponding to a plurality of dots to be recorded on the recording medium, and in which discharge amounts of a liquid to be discharged in a case that the corresponding dots are recorded are set for the plurality of dot elements respectively; and a controller configured to execute recording of an image on the recording medium by alternately executing a recording pass in which the dots are recorded on the recording medium by causing the recording head to discharge, from the plurality of nozzles, the liquid in the discharge amounts set for the dot elements of the image data while moving the carriage in the scanning direction and a conveying operation in which the conveyer is caused to convey the recording medium in the conveyance direction, wherein the controller is configured to cause the conveyer to convey the recording medium in the conveyance direction such that dot recording ranges, in which the dots are recorded in two continuous recording passes, are partially overlapped with each other in the conveying operation, in an overlap range in which the dot recording ranges of the two continuous recording passes are overlapped with each other, the controller is configured to cause the recording head to record a dot array corresponding to one line in the scanning direction by the two continuous recording passes while being mutually complemented, in a case that a specified image, which includes a plurality of discharge dots corresponding to the dot elements included in the plurality of dot elements of the image data and having the set discharge amounts larger than zero and which has a width corresponding to the plurality of dots in each of the conveyance direction and the scanning direction, is recorded while ranging over the overlap range, the controller is configured to judge whether or not a predetermined condition is fulfilled, the predetermined condition including at least one of a first condition and a second condition, the first condition relating to a duty as a ratio of an areal size for recording the discharge dots corresponding to the dot elements having the discharge amounts larger than zero with respect to an areal size of an entire area in the area adjacent in the scanning direction to a correcting portion, the second condition relating to a positional deviation in the scanning direction of a landing position of the liquid discharged from the nozzle between the two continuous recording passes, wherein the correcting portion is an end portion in the scanning direction of an image area recorded in the overlap range in the specified image, in a case that the predetermined condition is fulfilled, the controller is configured to cause the recording head to record the dot including the correcting portion by correcting discharge in which the liquid in a discharge amount smaller than the discharge amount set for the dot element corresponding to the dot is discharged from at least one of the plurality of nozzles, and in a case that the predetermined condition is not fulfilled, the controller is configured to cause the recording head to record the dot including the correcting portion by ordinary discharge in which the liquid in the discharge amount set for the dot element corresponding to the dot is discharged from at least one of the plurality of nozzles.

2. The image recording apparatus according claim 1, wherein in a case that the first condition, in which the duty is less than a threshold value owing to the fact that the specified image is a text, is fulfilled as the predetermined condition, the controller is configured to cause the recording head to record the dot including the correcting portion by the correcting discharge.

3. The image recording apparatus according to claim 1, wherein the controller is configured to cause the recording head to record the image by selecting one of a unidirectional recording mode and a bidirectional recording mode, wherein the unidirectional recording mode is a recording mode in which the dots are recorded on the recording medium in accordance with a first recording pass as the recording pass for causing the recording head to discharge the liquid from the plurality of nozzles while moving the carriage to one side in the scanning direction, and the recording head is not caused to discharge the liquid from the plurality of nozzles when the carriage is moved to the other side in the scanning direction, the bidirectional recording mode is a recording mode in which the dots are recorded on the recording medium in accordance with the first recording pass and a second recording pass as the recording pass for causing the recording head to discharge the liquid from the plurality of nozzles while moving the carriage to the other side in the scanning direction, and in a case that the second condition, in which the image is recorded in accordance with the bidirectional recording mode, is fulfilled as the predetermined condition, the controller is configured to cause the recording head to record the dot including the correcting portion by the correcting discharge.

4. The image recording apparatus according to claim 3, wherein the conveyer includes:

a first conveying roller pair which is arranged on an upstream side in the conveyance direction from the recording head and which is configured to nip the recording medium and convey the recording medium in the conveyance direction; and a second conveying roller pair which is arranged on a downstream side in the conveyance direction from the recording head and which is configured to nip the recording medium and convey the recording medium in the conveyance direction, and in a case that the second condition, in which the image is recorded by the unidirectional recording mode, the recording medium is nipped by both of the first conveying roller pair and the second conveying roller pair in one recording pass of the two continuous recording passes, and the recording medium is nipped by only one of the first conveying roller pair and the second conveying roller pair in the other recording pass, is fulfilled as the predetermined condition, the controller is configured to cause the recording head to record the dot including the correcting portion by the correcting discharge.

5. The image recording apparatus according to claim 1, wherein in a case that a plurality of the specified images, which are aligned in the scanning direction, are recorded while ranging over the boundary between the first dot recording range and the second dot recording range, the controller is configured to judge whether or not the predetermined condition is fulfilled individually for each of the plurality of specified images.

6. An image recording apparatus comprising:

a conveyer configured to convey a recording medium in a conveyance direction;

a head bar including a plurality of recording heads each including nozzle arrays having a plurality of nozzles arranged in an intersecting direction intersecting the conveyance direction, the plurality of recording heads being aligned in the intersecting direction such that arrangement areas, in which the nozzles are opened, are not overlapped with each other in the conveyance direction, in relation to each of the recording heads adjoining in the intersecting direction, of the plurality of recording heads;

a memory configured to store image data which includes a plurality of dot elements corresponding to a plurality of dots to be recorded on the recording medium, and in which discharge amounts of a liquid to be discharged in a case that the corresponding dots are recorded are set for the plurality of dot elements respectively; and a controller configured to execute recording of an image on the recording medium by recording the dots on the recording medium by causing the head bar to discharge, from the plurality of nozzles, the liquid in the discharge amounts set for the dot elements of the image data while causing the conveyer to convey the recording medium in the conveyance direction, wherein in a case that a specified image, which includes a plurality of discharge dots corresponding to the dot elements included in the plurality of dot elements of the image data and having the set discharge amounts larger than zero and which has a width corresponding to the plurality of dots in each of the conveyance direction and the scanning direction, is recorded while ranging over a boundary between a first dot recording range in which the dots are recorded by one of the two adjoining recording heads and a second dot recording range in which the dots are recorded by the other, the controller is configured to judge whether or not a predetermined condition is fulfilled, the predetermined condition relating to a duty as a ratio of an areal size for recording the discharge dots corresponding to the dot elements having the discharge amounts larger than zero with respect to an areal size of an entire area in the area adjacent in the scanning direction to a correcting portion, wherein the correcting portion is an end portion in the conveyance direction of a specified area, and the specified area is at least one boundary area of a first boundary area and a second boundary area, the first boundary area included in a first image area recorded in the first dot recording range in the specified image, being adjacent to the second dot recording range, and being shorter than a length of the first dot recording range in the intersecting direction, the second boundary area included in a second image area recorded in the second dot recording range, being adjacent to the first dot recording range, and being shorter than a length of the second dot recording range in the intersecting direction, in a case that the predetermined condition is fulfilled, the controller is configured to cause the head bar to record the dot including the correcting portion by correcting discharge in which the liquid in a discharge amount smaller than the discharge amount set for the dot element corresponding to the dot is discharged from at least one of the plurality of nozzles, and in a case that the predetermined condition is not fulfilled, the controller is configured to cause the head bar to record the dot including the correcting portion by ordinary discharge in which the liquid in the discharge amount set for the dot element corresponding to the dot is discharged from at least one of the plurality of nozzles.

* * * * *